US005187042A

United States Patent [19]

Katoh et al.

[11] Patent Number: 5,187,042

[45] Date of Patent: * Feb. 16, 1993

[54] SILVER HALIDE PHOTOGRAPHIC MATERIAL

[75] Inventors: Kazunobu Katoh; Hisashi Okamura; Hisashi Okada; Nobuaki Inoue; Toshiro Takahashi; Morio Yagihara; Tetsuo Yamaguchi, all of Kanagawa, Japan

[73] Assignee: Fuji Photo Film Co., Ltd., Kanagawa, Japan

[ * ] Notice: The portion of the term of this patent subsequent to Feb. 4, 2009 has been disclaimed.

[21] Appl. No.: 515,882

[22] Filed: Apr. 27, 1990

[30] Foreign Application Priority Data

| | | | |
|---|---|---|---|
| Apr. 27, 1989 | [JP] | Japan | 1-108216 |
| Apr. 28, 1989 | [JP] | Japan | 1-109981 |
| May 2, 1989 | [JP] | Japan | 1-113093 |
| May 23, 1989 | [JP] | Japan | 1-129226 |
| Jun. 7, 1989 | [JP] | Japan | 1-144721 |

[51] Int. Cl.[5] ..... G03C 1/09; G03C 1/42

[52] U.S. Cl. ..... 430/264; 430/222; 430/223; 430/522; 430/544; 430/546; 430/566; 430/572; 430/600; 430/603; 430/605; 430/598; 430/957

[58] Field of Search ..... 430/222, 223, 264, 566, 430/572, 544, 546, 598, 957, 522, 600, 603, 605

[56] References Cited

U.S. PATENT DOCUMENTS

| | | | |
|---|---|---|---|
| 4,288,535 | 9/1981 | Kanisawa et al. | 430/569 |
| 4,447,522 | 5/1984 | Hirano et al. | 430/405 |
| 4,684,604 | 8/1987 | Harder | 430/375 |
| 4,722,884 | 2/1988 | Inoue et al. | 430/446 |
| 4,755,448 | 7/1988 | Katoh | 430/266 |
| 4,762,769 | 8/1988 | Takahashi et al. | 430/264 |
| 4,800,150 | 1/1989 | Katoh | 430/264 |
| 4,904,565 | 2/1990 | Schmidt et al. | 430/264 |
| 4,914,002 | 4/1990 | Inoue et al. | 430/264 |
| 4,956,257 | 9/1990 | Inoue | 430/264 |

FOREIGN PATENT DOCUMENTS

| | | | |
|---|---|---|---|
| 2528777 | 6/1974 | Fed. Rep. of Germany | 430/522 |
| 2521994 | 12/1975 | Fed. Rep. of Germany | 430/522 |
| 61-213847 | 9/1986 | Japan | 430/598 |
| 62-245263 | 10/1987 | Japan | 430/957 |
| 63-046450 | 2/1988 | Japan | 430/544 |
| 1-072140 | 3/1989 | Japan | 430/569 |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide photographic material comprising a support having thereon at least one sensitive silver halide emulsion layer, wherein said emulsion layer comprises a monodisperse emulsion and said emulsion layer or other hydrophilic colloid layer contains at least one hydrazine derivative and at least one redox compound capable of releasing a development inhibitor when oxidized.

5 Claims, No Drawings

SILVER HALIDE PHOTOGRAPHIC MATERIAL

FIELD OF THE INVENTION

The present invention relates to a silver halide photographic material (particularly, negative type) which is used in the field of photoengraving and enables an ultrahigh contrast image to be rapidly formed with highly stable processing solutions.

BACKGROUND OF THE INVENTION

It is highly demanded to provide photographic materials having good original reproducibility and stable processing solutions and to simplify replenishment in the field of photoengraving to cope with the variety and complexity of prints.

Particularly, the originals in line work stage are prepared by inserting phototypeset letters, handwritten letters, illustrations and dotted photographs. Accordingly, images having different densities and line widths are included in the originals. Hence, it is highly demanded to provide process cameras, photographic materials or image forming methods which can finish these originals with good reproducibility. On the other hand, the enlargement of halftone photographs ("spread") or the reduction of halftone photographs ("choke") is widely carried out for the photoengraving of catalogs or large size posters. In the photoengraving wherein halftone dots are enlarged, the number of lines is roughened and dots which are out of focus are photographed. In the reduction, the number of lines/inch is increased in comparison with the original and finer dots are photographed. Therefore, image forming methods having a much greater latitude are required for keeping the reproducibility of halftone gradation.

Halogen lamps or xenon lamps are used as light sources for process cameras. Generally, photographic materials are subjected to orthosensitization to obtain photographing sensitivity to these light sources. However, it has been found that orthosensitized photographic materials are more affected by the chromatic aberration of lenses and hence image quality is liable to be deteriorated. This deterioration is remarkable with xenon lamps.

As a system for meeting the requirement for obtaining a large latitude, there has been proposed a method for obtaining a halftone image or line original having a high contrast and a high blackening density wherein the image area and the nonimage area are clearly distinguished from each other by processing lith type silver halide photographic materials comprising silver chlorobromide (having a silver chloride content of at least 50%) with hydroquinone developing solutions containing sulfite ion at a very low effective concentration (usually not higher than 0.1 mol/liter). However, since the concentration of sulfite in the developing solutions is low in this method, the solutions are unstable against oxidation by air. Various attempts have been made to preserve the activity of developing solutions but these have resulted in very slow processing speeds and low working efficiencies.

Accordingly, there have been proposed image forming systems which solve the problems of unstableness in the formation of image by the above-described development method (lith development system), enable development to be carried out with processing solutions having good storage stability and give high contrast photographic characteristics. For example, U.S. Pat. Nos. 4,166,742, 4,168,977, 4,221,857, 4,224,401, 4,243,739, 4,272,600 and 4,311,781 disclose systems wherein surface latent image type silver halide photographic materials containing specific acylhydrazine compounds are processed with developing solutions having a pH of 11.0 to 12.3, containing a sulfite preservative in an amount of at least 0.15 mol/liter and having good storage stability to form ultrahigh contrast negative images having a gamma ($\gamma$) value exceeding 10. These new image forming systems have such characteristics that silver iodobromide as well as silver chloroiodobromide can be used, while only silver chlorobromide having a high silver chloride content can be used in conventional ultrahigh contrast image formation.

Though the above-described image forming systems have excellent performance with regard to the quality of sharp halftone dots, processing stability, quickness and the reproducibility of the original, it is highly demanded to provide systems wherein the reproducibility of the original and processing stability are further improved to cope with the increasing variety of types of prints.

Systems using hydrazine compounds, which contain redox compounds releasing development inhibitors when oxidized, are disclosed in JP-A-61-213847 (the term "JP-A" as used herein refers to a "published unexamined Japanese patent application") and JPA-64-72140.

However, it has been found that the dependence on these methods of development is not preferred.

SUMMARY OF THE INVENTION

An object of the present invention is to provide a photographic material which gives excellent image quality suitable for line original or halftone enlargement and halftone reduction.

Another object of the present invention is to provide a silver halide photographic material which scarcely causes lowering in pH of the developer even when films in large quantities are processed and which scarcely causes lowering in sensitivity, gamma ($\gamma$) value and Dmax even when the concentration of bromine ion is increased.

The above-described objects of the present invention have been achieved by a silver halide photographic material comprising a support having thereon at least one light-sensitive silver-halide emulsion layer, wherein the emulsion layer comprises a monodisperse system and the emulsion layer or other hydrophilic colloid layer contains at least one hydrazine derivative and at least one redox compound capable of releasing a development inhibitor when oxidized.

DETAILED DESCRIPTION OF THE INVENTION

Examples of the redox groups of the redox compounds which release development inhibitors when oxidized and can be used in the present invention include hydroquinones, catechols, naphthohydroquinones, aminophenols, pyrazolidone, hydrazines, hydroxylamines and reductones. Hydrazines are preferred as the redox group. Compounds represented by the following formula (I) are particularly preferred as the redox group.

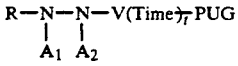

(I)

wherein both $A_1$ and $A_2$ represent hydrogen atoms, or one of $A_1$ and $A_2$ represents a hydrogen atom and the other represents a residue of a sulfinic acid or

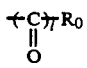

(wherein $R_0$ represents an alkyl group, an alkenyl group, an aryl group, an alkoxy group or an aryloxy group; and l represents 1 or 2); Time represents a bivalent bonding group; t represents 0 or 1; PUG represents a development inhibitor; V represents a carbonyl group,

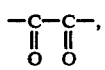

a sulfonyl group, a sulfonyl group, a sulfoxy group,

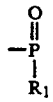

(wherein $R_1$ represents an alkoxy group or an aryloxy group), an iminomethylene group or a thiocarbonyl group; and R represents an aliphatic group, an aromatic group or a heterocyclic group.

The compound of formula (I) will be illustrated in more detail below.

In formula (I), $A_1$ and $A_2$ are each a hydrogen atom, an alkylsulfonyl group having not more than 20 carbon atoms, an arylsulfonyl group having not more than 20 carbon atoms (preferably a phenylsulfonyl group or a substituted phenylsulfonyl group having such a degree of substitution that the sum of Hammett's substituent constant is not less than −0.5) or

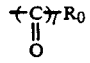

[wherein $R_0$ is preferably a straight chain, branched or cyclic alkyl group having not more than 30 carbon atoms, an alkenyl group, an aryl group (preferably a phenyl group or a substituted phenyl group having such a degree of substitution that the sum of Hammett's substituent constant is not less than −0.5), an alkoxy group (e.g., ethoxy) or an aryl group (preferably a monocyclic aryl group)]. These groups may be substituted by one or more substituent groups. Examples of the substituent groups which may be further substituted include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a carboxyl group, an aryloxycarbonyl group, an acyl group, an alkoxycarbonyl group, an acyloxy group, a carbonamido group, a sulfonamido group and a nitro group. Concretely, examples of the residues of sulfinic acids represented by $A_1$ and $A_2$ include those described in U.S. Pat. No. 4,478,928.

$A_1$ may be combined together with $(Time)_t$ described before to form a ring.

The compounds where both $A_1$ and $A_2$ are hydrogen atoms are most preferred.

Time is a bivalent bonding group and may have a timing controlling function; and t is 0 or 1. When t=0, PUG is directly attached to V.

The bivalent bonding group represented by Time is a group which releases PUG from Time-PUG through one stage or multistage reaction step, said Time-PUG being released from the oxidant of the redox nucleus.

Examples of the bivalent bonding group represented by Time include those which release the photographically useful group (PUG) by the intramolecular cyclization reaction of p-nitrophenoxy derivatives as described in U.S. Pat. No. 4,248,962 (JP-A-54-145135); those which release PUG by an intramolecular cylication reaction after ring cleavage as described in U.S. Pat. Nos. 4,310,612 (JP-A-55-5330) and 4,358,252; those which release PUG and involve the formation of acid anhydrides by the intramolecular cyclization reaction of succinic monoesters or carboxyl group of analogs thereof as described in U.S. Pat. No. 4,330,617, 4,446,216 and 4,483,919 and JP-A-59-121328; those which release PUG and involve the formation of quinomonomethane or analogs thereof by the electron transfer of an aryloxy group or a heterocyclic oxy group through conjugated double bond as described in U.S. Pat. Nos. 4,409,323 and 4,421,845, *Research Disclosure,* No. 21228 (December, 1981), U.S. Pat. No. 4,416,977 (JP-A-57-135944), JP-A-58-209736 and JP-A-58-209738; those which release PUG from the γ-position of enamines by the electron transfer of a moiety having a nitrogen-containing heterocyclic enamine structure as described in U.S. Pat. Nos. 4,420,554 (JP-A-57-136640), JP-A-57-135945, JP-A-57-188035, JP-A-58-98728 and JP-A-58-209737; those which release PUG by the intramolecular cyclization reaction of an oxy group formed by electron transfer to a carbonyl group conjugated with the nitrogen atom of a nitrogen-containing heterocyclic ring as described in JP-A-57-56837; those which release PUG and involve the formation of aldehydes as described in U.S. Pat. No. 4,146,396 (JP-A-52-90932), JP-A-59-93442 and JP-A-59-75475; those which release PUG and involve the decarbonization of a carboxyl group as described in JP-A-51-146828, JP-A-57-179842 and JP-A-59-104641; those which have a structure of —O—$COOCR_2R_b$—PUG, in which $R_2$ and $R_b$ each represents a monovalent group, and release PUG and involve decarboxylation and subsequently the formation of aldehydes; those which release PUG and involve the formation of isocyanates as described in JP-A-60-7429; and those which release PUG by a coupling reaction with the oxidants of color developing agents as described in U.S. Pat. No. 4,438,193.

Specific examples of the bivalent bonding group represented by Time are also described in JP-A-61-236549 and JP-A-1-269936. Preferred examples of the bivalent bonding group include the following groups. In the following formulae, the mark (*) represents a site where $(Time)_t$PUG is attached to V in formula (I) and the mark (*)(*) represents a site where the group is attached to PUG.

T-(1)
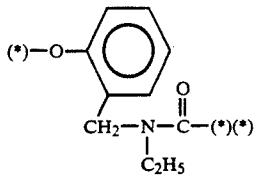
T-(2)
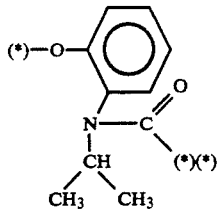
T-(3)
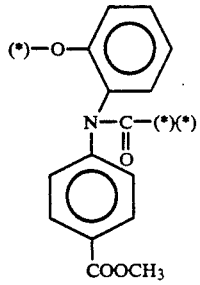
T-(4)
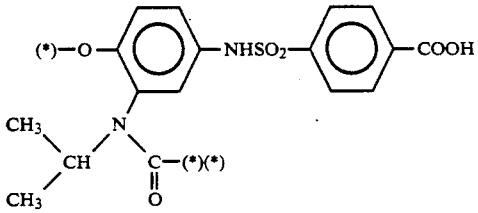
T-(5)
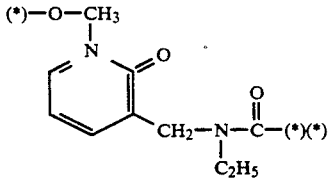
T-(6)
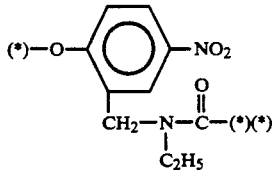
T-(7)
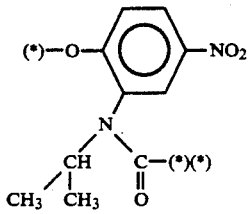
-continued
T-(8)
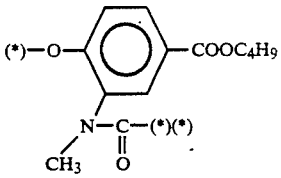
T-(9)
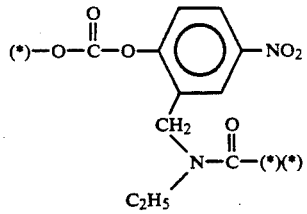
T-(10)
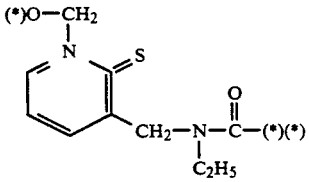
T-(11)
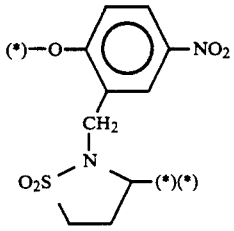
T-(12)
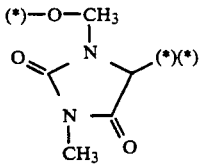
T-(13)
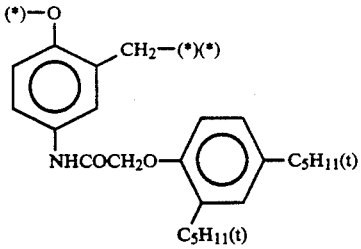
T-(14)
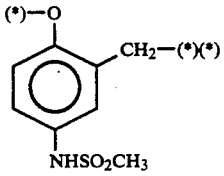
T-(15)
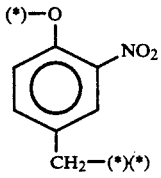

-continued
T-(16)
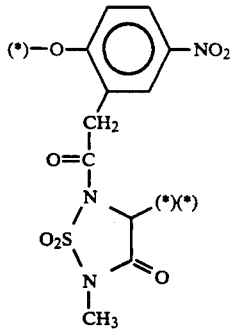
T-(17)
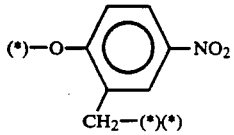
T-(18)
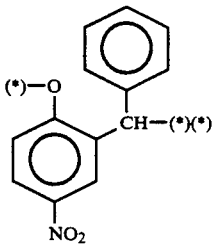
T-(19)
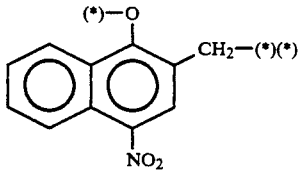
T-(20)
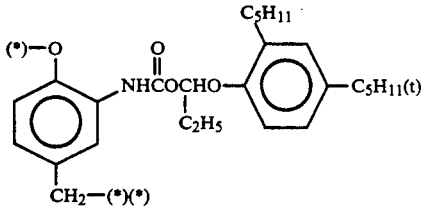
T-(21)
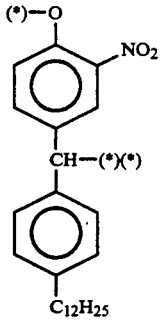
T-(22)
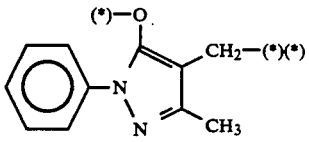
-continued
T-(23)
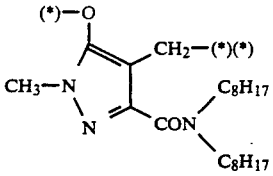
T-(24)
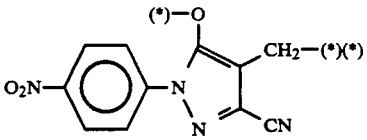
T-(25)
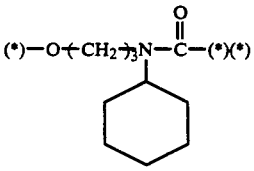
T-(26)
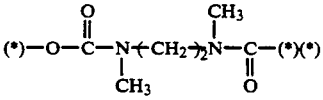
T-(27)
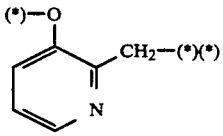
T-(28)
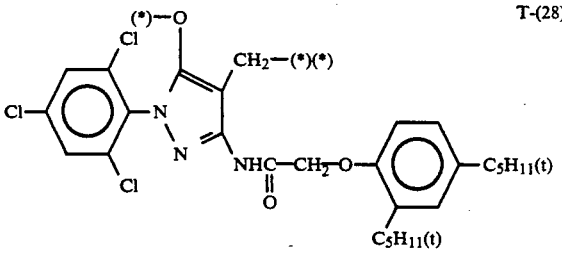
T-(29)
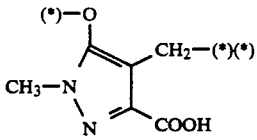
T-(30)
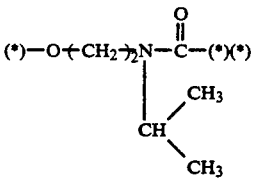
T-(31)
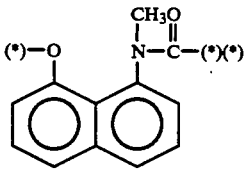
T-(32)
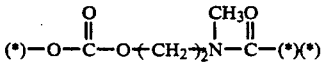

-continued

T-(33) $(*)-O-CH_2-(*)(*)$

T-(34) $(*)-O-CH(COOC_2H_5)-(*)(*)$

T-(35) 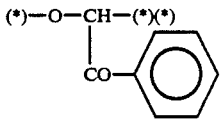

T-(36) 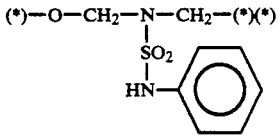

T-(37) 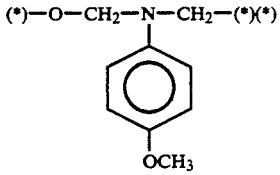

T-(38) 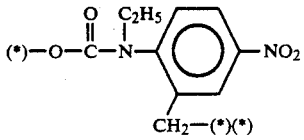

T-(39) 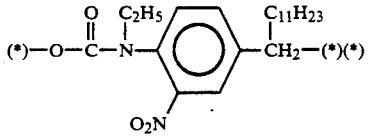

T-(40) 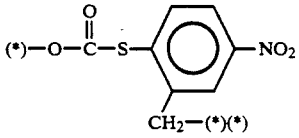

T-(41) 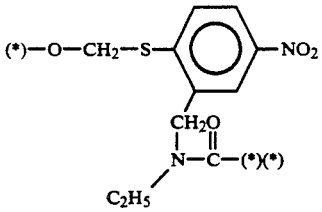

T-(42) 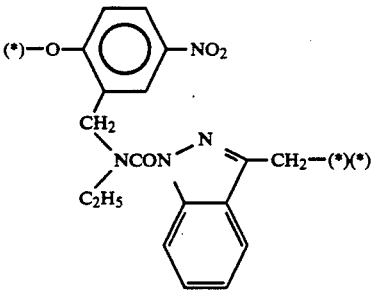

PUG is a group having a development restraining effect as (Time)$_T$PUG or PUG.

Development inhibitors represented by PUG or (Time)$_T$PUG are conventional development inhibitors which have a hetero atom and are attached through the hetero atom to (Time)$_T$ and are described in C. E. K. Mees and T. H. James, *The Theory of Photographic Processes,* Third Edition, pages 344 to 346 (1966) (Macmillan). Examples of the development inhibitors include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes and mercaptotriazoles.

The development inhibitor represented by PUG may be substituted by one or more substituent groups which may be further substituted.

Examples of the substituent groups include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a nitro group, a cyano group, a sulfo group, an alkyloxycarbonyl group, an aryloxycarbonyl group, an acyl group, an alkoxycarbonyl group, an acyloxy group, a carboxyamido group, an sulfonamido group, a carboxyl group, a sulfoxy group, a phosphono group, a phosphinico group and a phosphoric amido group.

Among them, preferred substituent groups are a nitro group, a sulfo group, a carboxyl group, a sulfamoyl group, a phosphono group, a phosphinico group and a sulfonamido group.

Typical examples of the development inhibitors include the following compounds.

1 MERCAPTOTETRAZOLE DERIVATIVES (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-($\alpha$-Naphthyl)-5-mercaptotetrazole
(19) 1-(4-Sulfophenyl)-5-mercaptotetrazole
(20) 1-(3-Sulfophenyl)-5-mercaptotetrazole
(21) 1-($\beta$-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole

(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazole)ethyltrimethylammonium chloride
(34) 1-(3-phenoxycarbonylphenyl)-5-mercaptotetrazole
(35) 1-(3-Maleinimidophenyl)-6-mercaptotetrazole

2 MERCAPTOTRIAZOLE DERIVATIVES (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole

3 MERCAPTOIMIDAZOLE DERIVATIVES (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole

4MERCAPTOPYRIMIDINE DERIVATIVES (1) Thiouracil
(2) Methylthiouracil
(3) Ethylthiouracil
(4) Propylthiouracil
(5) Nonylthiouracil
(6) Aminothiouracil
(7) Hydroxythiouracil

5 MERCAPTOBENZIMIDAZOLE DERIVATIVES (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole

6 MERCAPTOTHIADIAZOLE DERIVATIVES (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole

7 MERCAPTOBENZOTHIAZOLE DERIVATIVES (1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole

8 MERCAPTOBENZOXAZOLE DERIVATIVES (1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9 1 BENZOTRIAZOLE DERIVATIVES (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole Na salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole

10 BENZIMIDAZOLE DERIVATIVES (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole

11 INDAZOLE DERIVATIVES (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole

12 TETRAZOLE DERIVATIVES (1) 5-(4-Nitrophenyl)tetrazole
(2) 5-Phenyltetrazole
(3) 5-(3-Carboxyphenyl)tetrazole

13 TETRAAZAINDENE DERIVATIVES (1) 4-Hydroxy-6-methyl-5-nitro-1,3,3a,7-tetraazaindene
(2) 4-Mercapto-6-methyl-5-nitro-1,3,3a,7-tetraazaindene

14 MERCAPTOARYL DERIVATIVES (1) 4-Nitrothiophenol
(2) Thiophenol
(3) 2-Carboxythiophenol V is a carbonyl group,

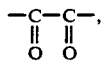

a sulfonyl group, a sulfoxy group,

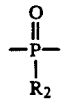

(wherein $R_2$ is an alkoxy group or an aryloxy group), an iminomethylene group or a thiocarbonyl group. Preferably, V is a carbonyl group.

The aliphatic group represented by R is a straight chain, branched or cyclic alkyl, alkenyl or alkynyl group having preferably 1 to 30 carbon atoms, particularly preferably 1 to 20 carbon atoms. The branched alkyl group may be cyclized so as to form a saturated heterocyclic ring having one or more hetero atoms.

Examples of the aliphatic group include a methyl group, a t-butyl group, an n-octyl group, a t-octyl group, a cyclohexyl group, a hexenyl group, a pyrrolidyl group, a tetrahydrofuryl group and an n-dodecyl group.

The aromatic group represented by R is a monocyclic or bicyclic aryl group such as a phenyl group and a naphthyl group.

The heterocyclic group represented by R is a 3-membered to 10-membered saturated or unsaturated heterocyclic ring having at least one atom of N, 0 and S atoms. The ring may be a monocyclic ring or may form a condensed ring together with another aromatic ring or heterocyclic ring. Preferably, the heterocyclic ring is a 5-membered or 6-membered aromatic heterocyclic ring. Examples of the heterocyclic group include a pyridyl group, an imidazolyl group, a quinolinyl group, a benzimidazolyl group, a pyrimidinyl group, a pyrazolyl group, an isoquinolinyl group, a benzothiazolyl group and a thiazolyl group.

The group R may be substituted by one or more substituent groups which may be further substituted.

Examples of the substituent groups include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group and a phosphoric acid amido group.

In formula (I), R or $\text{-(Time)}_n\text{PUG}$ may have, as a moiety thereof, a ballast group commonly used in non-diffusible photographic additives such as couplers or a group capable of accelerating the adsorption of the compound of formula (I) on silver halide.

The ballast group is an organic group which gives such a sufficient molecular weight that the compound of formula (I) cannot be substantially dispersed in other layers or processing solutions. Examples thereof include an alkyl group, an aryl group, a heterocyclic group, an ether group, a thioether group, an amido group, a ureido group, a urethane group and a sulfonamido group singly or a combination of two or more of them. A ballast group having a substituted benzene ring is preferred. A ballast group having a branched alkyl-substituted benzene ring is particularly preferred.

Examples of the group capable of accelerating the adsorption of the compound on silver halide include cyclic thioamido groups, linear thioamido groups, aliphatic mercapto groups, aromatic mercapto groups, heterocyclic mercapto groups (when the atom next to the carbon atom to which an —SH group is attached is a nitrogen atom, it has the same meaning as the cyclic thioamido group existing in tautomeric relation thereto, and examples of both groups are the same as described below) and groups having a disulfide bond such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidazoline-2-thione; 5-membered or 6-membered nitrogen-containing heterocyclic groups having a combination of nitrogen, oxygen, sulfur and carbon atoms such as benzotriazole, triazole, tetrazole, indazole, benzimidazole, imidazole, benzothiazole, thiazole, thiazoline, benzoxazole, oxazole, oxazoline, thiazole, oxathiazole, triazine and azaindene; and heterocyclic quaternary salts such as benzimidazolinium.

These groups may be substituted by one or more substituent groups. Examples of the substituent groups include those already described above in the definition of the substituent groups for R.

Examples of the compounds which can be used in the present invention include, but are not limited to, the following compounds.

1.

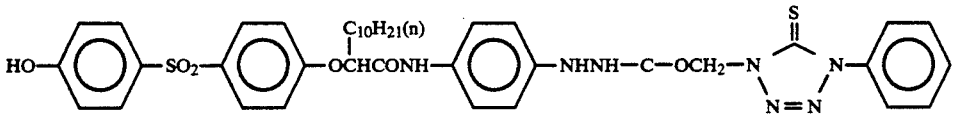

2.

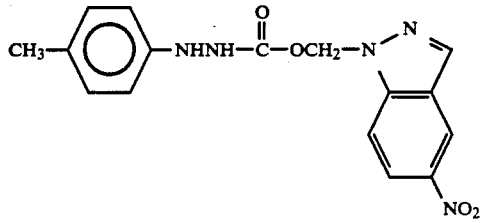

-continued
3.
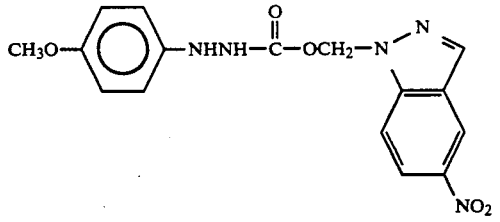
4.
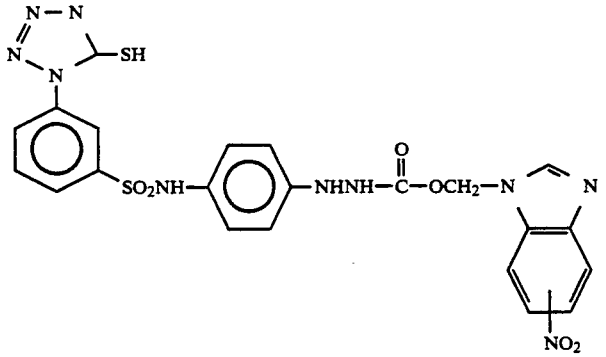
5.
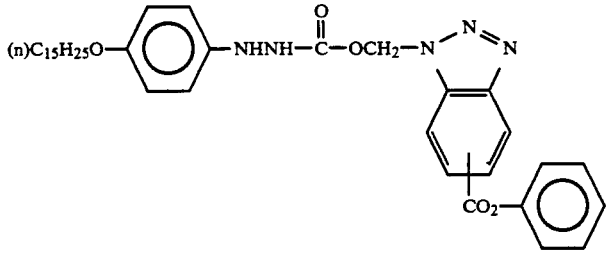
6.
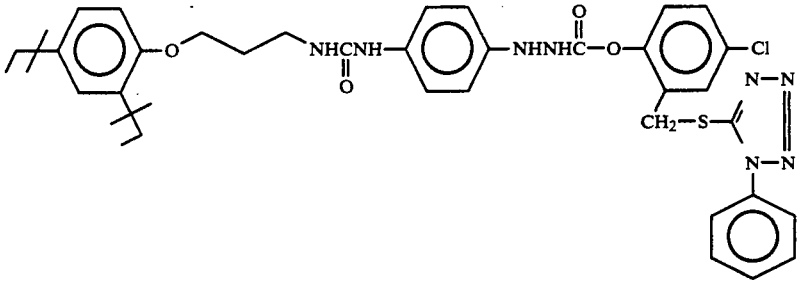
7.
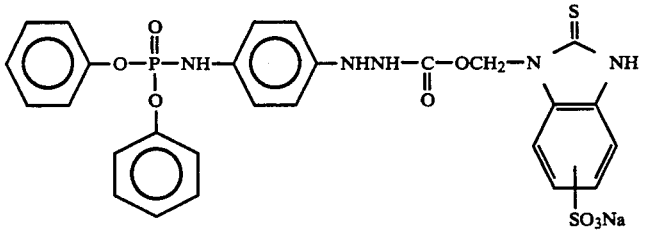
8.
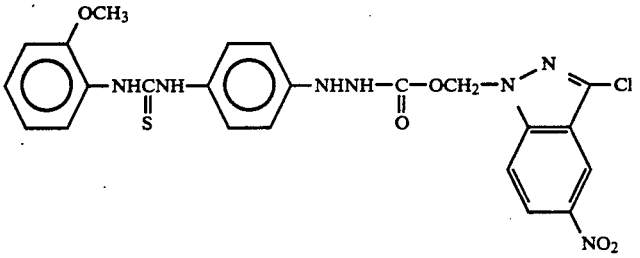

-continued
9.
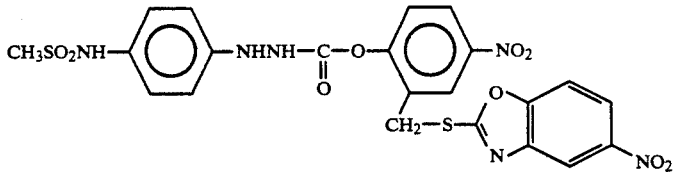
10.
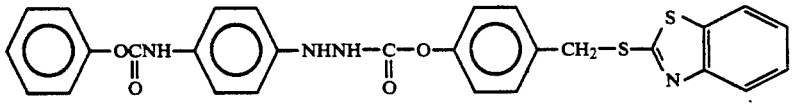
11.
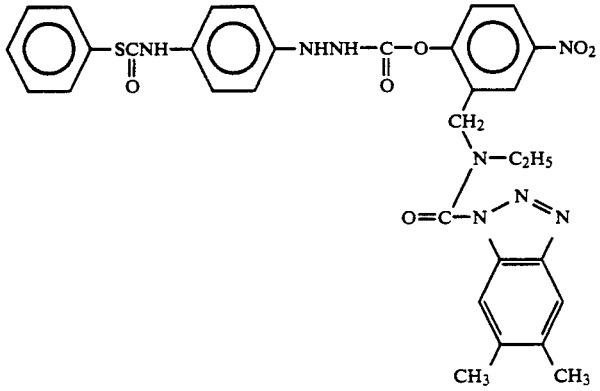
12.
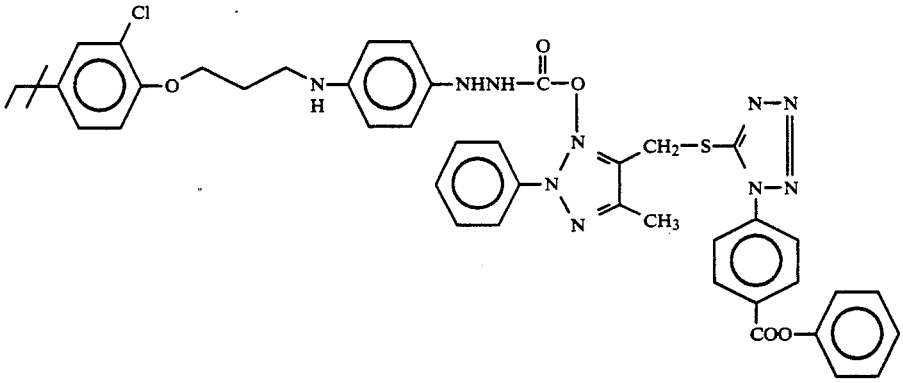
13.
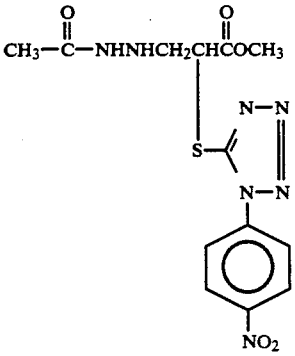

-continued
14.
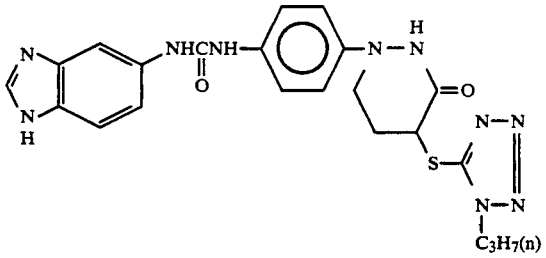
15.
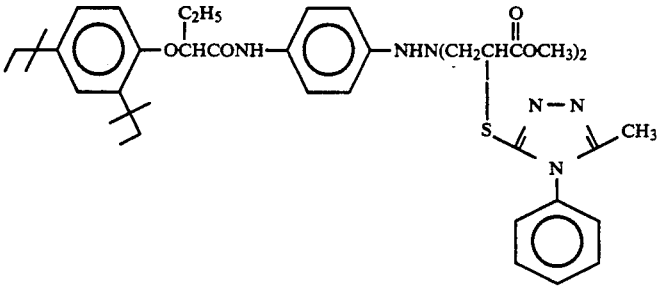
16.
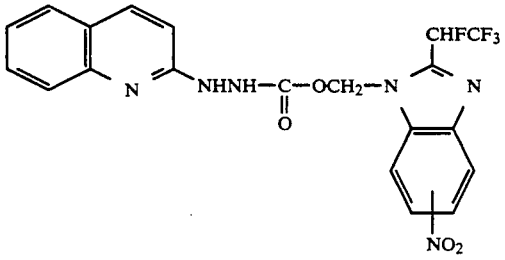
17.
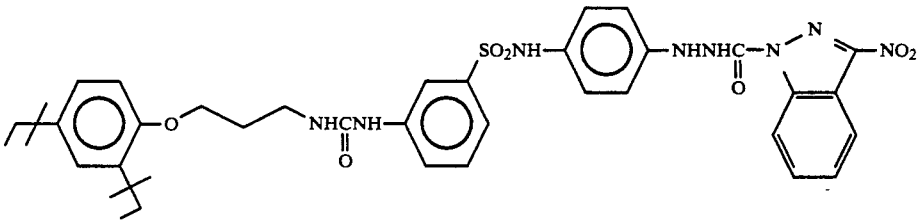
18.
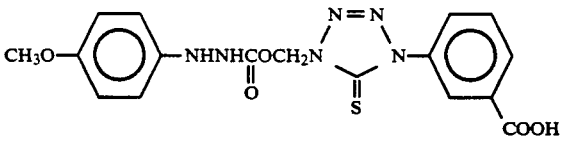
19.
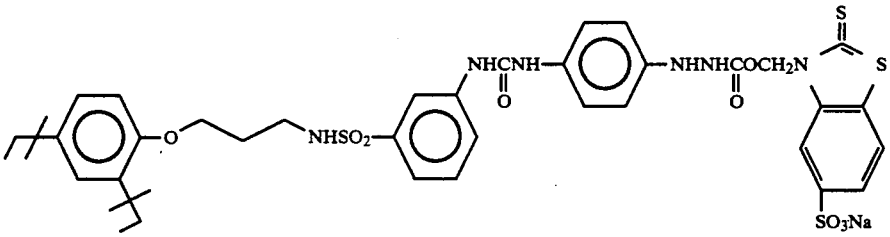
20.
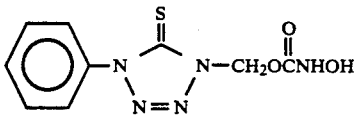

-continued
21.
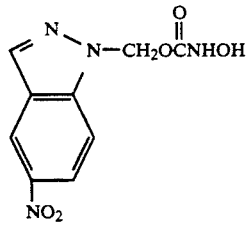
22.
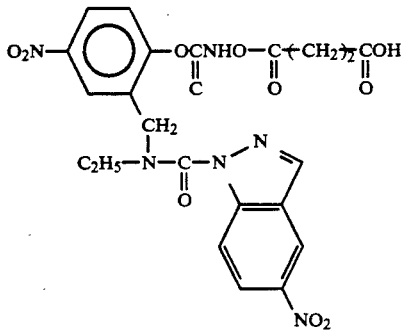
23.
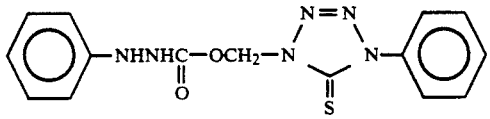
24.
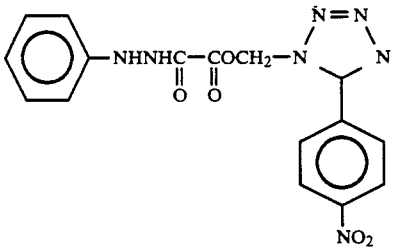
25.
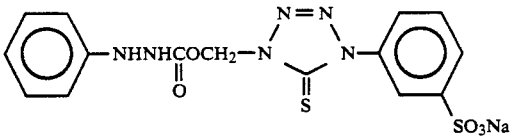
26.
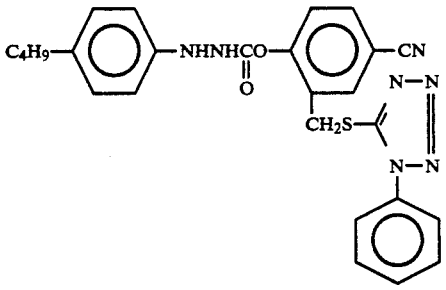
27.
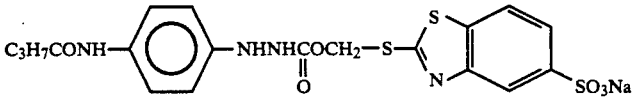

-continued
28.
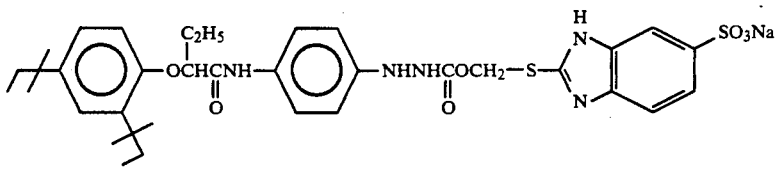
29.
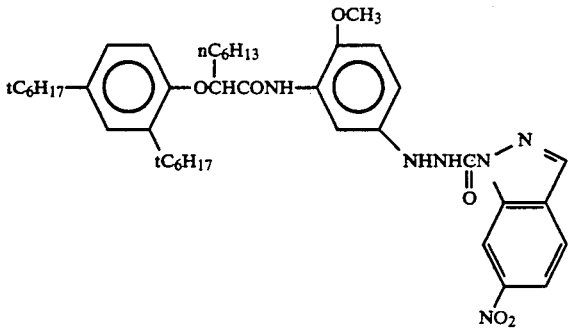
30.
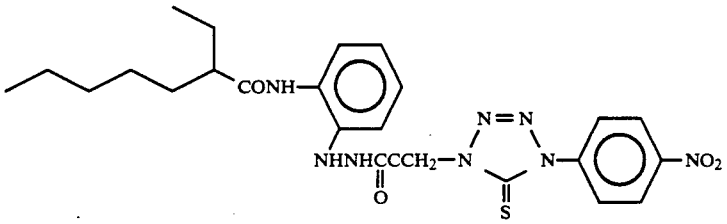
31.
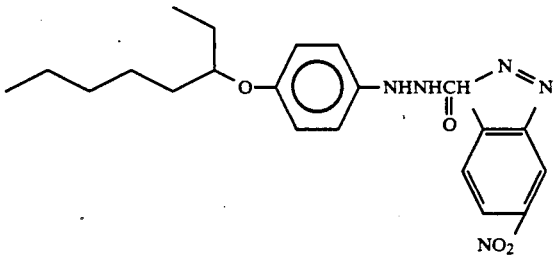
32.
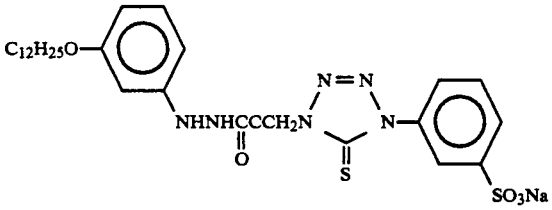
33.
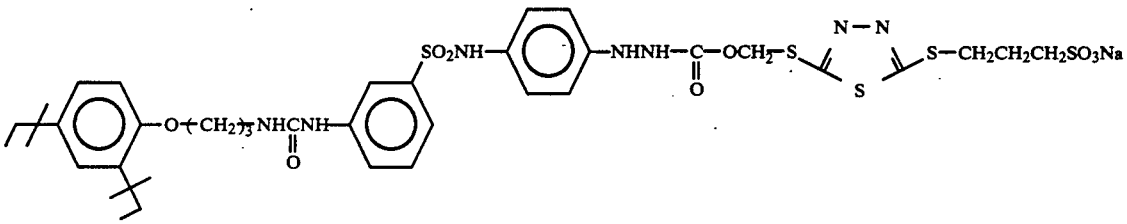

-continued
34.
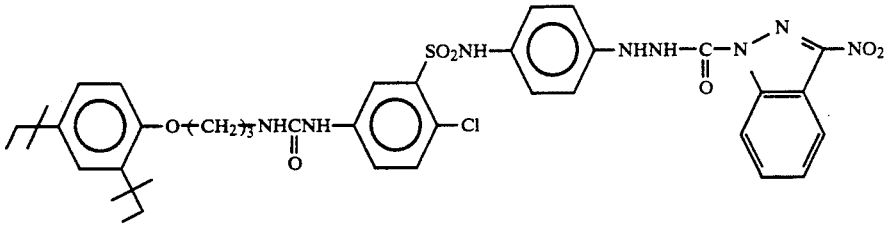
35.
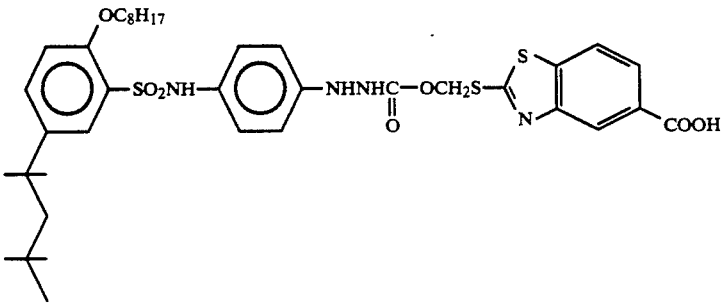
36.
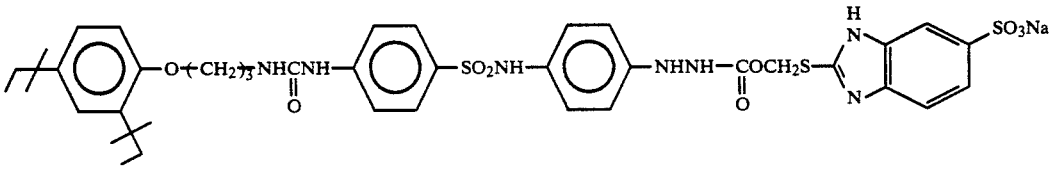
37.
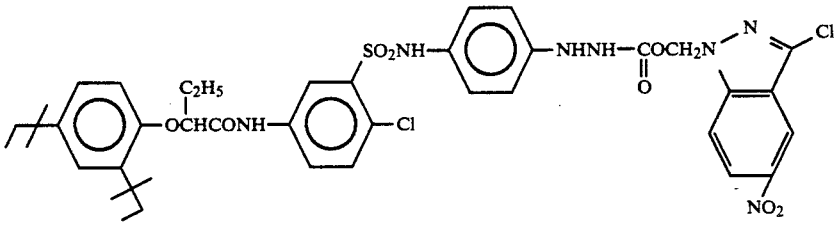
38.
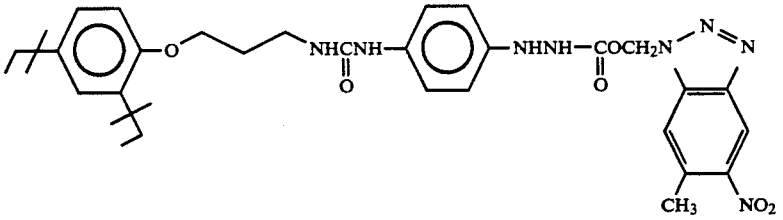
39.
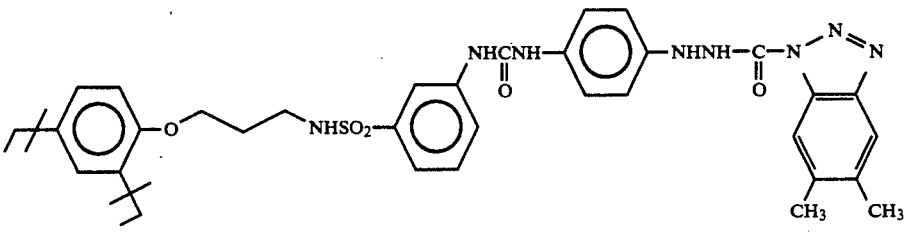

-continued
40.
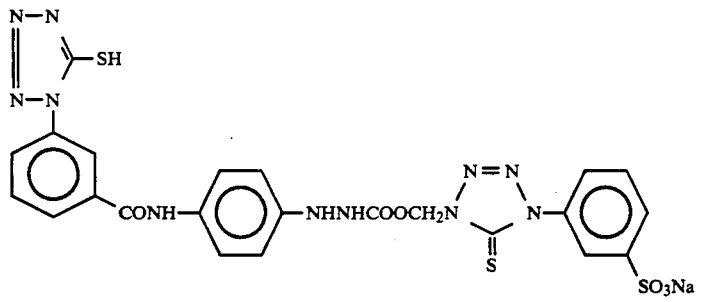
41.
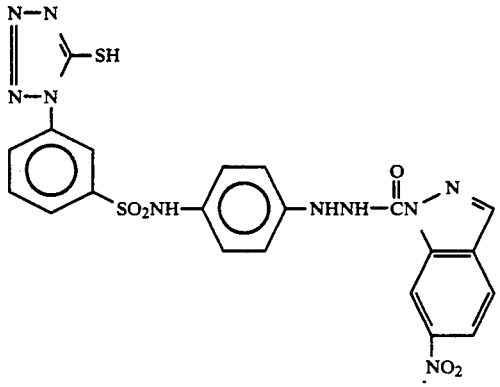
42.
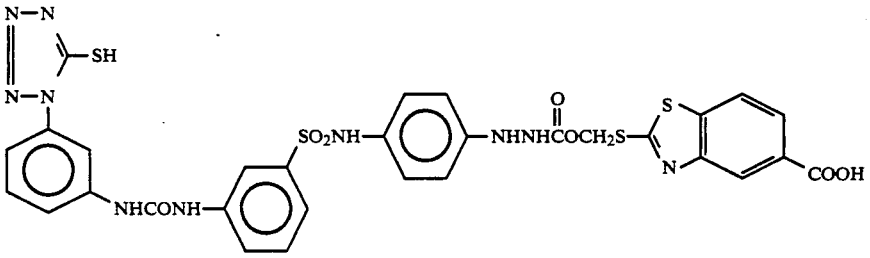
43.
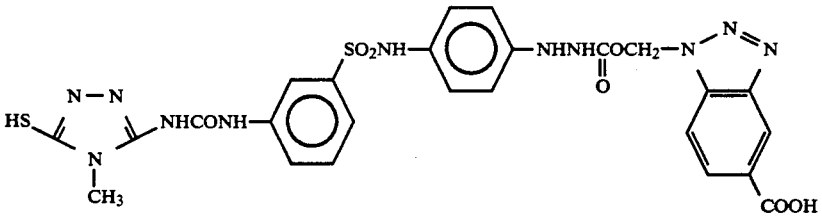
44.
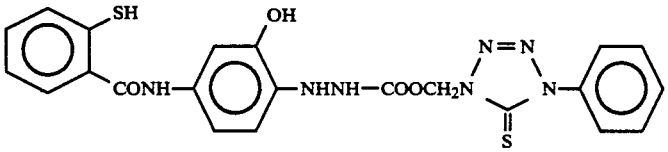

-continued
45.
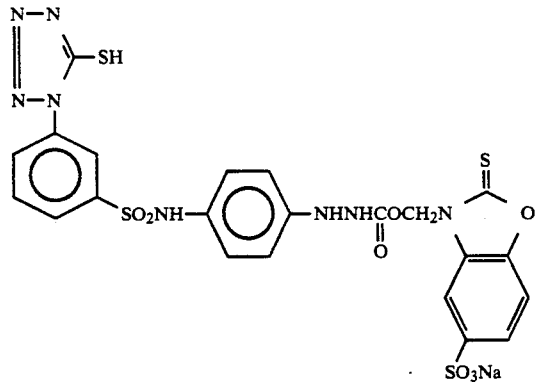
46.
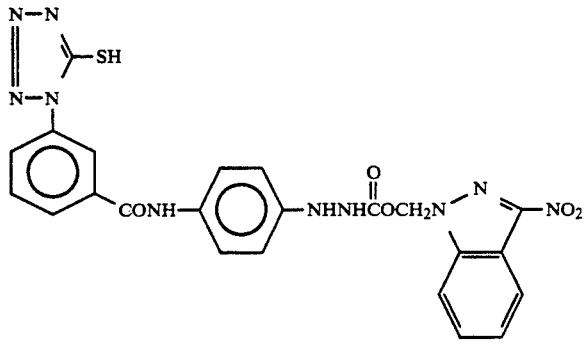
47.
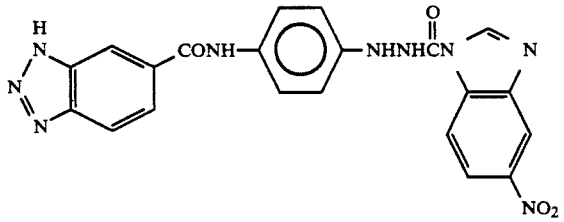
48.
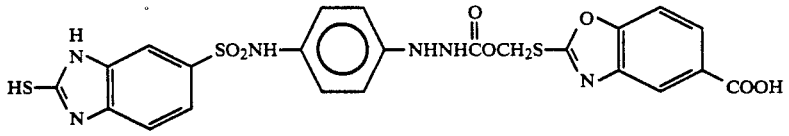
49.
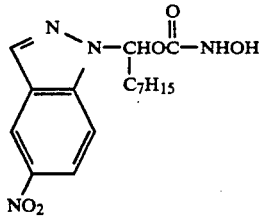
50.
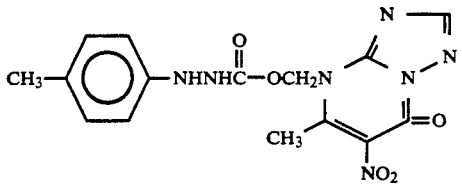

-continued

51.

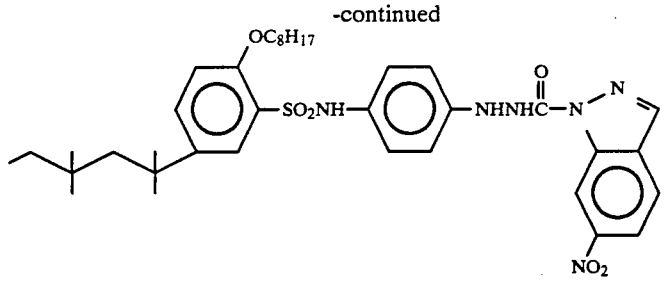

Methods for synthesizing the redox compounds which are used in the present invention are described in JP-A-61-213847, JP-A-62-260158, U.S. Pat. No. 4,684,604, JP-A-1-269936, U.S. Pat. Nos. 3,379,529, 3,620,746, 4,377,634 and 4,332,878, JP-A-49-129536, JP-A-56-153336 and JP-A-56-153342.

The redox compounds of the present invention are used in an amount of $1.0\times10^{-7}$ to $1.0\times10^{-3}$ mol/m$^2$, preferably $1.0\times10^{-6}$ to $1.0\times10^{-4}$ mol/m$^2$. The redox compounds of the present invention are dissolved in appropriate water-miscible organic solvents such as alcohols (e.g., methanol, ethanol, propanol, fluorinated alcohols), ketones (e.g., acetone, methyl ethyl ketone), dimethylformamide, dimethyl sulfoxide and methyl cellosolve.

The emulsified dispersions of the compounds may be mechanically prepared by conventional emulsifying dispersion methods. For example, the compounds may be dissolved in oil such as dibutyl phthalate, tricresyl phosphate, glyceryl triacetate or diethyl phthalate by using a co-solvent such as ethyl acetate or cyclohexanone to prepare the emulsified dispersions.

Alternatively, the powders of the redox compounds may be dispersed in water by means of a ball mill, colloid mill or ultrasonic dispersion by methods known as solid dispersion methods.

Compounds represented by the following formula (II) are preferred as the hydrazine derivatives which are used in the present invention.

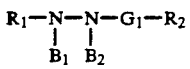

(II)

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, a group of

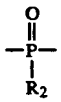

or an iminomethylene group; and both $B_1$ and $B_2$ represent hydrogen atoms, or one of $B_1$ and $B_2$ is a hydrogen atom and the other is a substituted or unsubstituted alkylsulfonyl group, a substituted or unsubstituted arylsulfonyl group or a substituted or unsubstituted acyl group.

The aliphatic group represented by $R_1$ in formula (II) is a straight chain, branched or cyclic alkyl group having preferably 1 to 30 carbon atoms, particularly preferably 1 to 20 carbon atoms. The branched alkyl group may be cyclized so as to form a saturated heterocyclic ring having at least one hetero atom. The alkyl group may be substituted by one or more substituent groups such as an aryl group, an alkoxy group, a sulfoxy group, a sulfonamido group and a carbonamido group.

The aromatic group represented by $R_1$ in formula (II) is a monocyclic or bicyclic aryl group or an unsaturated heterocyclic group. The unsaturated heterocyclic group may be condensed with the monocyclic or bicyclic aryl group to form a hetero aryl group.

Examples of the ring include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among them, those having a benzene ring are preferred.

Preferably, $R_1$ is an aryl group. The aryl group or the unsaturated heterocyclic group represented by $R_1$ may be substituted. Typical examples of substituent groups include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a phosphoric acid amido group, a diacylamino group and an imido group. Among them, preferred substituent groups are a straight chain, branched or cyclic alkyl group having preferably 1 to 20 carbon atoms, an aralkyl group (preferably a monocyclic or bicyclic group having an alkyl moiety having 1 to 3 carbon atoms), an alkoxy group having preferably 1 to 20 carbon atoms, a substituted amino group (preferably an amino group substituted by an alkyl group having 1 to 20 carbon atoms), an acylamino group having preferably 2 to 30 carbon atoms, a sulfonamido group having preferably 1 to 30 carbon atoms, a ureido group having preferably 1 to 30 carbon atoms and a phosphoric acid amido group having preferably 1 to 30 carbon atoms.

The alkyl group represented by $R_2$ in formula (II) is preferably an alkyl group having 1 to 4 carbon atoms. The alkyl group may be substituted by one or more substituent groups such as a halogen atom, a cyano group, a carboxy group, a sulfo group, an alkoxy group, a phenyl group and a sulfonyl group.

Preferably, the aryl group is a monocyclic or bicyclic aryl group. For example, said aryl group may be a benzene ring. The aryl group may be substituted, for example, by a halogen atom, an alkyl group, a cyano group, a carboxyl group, a sulfo group or a sulfonyl group.

The alkoxy group has preferably 1 to 8 carbon atoms and may be substituted by a halogen atom or an aryl group.

The aryloxy group is preferably a monocyclic group and may be substituted by a halogen atom.

Preferred examples of the amino group include an unsubstituted amino group, an alkylamino group having 1 to 10 carbon atoms and an arylamino group. These groups may be substituted by an alkyl group, a halogen atom, a cyano group, a nitro group or a carboxyl group.

Preferred examples of the carbamoyl group include an unsubstituted carbamoyl group, an alkylcarbamoyl group having 1 to 10 carbon atoms and an arylcarbamoyl group. These groups may be substituted, for example, by an alkyl group, a halogen atom, a cyano group or a carboxyl group.

Preferred examples of the oxycarbonyl group include an alkoxycarbonyl group having 1 to 10 carbon atoms and an aryloxycarbonyl group. These groups may be substituted, for example, by an alkyl group, a halogen atom, a cyano group or a nitro group.

Among the groups represented by $R_2$, preferred groups are a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) and an aryl group (e.g., phenyl, 3,5-dichlorophenyl, o-methanesulfonamidophenyl, 4-methanesulfonylphenyl) when $G_1$ is a carbonyl group. A hydrogen atom is particularly preferred as $R_2$.

When $G_1$ is a sulfonyl group, $R_2$ is preferably an alkyl group (e.g., methyl), an aralkyl group (e.g., o-hydroxyphenylmethyl), an aryl group (e.g., phenyl) or an unsubstituted amino group (e.g., dimethylamino).

When $G_1$ is a sulfoxy group, $R_2$ is preferably a cyanobenzyl group or a methylthiobenzyl group. When $G_1$ is a group of

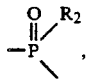

$R_2$ is preferably a methoxy group, an ethoxy group, a butoxy group, a phenoxy group or a phenyl group with a phenoxy group being particularly preferred.

When $G_1$ is an N-substituted or unsubstituted iminomethylene group, $R_2$ is preferably a methyl group, an ethyl group or a substituted or unsubstituted phenyl group.

Examples of substituent groups for $R_2$ include those already described above in the definition of the substituent groups for $R_1$.

A carbonyl group is most preferred as $G_1$ in formula (II).

Further, $R_2$ may be a group which allows the moiety of $G_1$-$R_2$ to be cleaved from the remainder of the molecule and allows a cyclization reaction for forming a cyclic structure containing the atoms of the moiety -$G_1$-$R_2$ to take place. Concretely, the group will be represented by the following formula (a):

$$-R_3-Z_1 \qquad \text{(a)}$$

wherein $Z_1$ is a group which nucleophilically attacks $G_1$ to cause the cleavage of the moiety $G_1$-$R_3$-$Z_1$ from the remainder of the molecule; and $R_3$ is a group formed by removing one hydrogen atom from $R_2$ Namely, $Z_1$ nucleophilically attacks $G_1$ and a cyclic structure can be formed by $G_1$, $R_3$ and $Z_1$.

In more detail, $Z_1$ is a group which is easily nucleophilically reacted with $G_1$ when the following intermediate $$R_1\text{-}N{=}N\text{-}G_1\text{-}R_3\text{-}Z_1$$

is formed, for example, by the oxidation of the hydrazine compound of formula (II), to thereby allow the cleavage of $R_1$-N=N from $G_1$ to occur. Specifically, the group may be a functional group capable of directly reacting with $G_1$, such as OH, SH, $NHR_4$ (wherein $R_4$ is a hydrogen atom, an alkyl group, an aryl group, —$COR_5$ or —$SO_2R_5$, and $R_5$ is a hydrogen atom, an alkyl group, an aryl group or a heterocyclic group or COOH (OH, SH, $NHR_4$ and —COOH may be temporarily protected so as to reform these groups by hydrolysis with an alkali). Alternatively, the group may be a functional group such as $$-\overset{O}{\overset{\|}{C}}-R_6 \text{ or } -\overset{N-R_7}{\overset{\|}{C}}-R_6$$

(wherein $R_6$ and $R_7$ are each a hydrogen atom, an alkyl group, an alkenyl group, an aryl group or a heterocyclic group, which can be reacted with $G_1$ through the reaction with a nucleophilic reagent such as hydroxyl ion or sulfite ion.

The ring formed by $G_1$, $R_3$ and $Z_1$ is preferably a 5-membered or 6-membered ring.

Among the groups represented by formula (a), groups represented by the following formulae (b) and (c) are preferred.

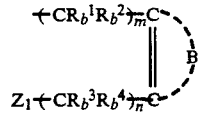

(b)

wherein $R_b^1$ to $R_b^4$ may be the same or different groups and each is a hydrogen atom, an alkyl group (having preferably 1 to 12 carbon atoms), an alkenyl group (having preferably 2 to 12 carbon atoms) or an aryl group (having preferably 6 to 12 carbon atoms); B is an atomic group required for the formation of a 5-membered or 6-membered ring which may be optionally substituted; and m and n are each 0 or 1 and n+m is 1 or 2.

Examples of the 5-membered or 6-membered ring formed by B include a cyclohexene ring, a cyclobutene a benzene ring, a naphthalene ring, a pyridine ring and a quinoline ring.

$Z_1$ is as defined in formula (a).

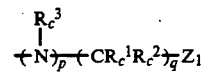

(c)

wherein $R_c^1$ and $R_c^2$ may be the same or different groups and each is a hydrogen atom, an alkyl group, an alkenyl group, an aryl group or a halogen atom; $R_c^3$ is a hydrogen atom, an alkyl group, an alkenyl group or an aryl group; p is 0 or 1; and q is from 1 to 4.

$R_c^1$, $R_c^2$ and $R_c^3$ may be combined together to form a ring, so long as it has such a structure that an intramolecular nucleophilic attack on $G_1$ can be made by $Z_1$.

$R_c^1$ and $R_c^2$ are preferably a hydrogen atom, a halogen atom or an alkyl group, and $R_c^3$ is preferably an alkyl group or an aryl group.

Preferably, q is from 1 to 3. When q is 1, p is 0 or 1. When q is 2, p is 0 or 1, and when q is 3, p is 0 or 1. When q is 2 or 3, $CR_c^1R_c^2$ may be the same or different.

$Z_1$ is as defined in formula (a).

$B_1$ and $B_2$ are each a hydrogen atom, an alkylsulfonyl group having not more than 20 carbon atoms, an arylsulfonyl group (preferably a phenylsulfonyl group or a substituted phenylsulfonyl group having such a degree of substitution that the same of Hammett's substituent constant is at least −0.5), or an acyl group [preferably, a benzoyl group, a substituted benzoyl group having such a degree of substitution that the sum of Hammett's substituent constant is at least −0.5, or a straight chain, branched or cyclic unsaturated or saturated acyl group (examples of substituent groups include a halogen atom, an ether group, a sulfonamido group, a carbonamido group, a hydroxyl group, a carboxyl group and a sulfo group)].

The compounds where $B_1$ and $B_2$ are hydrogen atoms are most preferred.

In formula (II), $R_1$ or $R_2$ may have, as a moiety thereof, a ballast group commonly used in nondiffusible photographic additives such as couplers. The ballast group is a $C_8$ or higher group relatively inert to photographic characteristics and can be chosen, for example, from among an alkyl group, an alkoxy group, a phenyl group, an alkylphenyl group, a phenoxy group and an alkylphenoxy group.

In formula (II), $R_1$ or $R_2$ may have, as a moiety thereof, a group capable of accelerating the adsorption of the compound on the surfaces of silver halide grains. Examples of such adsorption groups include thiourea groups, heterocyclic thioamido groups, heterocyclic mercapto groups, triazole groups described in U.S Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61- 270744, JP-A-62-948, JP-A-63-234244, JP-A-63-234245 and JP-A-63-234246.

Examples of the compounds represented by formula (II) include, but are not limited to, the following compounds.

II-1)

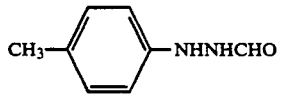

II-2)

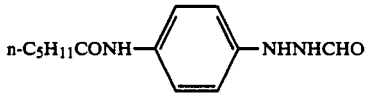

II-3)

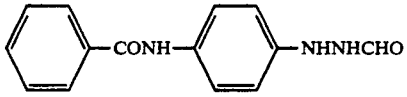

II-4)

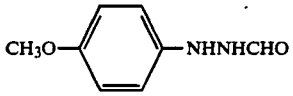

II-5)

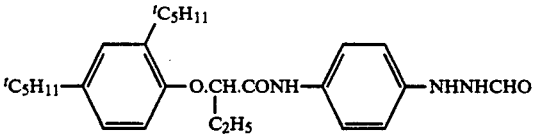

II-6)

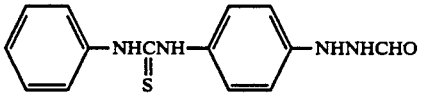

II-7)

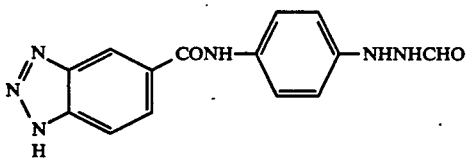

II-8)

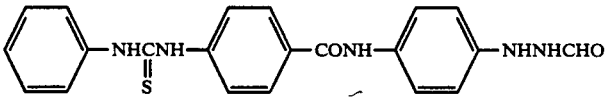

-continued
II-9)
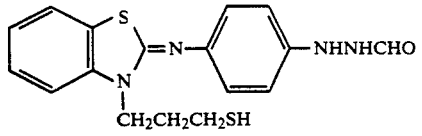
II-10)
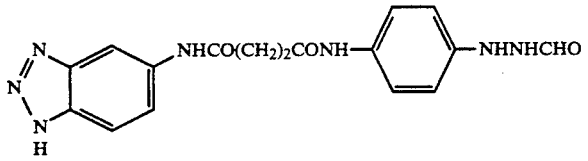
II-11)
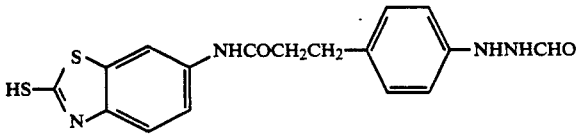
II-12)
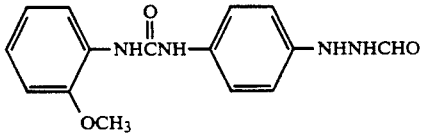
II-13)
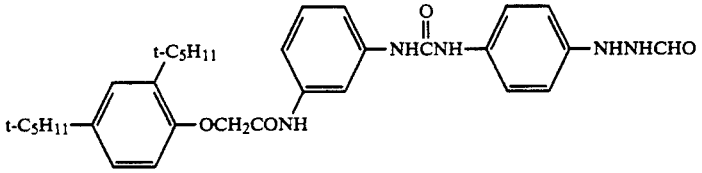
II-14)
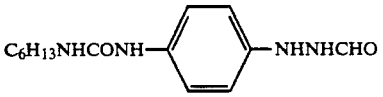
II-15)
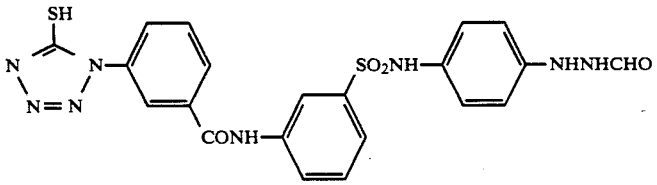
II-16)
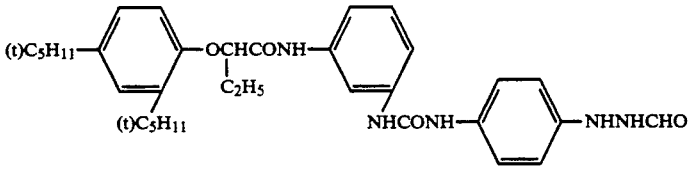
II-17)
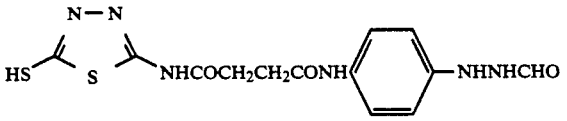
II-18)
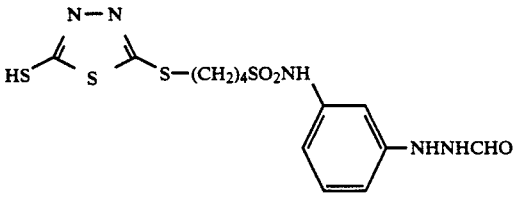

-continued.
II-19)
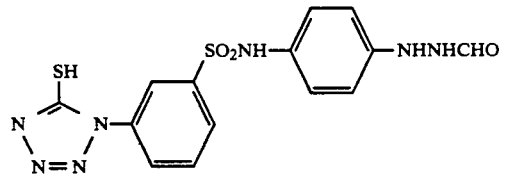
II-20)
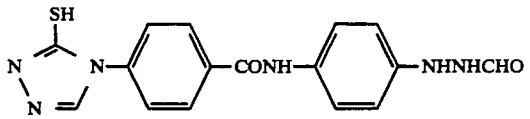
II-21)
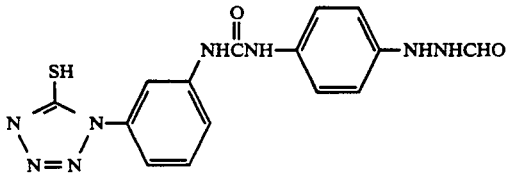
II-22)
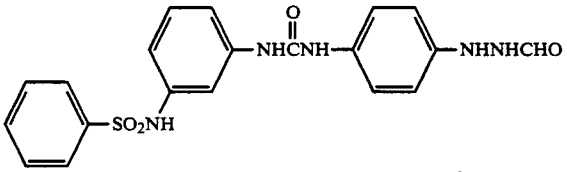
II-23)
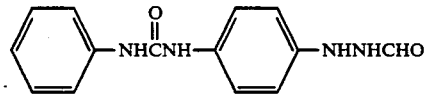
II-24)
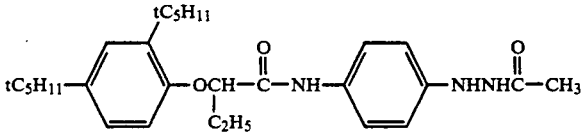
II-25)
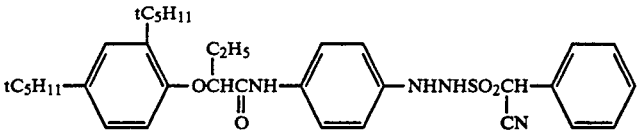
II-26)
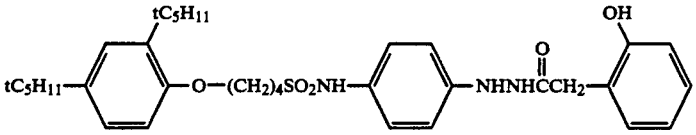
II-27)
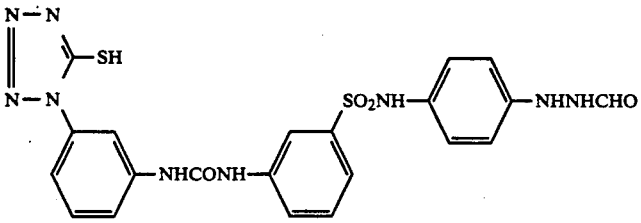

-continued
II-28)
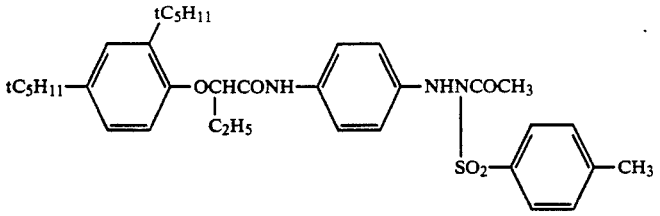
II-29)
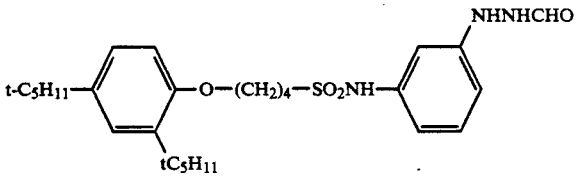
II-30)
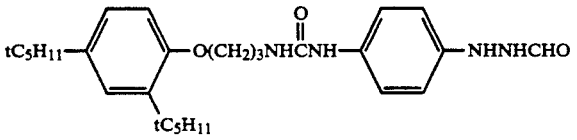
II-31)
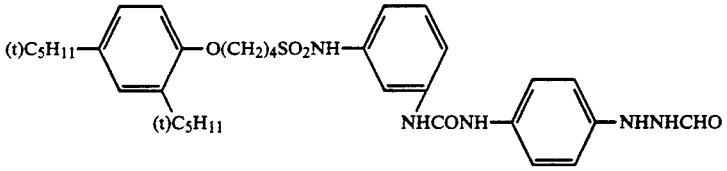
II-32)
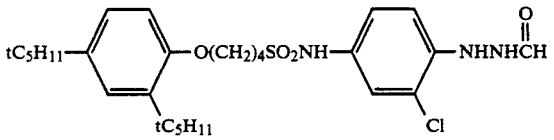
II-33)
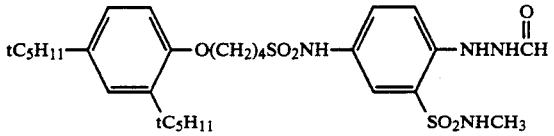
II-34)
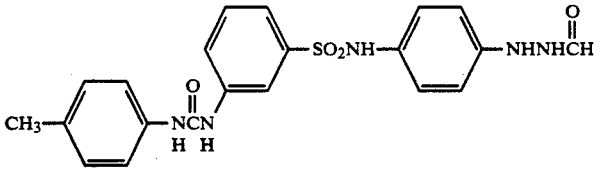
II-35)
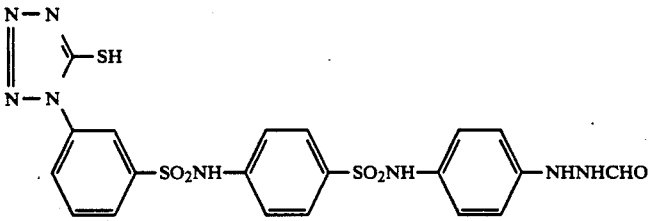
II-36)
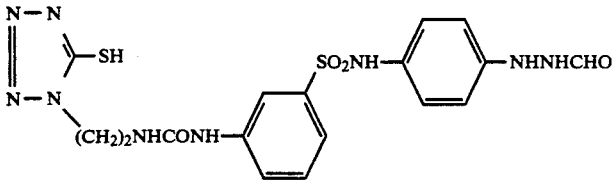

-continued
II-37)
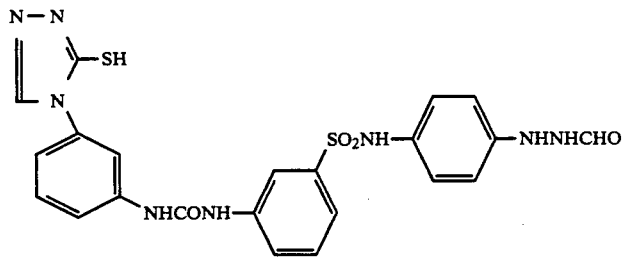
II-38)
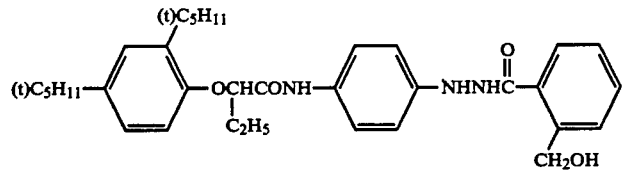
II-39)
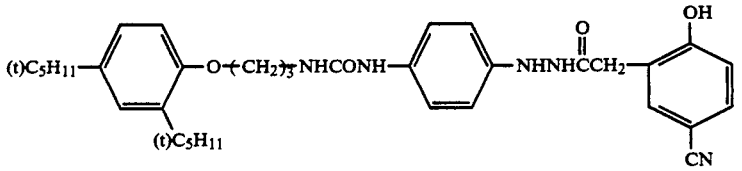
II-40)
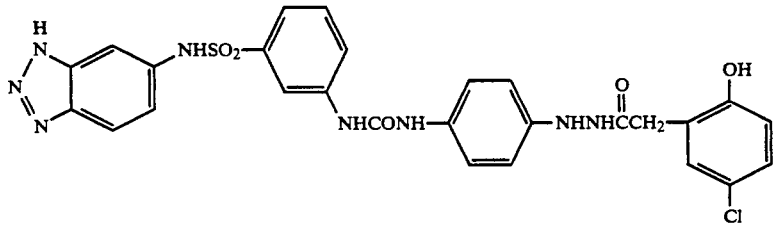
II-41)
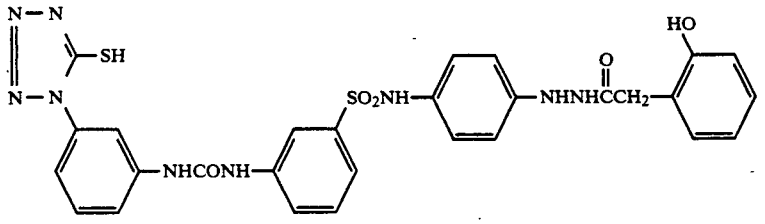
II-42)
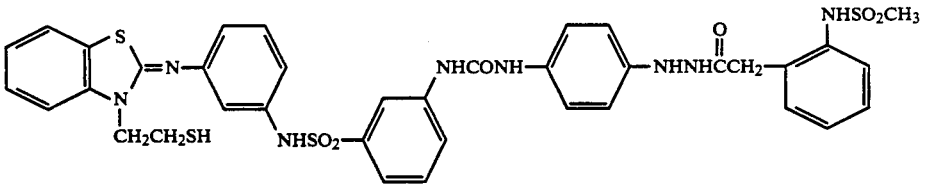
II-43)
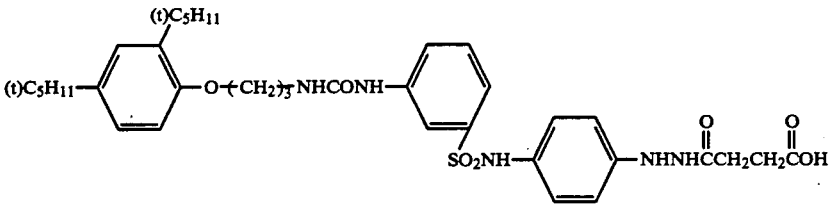
II-44)
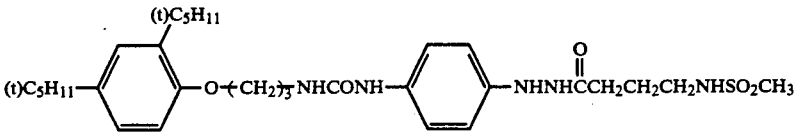

-continued
II-45)
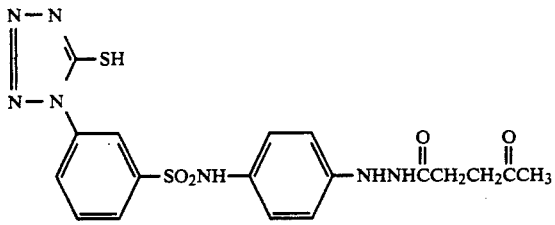
II-46)
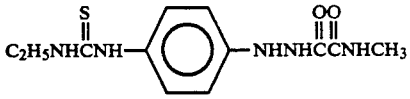
II-47)
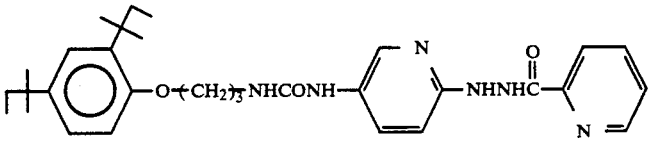
II-48)
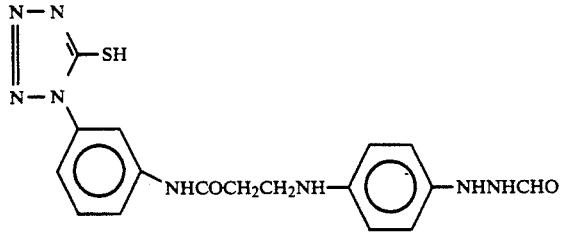
II-49)
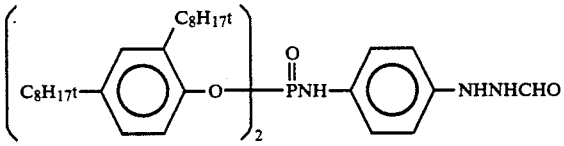
II-50)
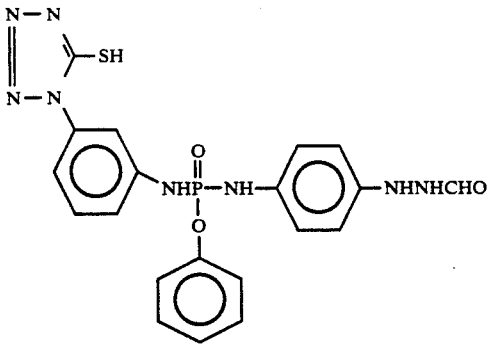
II-51)
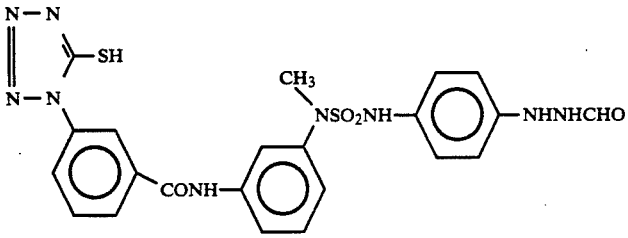

-continued

II-52)

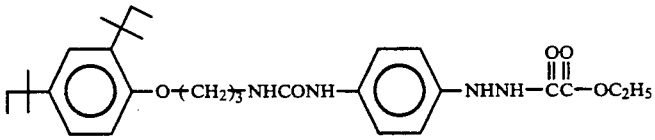

II-53)

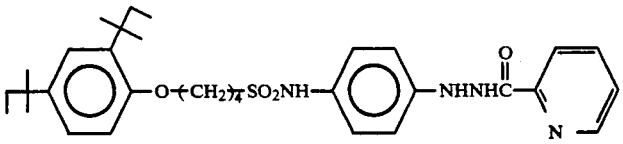

II-54)

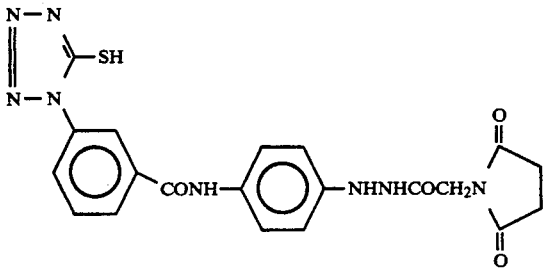

In addition to the above-described hydrazine compounds, there can be used compounds described in *Research Disclosure,* Item 23516 (p. 346, November, 1983) and literature cited therein, U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310, JP-A-63-32538, JP-A-63-104047, JP-A-63-121838, JP-A-63-129337, JP-A-63-234245, JP-A-63-234246, JP-A-63-223744, JP-A-63-294552, JP-A-63-306448 and JP-A-1-10233, U.S. Pat. No. 4,686,167, JP-A-62-178246, JP-A-63-234244, JP-A-63-294552, JP-A-63-306438, JP-A-1-90439, JP-A-1-276128, JP-A-1-283548, JP-A-1-280747, JP-A-1-283549, JP-A-1-285940, Japanese Patent Application Nos. 63-147339, 63-179760, 63-229162, 1-18377, 1-18378, 1-18379, 1-15755, 1-16814, 1-40792, 1-42615 and 1-42616.

It is preferred that the hydrazine derivatives of formula (II) are incorporated in the silver halide emulsions of the photographic materials in the present invention. However, the hydrazine derivatives may be incorporated in non-photosensitive hydrophilic colloid layers (e.g., a protective layer, an interlayer, a filter layer, an antihalation layer). When the compounds to be used are water-soluble, they are added in the form of an aqueous solution to hydrophilic colloid solutions. When the compounds are poorly soluble in water, they are dissolved in water-miscible organic solutions such as alcohols, esters or ketones and the resulting solutions are added to the hydrophilic colloid solutions. When the compounds are to be added to silver halide emulsion layers, they may be added thereto at any stage before coating after the commencement of chemical ripening. However, it is preferred that the addition thereof is made before coating after the completion of chemical ripening. It is particularly preferred that the compounds are added to coating solutions.

The hydrazine derivatives of formula (II) are used in an amount of preferably $1\times10^{-6}$ to $1\times10^{-1}$ mol, particularly preferably $1\times10^{-5}$ to $4\times10^{-3}$ mol per mol of silver halide.

A feature of the present invention resides in that the photographic material of the present invention has at least one emulsion layer comprising a monodisperse emulsion. When there exist two or more silver halide emulsion layers comprises a monodisperse emulsion.

The term "silver halide emulsion layer comprising a monodisperse emulsion" as used herein means that the grain size distribution of all of the photosensitive silver halide grains present in the emulsion layer or layers is uniform.

More specifically, the term means that a coefficient of dispersion obtained by the following formula is not higher than 20%, and preferably the coefficient of variation is not higher than 15%.

$$\frac{\text{Standard deviation of grain size}}{\text{Mean grain size}} \times 100\ (\%)$$

The grain size is defined by the diameter of a circle having the same area as that of the projected area of the grain.

If the redox compound of formula (I) according to the present invention is used together with the nucleating agent of formula (II) in a photographic material having an emulsion layer comprising an emulsion having a coefficient of variation of higher than 20%, the change of the photographic performance (sensitivity and gradation) due to the degree of fatigue of the developing solution is not on a level for practical use.

The silver halide emulsion of the present invention may be composed of any composition of silver chloride, silver chlorobromide, silver iodobromide and silver iodochlorobromide. However, it is preferred that the silver halide emulsion be composed of at least 70 mol %, particularly at least 90 mol %, of silver bromide. It is preferred that the silver halide have a silver iodide content of not higher than 10 mol %, particularly preferably 0.1 to 5 mol %.

The silver halide of the present invention is preferably in the form of fine grains having a mean grain size of, for example, not greater than 0.7 μm, particularly not greater than 0.5 μm.

Silver halide grains in the photographic emulsions may have regular crystal forms such as cubic or octahedral, irregular crystal forms such as spheric or tabular or composite forms of these crystal forms.

The interior and surface layer of the silver halide grain may be composed of a uniform phase or different phases. Two or more silver halide emulsions which are separately formed may be mixed and used.

It is very preferred that iridium be incorporated in the silver halide grains in the present invention, because the formation of black peppers can be reduced and the quality of the resulting image can be improved.

In a preferred embodiment of the present invention, silver halide grains are prepared in the presence of an iridium salt in an amount of $1\times10^{-8}$ to $1\times10^{-5}$ mol per mol of silver. It is preferred that an iridium salt in an amount within the range defined above be added before the completion of the physical ripening of the silver halide emulsion, particularly during the formation of silver halide grains.

Water-soluble iridium salts or iridium complex salts can be used as the iridium salt. Examples of such iridium salts include iridium trichloride, iridium tetrachloride, potassium hexachloroiridate(III), potassium hexachloroiridate(IV) and ammonium hexachloroiridate(III).

Cadmium salts, sulfite, lead salts, thallium salts or rhodium salts or complex salts thereof may be allowed to coexist during the formation of silver halide grains or during the physical ripening in the preparation of the silver halide emulsions of the present invention.

Silver halide suitable for use in the present invention is silver haloiodide wherein the surface layer thereof has a silver iodide content higher than the average silver iodide content of the grains. When an emulsion containing such silver haloiodide is used, photographic characteristics having much higher sensitivity and higher gamma value can be obtained.

The silver halide emulsions of the present invention may be subjected to chemical sensitization. Examples of chemical sensitization include conventional sulfur sensitization, reduction sensitization and noble metal sensitization. These chemical sensitization methods may be used either along or in combination.

Typical examples of noble metal sensitization are gold sensitization methods using gold compounds, particularly gold complexes. However, complex salts of other noble metals such as platinum, palladium and rhodium may be used. Examples thereof are described in U.S. Pat. No. 2,448,060 and British Patent 618,061.

Sulfur compounds contained in gelatin as well as various sulfur compounds such as thiosulfates, thioureas, thiazoles and rhodanine may be used as sulfur sensitizing agents.

The total coating weight of silver is preferably in the range of 1 to 8 g/m$^2$.

It is preferred that one or more compounds selected from the group consisting of polymers having a repeating unit derived from the monomer represented by the following formula (III), short wave monomethine dyes represented by the following formula (IV), thioamido compounds represented by the following formula (V), and dyes having absorption peaks at 300 to 420 nm be used for the purpose of forming an image which has a high gamma value and does not form undesirable black peppers.

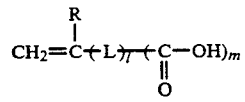

(III)

wherein R is a hydrogen atom or a substituted or unsubstituted alkyl group; L is a bivalent, trivalent or tetravalent bonding group; l is 0 or 1; and m is 1, 2 or 3.

R is a hydrogen atom, an unsubstituted alkyl group such as methyl, ethyl or n-propyl or a substituted alkyl group such as a carboxymethyl group. Preferably, R is a hydrogen atom, methyl or carboxymethyl.

L is a bivalent, trivalent or tetravalent bonding group. It is preferred that L is —Q— when L is a bivalent group; L is

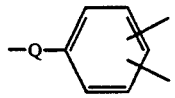

when L is a trivalent group, and L is

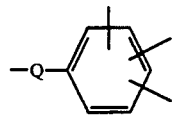

when L is a tetravalent group. Q is a bivalent bonding group such as an alkylene group (e.g., methylene, ethylene, trimethylene), an arylene group (e.g., phenylene),

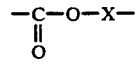

(wherein X is an alkylene group having about 1 to about 6 carbon atoms or an arylene group; the same applies hereinbelow) e.g.,

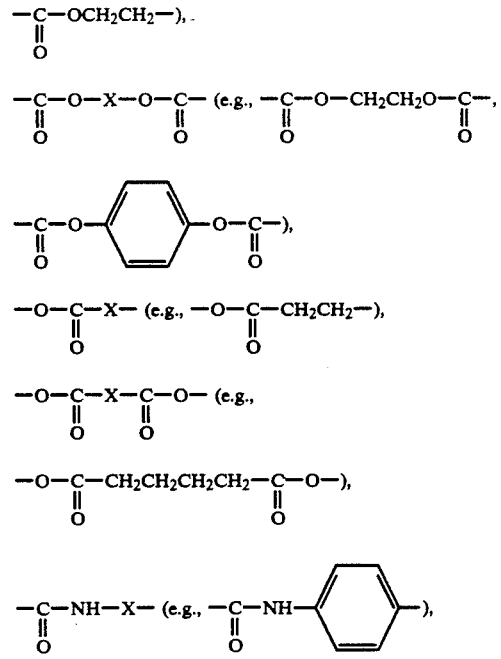

-continued $-\underset{\underset{O}{\|}}{C}-NH-X-NH-\underset{\underset{O}{\|}}{C}-$ (e.g., $-\underset{\underset{O}{\|}}{C}-NH-CH_2CH_2NH\underset{\underset{O}{\|}}{C}-$), or $-\underset{\underset{O}{\|}}{C}-NH-X-O-\underset{\underset{O}{\|}}{C}-$ (e.g., $-\underset{\underset{O}{\|}}{C}-NHCH_2CH_2O\underset{\underset{O}{\|}}{C}-$).

Preferred examples of copolymerizable ethylenically unsaturated monomers represented by formula (III) include, but are not limited to, the following compounds.

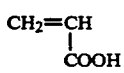
M-1

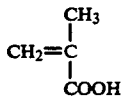
M-2

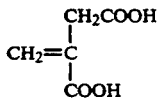
M-3

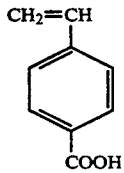
M-4

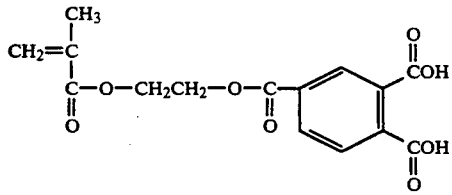
M-5

Examples of ethylenically unsaturated monomers having at least on acid radical include carboxylic acid anhydrides, monomers (such as a lactone ring) which form a carboxyl group when brought into contact with developing solutions and monomers having a phosphoric acid group and monomers having a sulfo group described in JP-A-54-128335.

Examples of crosslinking monomers having at least two copolymerizable ethylenically unsaturated groups include, but are not limited to, divinylbenzene, ethylene glycol diacrylate, ethylene glycol dimethacrylate, diethylene glycol diacrylate, diethylene glycol dimethacrylate, triethylene glycol diacrylate, triethylene glycol dimethacrylate, trivinylcyclohexane, trimethylolpropane triacrylate, trimethylolpropane trimethacrylate, pentaerythritol triacrylate, pentaerythritol trimethacrylate, pentaerythritol tetraacrylate and pentaerythritol tetramethacrylate. Among them, ethylene glycol dimethacrylate, divinylbenzene, pentaerythritol tetraacrylate and pentaerythritol tetramethacrylate are particularly preferred.

The copolymerization ratio of the crosslinked polymer of the present invention is such that the monomer (A) having an acid radical is 30 to 90 mol %, preferably 50 to 90 mol %, and the crosslinking monomer (B) is 1 to 50 mol %, preferably 10 to 30 mol %.

The crosslinked polymer of the present invention may contain a copolymerized monomer unit formed by the copolymerization of a third copolymerizable ethylenically unsaturated monomer unit to exhibit a composite function. Examples of such copolymerizable ethylenically unsaturated monomers include, but are not limited to, ethylene, propylene, 1-butene, isobutene, styrene, α-methylstyrene, vinyltoluene, ethylenically unsaturated esters of fatty acids (e.g., vinyl acetate, allyl acetate), esters of ethylenically unsaturated carboxylic acids (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate), monoethylenically unsaturated compounds (e.g., acrylonitrile, methacrylonitrile) and dienes (e.g., butadiene, isoprene).

The ratio of the third monomer unit to be copolymerized is 0 to 50 mol %, preferably 0 to 20 mol %.

Polymerization initiators will be illustrated below.

Polymerization initiators described in the literature on synthesis of high molecular materials such as *Experimental Method for Synthesis of High Molecular Material* written by T. Otsu and M. Kinoshita (published by Kagaku Dojin) can be used. Water-soluble polymerization initiators are preferred in the present invention. Persulfates and azo compounds are known as water-soluble polymerization initiators. Persulfates such as potassium persulfate give favorable results in the present invention. The polymerization initiator is used in an amount of 0.05 to 5% by weight, preferably 0.1 to 1.0% by weight, based on the amount of the monomers.

The resulting anionic crosslinked polymers are electrically charged and dispersed relatively stable in water. While it is typically not necessary to add surfactants to the water, surfactants may be added, if desired. Examples of the surfactants which can be used in the present invention include, but are not limited to, the following compounds.

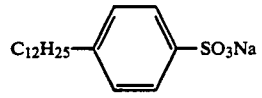

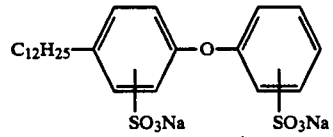

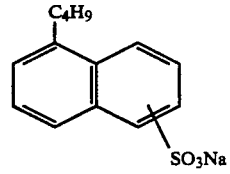

$C_{12}H_{25}OSO_3Na$ $C_{16}H_{33}OCOCH_2$
|
$C_{16}H_{33}OCOCHSO_3Na$

-continued

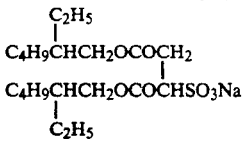

The crosslinked polymers of the present invention can be obtained by simultaneously adding the monomers and the polymerization initiator to water. The polymerization temperature is one of the most important factors in the production of the polymers of the present invention. In the art, polymerization is often carried out at a temperature of 50° to 80° C. However, when polymerization is carried out under such conditions in the present invention, large amounts of agglomerates which are neither dispersed nor dissolved in water and organic solvents are formed as by-products. Hence, it is impossible to form good planar coatings unless these agglomerates can be completely removed. The removal of these agglomerates requires extra expense for removal, lowers the yields of the polymers and results in an increase in costs.

Accordingly, higher polymerization temperatures are preferred in the present invention. However, the upper limit thereof is limited because polymerization is carried out in water. Generally, it is desirable that polymerization be carried out at a temperature of 90° to 98° C. However, the polymerization equipment may be designed so that polymerization may be carried out at a higher temperature. It is desirable that part of the polymer be neutralized with an alkali after the completion of the polymerization. The neutralization is carried out to such an extent that 0 to 30 mol %, preferably 3 to 20 mol %, of the polymer is in the form of a salt.

When the crosslinked polymers prepared by the present invention are used in negative-type silver halide photographic materials containing the hydrazine derivatives, the pH of the dispersions of the crosslinked polymers is preferably adjusted to the range of from 3.5 to 5.0 by adding an alkali.

Examples of the crosslinked polymers of the present invention include, but are not limited to, the following polymers.

(The copolymerization ratio described below represents mol %.)

Polymer 1

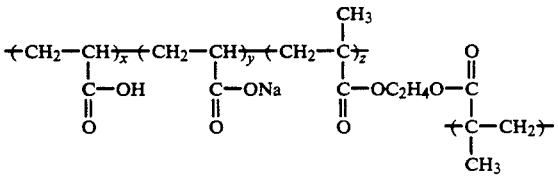

x/y/z = 64/9/27 (mol %)

Polymer 2

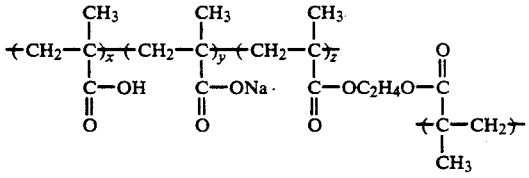

x/y/z = 60/15/25 (mol %)

Polymer 3

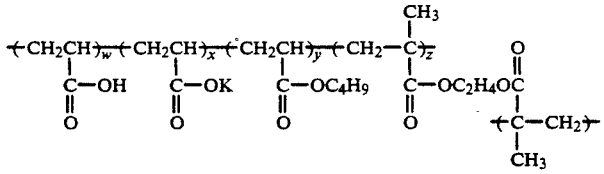

w/x/y/z = 67/10/13/10 (mol %)

Polymer 4

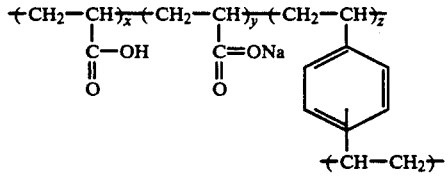

x/y/z = 60/10/30 (mol %)

Polymer 5

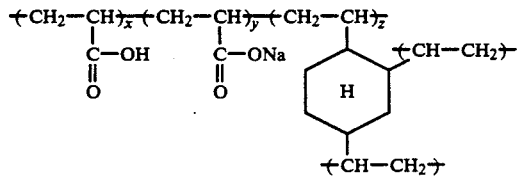

x/y/z = 72/13/15 (mol %)

-continued

Polymer 6

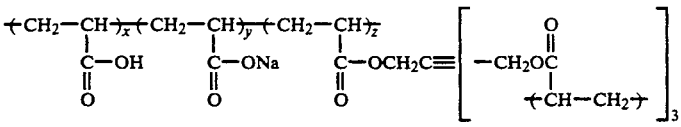

x/y/z = 68/12/20 (mol %)

Polymer 7

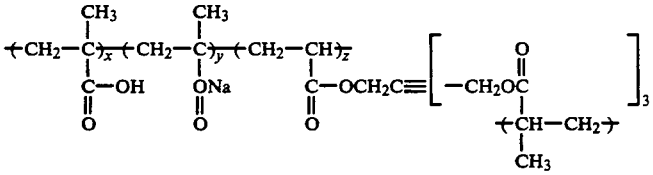

x/y/z = 69/11/20 (mol %)

Polymer 8

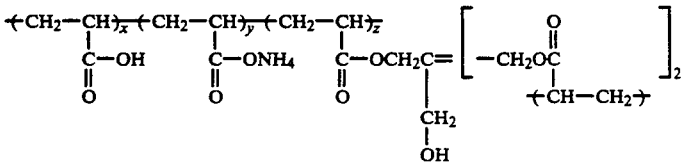

x/y/z = 50/35/15 (mol %)

Polymer 9

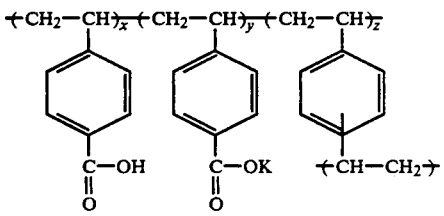

x/y/z = 64/11/25 (mol %)

Polymer 10

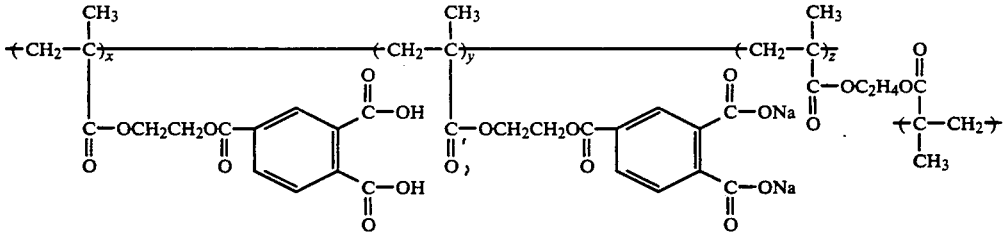

x/y/z = 60/10/30 (mol %)

Polymer 11

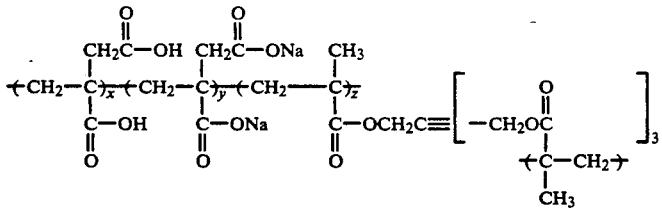

x/y/z = 70/15/15 (mol %)

Examples of the synthesis of the polymers of the present invention are described in JP-A-62-220947.

The crosslinked polymers of the present invention are used in an amount of preferably 0.05 to 5 g, more preferably 0.1 to 3 g, per $m^2$ of the photographic material. Preferably, the polymers are added to the silver halide emulsions.

The dispersions of the crosslinked polymers of the present invention are added as such to the photographic materials. Alternatively, the dispersions are diluted with water, an organic solvent (e.g., methanol, ethanol, acetone, ethyl acetate, preferably methanol or ethanol) or a mixture thereof and then used together with a binder such as gelatin, polyvinyl alcohol, cellulose acetate, cellulose acetate phthalate, polyvinyl formal or polyvinyl butyral.

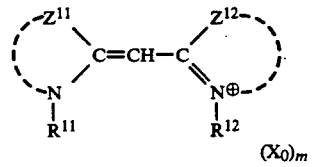

(IV)

wherein $Z^{11}$ and $Z^{12}$ are each a nonmetallic atomic group required for the formation of a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus or a quinoline nucleus; $R^{11}$ and $R^{12}$ are each an alkyl group or an aralkyl group and at least one thereof has an acid radical; $X_0$ is a counter ion for charge balance; m is 0 or 1.

The heterocyclic ring formed by $Z^{11}$ or $Z^{12}$ in formula (IV) is preferably a benzoxazole nucleus, a benzothiazole nucleus, a naphthoxazole nucleus, a naphthothiazole nucleus, a thiazole nucleus or an oxazole nucleus. More preferably, the heterocyclic ring is a benzoxazole nucleus, a benzothiazole nucleus or a naphthoxazole nucleus. Among them, a benzoxazole nucleus or a naphthoxazole nucleus is most preferred. The heterocyclic rings formed by $Z^{11}$ or $Z^{12}$ in formula (IV) may be substituted by at least one substituent group. Examples of the substituent group include a halogen atom (e.g., fluorine, chlorine, bromine, iodine), a nitro group, an alkyl group (having preferably 1 to 4 carbon atoms, e.g., methyl, ethyl, trifluoromethyl, benzyl, phenethyl), an aryl group (e.g., phenyl), an alkoxy group (having preferably 1 to 4 carbon atoms, e.g., methoxy, ethoxy, propoxy, butoxy), a carboxyl group, an alkoxycarbonyl group (having preferably 2 to 5 carbon atoms, e.g., ethoxycarbonyl), a hydroxyl group and a cyano group.

Examples of the benzothiazole nucleus formed by $Z^{11}$ or $Z^{12}$ in formula (IV) include benzothiazole, 5-chlorobenzothiazole, 5-nitrobenzothiazole, 5-methylbenzothiazole, 6-bromobenzothiazole, 5-iodobenzothiazole, 5-phenylbenzothiazole, 5-methoxybenzothiazole, 6-methoxybenzothiazole, 5-carboxybenzothiazole, 5-ethoxycarbonylbenzothiazole, 5-fluorobenzothiazole, 5-chloro-6-methylbenzothiazole, and 5-trifluoromethylbenzothiazole. Examples of the naphthothiazole nucleus include naphtho[2,1-d]thiazole, naphtho[1,2-d]thiazole, naphtho[2,3-d]thiazole, 5-methoxynaphtho[1,2-d]thiazole, and 5-methoxynaphtho[2,3-d]thiazole. Examples of the benzoselenazole nucleus include benzoselenazole, 5-chlorobenzoselenazole, 5-methoxybenzoselenazole, 5-hydroxybenzoselenazole, and 5-chloro-6-methylbenzoselenazole. Examples of the naphthoselenazole nucleus include naphtho[1,2-d]selenazole and naphtho[2,1-d]selenazole. Examples of the thiazole nucleus include thiazole, 4-methylthiazole, 4-phenylthiazole and 4,5-dimethylthiazole. Examples of the thiazoline nucleus include thiazoline nucleus and 4-methylthiazoline nucleus.

Further, examples of the benzoxazole nucleus formed by $Z^{11}$ or $Z^{12}$ in formula (IV) include benzoxazole nucleus, 5-chlorobenzoxazole nucleus, 5-methylbenzoxazole nucleus, 5-bromobenzoxazole nucleus, 5-fluorobenzoxazole nucleus, 5-phenylbenzoxazole nucleus, 5-methoxybenzoxazole nucleus, 5-ethoxybenzoxazole nucleus, 5-trifluoromethylbenzoxazole nucleus, 5-hydroxybenzoxazole nucleus, 5-carboxybenzoxazole nucleus, 6-methylbenzoxazole nucleus, 6-chlorobenzoxazole nucleus, 6-methoxybenzoxazole nucleus, 6-hydroxybenzoxazole nucleus, and 5,6-dimethylbenzoxazole nucleus. Examples of the naphthoxazole nucleus include naphtho[2,1-d]oxazole nucleus, naphtho[1,2-d]oxazole nucleus, naphtho[2,3-d]oxazole nucleus and 5-methoxynaphtho[1,2-d]oxazole nucleus.

Furthermore, examples of the oxazole nucleus formed by $Z^{11}$ or $Z^{12}$ include oxazole nucleus, 4-methyloxazole nucleus, 4-phenyloxazole nucleus, 4-methoxyoxazole nucleus, 4,5-dimethyloxazole nucleus, 5-phenyloxazole nucleus and 4-methoxyoxazole nucleus. Examples of the pyridine nucleus include 2-pyridine nucleus, 4-pyridine nucleus, 5-methyl-2-pyridine nucleus, and 3-methyl-4-pyridine nucleus. Examples of the quinoline nucleus include 2-quinoline nucleus, 4-quinoline nucleus, 3-methyl-2-quinoline nucleus, 5-ethyl-2-quinoline nucleus, 8-fluoro-2-quinoline nucleus, 6-methoxy-2-quinoline nucleus, 8-chloro-4-quinoline nucleus, and 8-methyl-4-quinoline nucleus. Examples of the benzimidazole nucleus include 5,6-dichloro-1-ethylbenzimidazole nucleus and 6-chloro-1-ethyl-3-trifluoromethylbenzimidazole nucleus.

The alkyl group represented by $R^{11}$ and $R^{12}$ include an unsubstituted alkyl group and a substituted alkyl group. At least one of $R^{11}$ and $R^{12}$ has an acid radical such as a sulfo group or a carboxyl group. The unsubstituted alkyl group has not more than 18 carbon atoms, preferably not more than 8 carbon atoms. Examples thereof include methyl, ethyl, n-propyl, n-butyl, n-hexyl and n-octadecyl. The alkyl moiety of the substituted alkyl group has preferably not more than 6 carbon atoms, particularly preferably not more that 4 carbon atoms. Examples of the substituted alkyl group include a sulfo group-substituted alkyl group (the sulfo group may be attached through an alkoxy group or an aryl group; e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenethyl, p-sulfophenylpropyl), a carboxyl group-substituted alkyl group (the carboxyl group may be attached through an alkoxy group or an aryl group; e.g., carboxymethyl, 3-carboxypropyl, 4-carboxybutyl), a hydroxyalkyl group (e.g., 2-hydroxyethyl, 3-hydroxypropyl), an acyloxyalkyl group (e.g., 2-acetoxyethyl, 3-acetoxypropyl), an alkoxyalkyl group (e.g., 2-methoxyethyl, 3-methoxypropyl), an alkoxycarbonylalkyl group (e.g., 2-methoxycarbonylethyl, 3-methoxycarbonylpropyl, 4-ethoxycarbonylbutyl), a vinyl group-substituted alkyl group (e.g., allyl), a cyanoalkyl group (e.g., 2-cyanoethyl), a carbamoylalkyl group (e.g., 2-carbamoylethyl), an aryloxyalkyl group (e.g., 2-phenoxyethyl, 3-phenoxypropyl), an aralkyl group (e.g., 2-phenethyl, 3-phenylpropyl) and an aryloxyalkyl group (e.g., 2-phenoxyethyl, 3-phenoxypropyl).

$X_0$ is a counter ion for charge balance and an anion capable of canceling positive charge formed by a quaternary ammonium salt in the heterocyclic ring. Examples of the counter ion include bromine ion, chlorine ion, iodine ion, p-toluenesulfonate ion, ethylsulfonate ion, perchlorate ion, trifluoromethanesulfonate ion and thiocyanate ion. In this case, n is 1.

When either one of $R^{11}$ and $R^{12}$ has an anionic substituent group such as a sulfoalkyl group, $X_0$ may be in the form of a betaine. In this case, no counter ion is required and m is 0. When $R^{11}$ and $R^{12}$ have two anionic substituent groups such as two sulfoalkyl groups, $X_0$ is a cationic counter ion such as alkali metal ion (e.g., sodium ion, potassium ion) or ammonium ion (e.g., triethylammonium ion).

Preferably, the compounds of formula (IV) have substantially no absorption maximum in the region of visible light.

The description "compounds having substantially no absorption maximum in the region of visible light" as used herein refers to compounds whose remaining color on photographic materials is on a level of a color tone which is not objectionable. More specifically, the description refers to compounds whose after-color after processing is on a level of a color tone which is not objectionable for practical use.

Preferably, the compounds have an absorption maximum in methanol at 460 nm or below, more preferably at 430 nm or below.

Examples of the compounds represented by formula (IV) include, but are not limited to, the following compounds.

IV-1

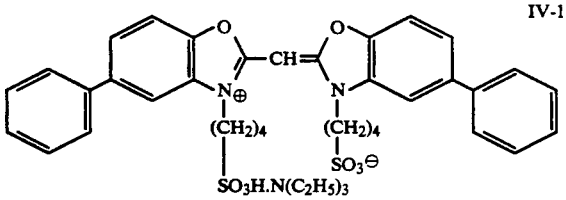

IV-2

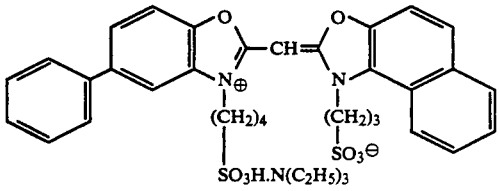

IV-3

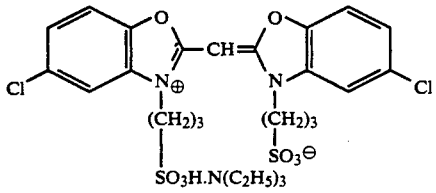

IV-4

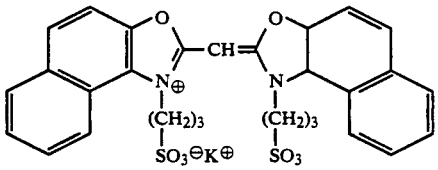

IV-5

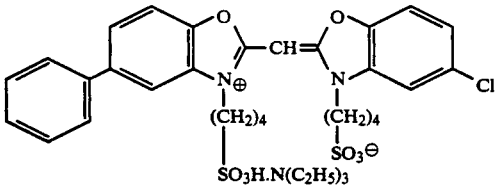

IV-6

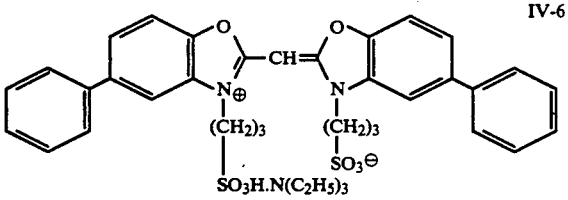

IV-7

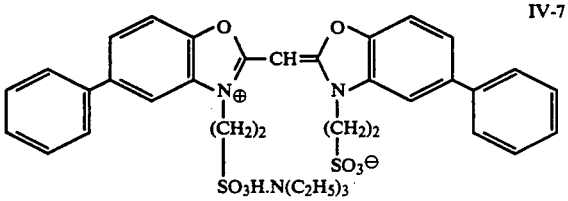

-continued

IV-8

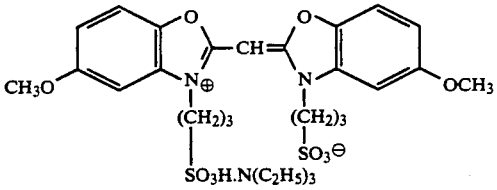

IV-9

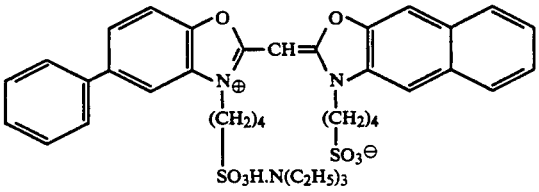

IV-10

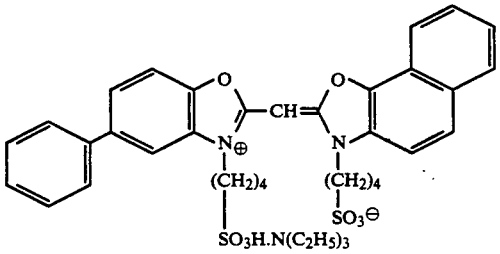

IV-11

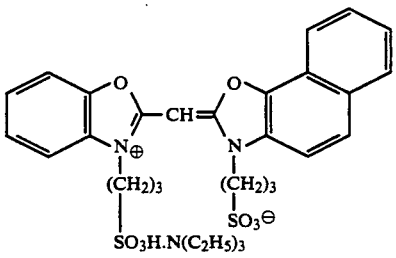

IV-12

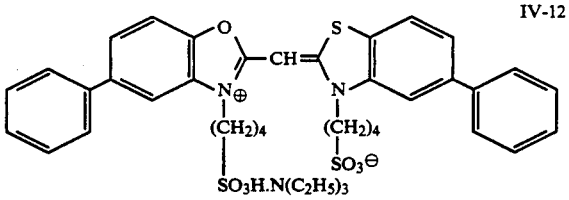

IV-13

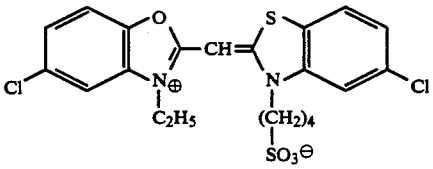

IV-14

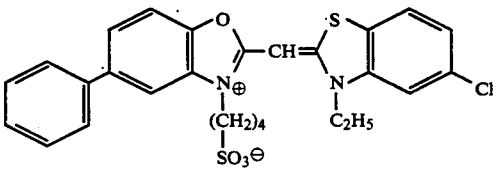

-continued

IV-15

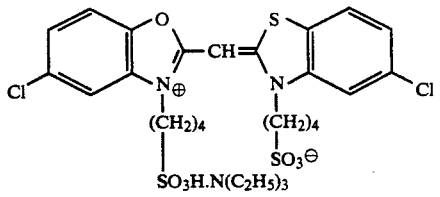

IV-16

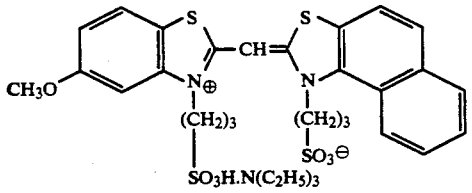

IV-17

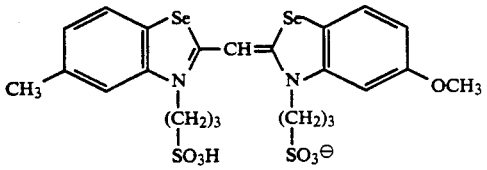

IV-18

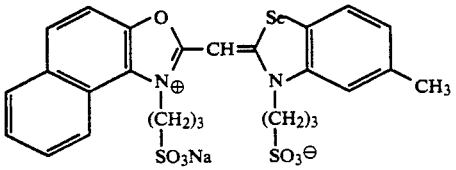

IV-19

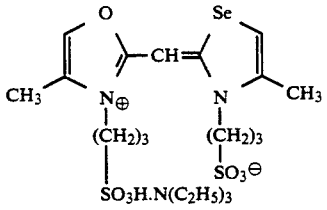

IV-20

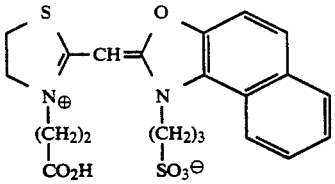

IV-21

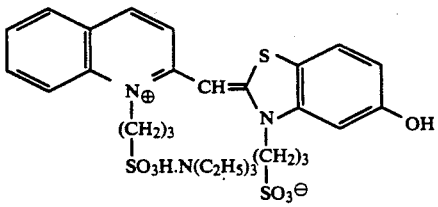

IV-22

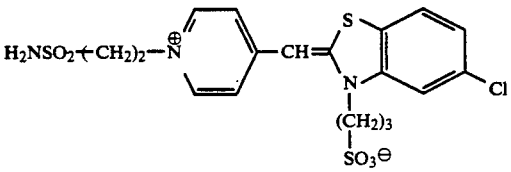

-continued

IV-23

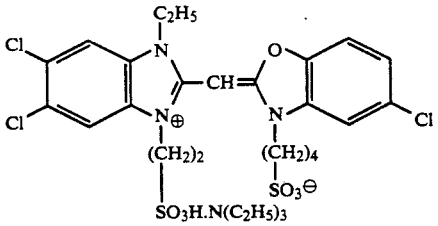

IV-24

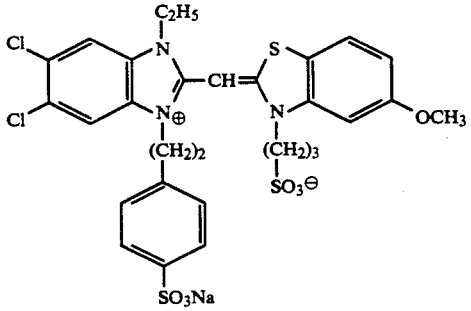

IV-25

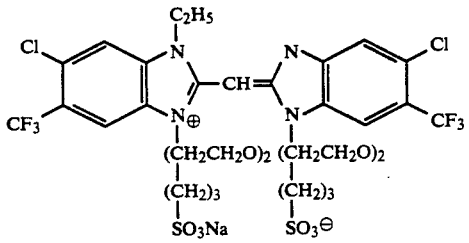

IV-26

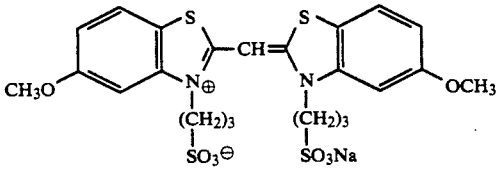

IV-27

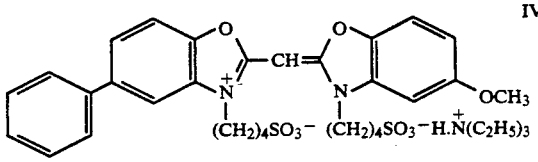

The compounds of formula (IV) are preferably incorporated in the silver halide emulsions when said compounds are to be incorporated in the photographic materials of the present invention. However, the compounds may be incorporated in non-photosensitive hydrophilic colloid layers (e.g., a protective layer, an interlayer, a filter layer, an antihalation layer). When the compounds are water-soluble, they are added in the form of an aqueous solution to hydrophilic colloid solutions, while when the compounds are sparingly soluble in water, they are dissolved in water-miscible organic solvents such as alcohols, esters or ketones and the solutions are added to the hydrophilic colloid solutions. When the compounds are added to the silver halide emulsion layers, the addition may be made at any stage before coating after the commencement of chemical ripening. Preferably, the addition is made before coating after the completion of chemical ripening. It is particularly preferred that the compounds be added to coating solutions.

It is desirable that the optimum amounts of the compounds of formula (IV) be chosen by taking into consideration the grain size of the silver halide emulsion, the halogen composition, the type and degree of chemical sensitization, the relationship between the layer to be incorporated and the silver halide emulsion and the type of antifogging compounds. Test methods for determining the amounts are known by those skilled in the art. The compounds are used in an amount of preferably $10^{-6}$ to $10^{-2}$ mol, particularly preferably $10^{-5}$ to $5\times10^{-3}$ mol, per mol of silver halide.

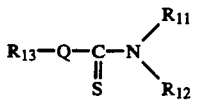

(V)

wherein $R_{13}$ is a hydrogen atom, an alkyl group, an aryl group or a residue of a heterocyclic ring; Q is a single bond, a sulfur atom, a selenium atom, an oxygen atom or a bivalent group selected from the group consisting of a disulfide group (—S—S—), $NR_{14}$,

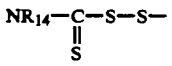

or $NR_{14}CS$ (wherein $R_{14}$ has the same meaning as $R_{13}$); and $R_{11}$ and $R_{12}$ are each a hydrogen atom, an alkyl group, an aryl group, a residue of a heterocyclic ring or an amino group.

$R_{13}$ and $R_{14}$, $R_{11}$ and $R_{12}$, or $R_{11}$ and $R_{13}$ may be combined together to form a 5-membered or 6-membered heterocyclic ring with the proviso that when $R_{11}$ and $R_{13}$ are combined together to form a 5-membered or 6-membered heterocyclic ring, both $R_{12}$ and $R_{14}$ are not hydrogen atoms.

The alkyl groups represented by $R_{11}$, $R_{12}$, $R_{13}$ and $R_{14}$ have 1 to 20 carbon atoms and include unsubstituted alkyl groups and substituted alkyl groups. Examples of substituent groups include a halogen atom (e.g., chlorine), a cyano group, a carboxyl group, a hydroxyl group, an acyloxy group having 2 to 6 carbon atoms (e.g., acetoxy), an alkoxycarbonyl group having 2 to 22 carbon atoms (e.g., ethoxycarbonyl, butoxycarbonyl) and an aryl group (monocyclic or bicyclic aryl group which may be substituted; e.g., phenyl, tolyl, p-sulfophenyl). Preferred examples of the alkyl group include a methyl group, an ethyl group, a propyl group (n- or i-), a butyl group (n-, i- or t-), an amyl group (including branched group; the same applies hereinbelow), a hexyl group, an octyl group, a dodecyl group, a pentadecyl group, a heptadecyl group, a chloromethyl group, a 2-chloroethyl group, a 2-cyanoethyl group, a carboxymethyl group, a 2-carboxyethyl group, a 2-hydroxyethyl group, a 2-acetoxyethyl group, an acetoxyethyl group, an ethoxycarbonylmethyl group, a butoxycarbonylmethyl group, a 2-methoxycarbonylethyl group, a benzyl group, an o-nitrogenzyl group and a p-sulfobenzyl group.

The aryl group represented by $R_{11}$, $R_{12}$, $R_{13}$ and $R_{14}$ include a monocyclic or bicyclic aryl group (preferably monocyclic aryl group) and a substituted aryl group. Examples of substituent groups include an alkyl group having 1 to 20 carbon atoms (e.g., methyl, ethyl, nonyl), an alkoxy group having 1 to 20 carbon atoms (e.g., methoxy, ethoxy), a hydroxy group, a halogen atom (e.g., chlorine, bromine), a carboxyl group and a sulfo group. Examples of the aryl group include a phenyl group, a p-tolyl group, a p-methoxyphenyl group, a p-hydroxyphenyl group, a p-chlorophenyl group, a 2,5-dichlorophenyl group, a p-carboxyphenyl group, an o-carboxyphenyl group, a 4-sulfophenyl group, a 2,4-disulfophenyl group, a 2,5-disulfophenyl group, a 3-sulfophenyl group and a 3,5-disulfophenyl group.

The residue of a heterocyclic ring represented by $R_{11}$, $R_{12}$, $R_{13}$ or $R_{14}$ is preferably a 5-membered to 7-membered ring. Examples thereof include pyrrolidine, pyrrole, tetrahydrofuran, furan, tetrahydrothiophene, thiophene, thiazole, thiadiazoline, oxazole, oxazoline, imidazole, imidazoline, triazole, tetrazole, thiadiazole, oxadiazole, benzothiazole, benzoxazole, benzimidazole, morpholine, pyridine, quinoline, quinoxaline, and azepine. These rings may be substituted by one or more substituent groups. Examples of the substituent groups include those already described above in the definition of the substituent groups for $R_{11}$ to $R_{13}$ Examples of the 5-membered or 6-membered ring formed by $R_{13}$ and $R_{14}$ or $R_{11}$ and $R_{12}$ include a piperidine ring, a piperazine ring, a pyrrole ring, a pyrazole ring, an imidazole ring and a triazole ring. A piperidine ring, a pyrrole ring, a piperazine ring and a morpholine ring are preferred.

Examples of the 5-membered to 6-membered heterocyclic ring formed by $R_{11}$ and $R_{13}$ include a rhodanine ring, a thiazoline ring, a thiazolidine ring, a selenazoline ring, an oxazoline ring, an oxazolidine ring, an imidazoline ring, an imidazolidine ring, a pyrazoline ring, a pyrazolidine ring, a 1,3,4-thiadiazoline ring, a 1,3,4-oxadiazoline ring, a 1,3,4-triazoline ring, a tetrazoline ring, a thiohydantoin ring, a dihydropyridine ring, a dihydropyrimidine ring and a dihydrotriazine ring. Condensed rings formed by condensing these heterocyclic rings with 5-membered to 7-membered carbon rings or heterocyclic rings are also included within the scope of the present invention. Examples of condensed rings with a thiazole ring include a benzothiazoline nucleus, a naphthothiazoline nucleus, a dihydronaphthothiazoline nucleus, and a tetrahydrobenzothiazoline nucleus. An example of a condensed ring with a selenazole ring is a benzoselenazoline nucleus. Examples of condensed rings with an oxazoline ring include a benzoxazoline nucleus and a naphthoxazoline nucleus. Examples of condensed rings with an imidazoline ring include a benzimidazoline nucleus and a dihydroimidazolopyrimidine nucleus. Examples of condensed rings with a triazoline ring include a dihydrotriazolopyridine nucleus and a dihydrotriazolopyrimidine nucleus. Examples of condensed rings with a pyrazoline ring include a dihydropyrazolopyridine nucleus and a dihydropyrazolopyrimidine nucleus. Examples of condensed rings with a dihydropyrimidine ring include a dihydropyrazolopyrimidine nucleus, a dihydropyrrolopyrimidine nucleus and a dihydrotriazolopyrimidine nucleus.

These heterocyclic nuclei may have various substituent groups on the carbon atoms thereof. Examples of substituent groups include an alkyl group having 1 to 20 carbon atoms (e.g., methyl, ethyl, n-butyl, t-butyl, heptyl, heptadecyl), an alkoxy group having 1 to 20 carbon atoms (e.g., methoxy, ethoxy, dodecyloxy, heptadecyloxy), an alkylthio group having 1 to 20 carbon atoms (e.g., methylthio, ethylthio, butylthio), a hydroxyl group, a mercapto group, an amino group (including an unsubstituted amino group and a substituted amino group; e.g., an alkyl-substituted amino group such as dimethylamino, methylamino, diethylamino, butylamino and benzylamino; an aryl-substituted amino group such as anilino and diphenylamino; an acylamino group such as acetylamino, capryloylamino, benzoylamino, methylsulfonylamino, benzenesulfonylamino and p-toluenesulfonylamino; and a thioamido group such as acetylthioamido and propionylthioamido), an aryl group (e.g., phenyl, naphthyl, tolyl), an alkenyl group having 2 to 20 carbon atoms (e.g., allyl, methallyl), an aralkyl group wherein alkyl moiety has 1 to 4 carbon atoms (e.g., benzyl, phenethyl), a halogen atom (e.g., chlorine, bromine), a cyano group, a carboxyl group, a sulfo group, a carbamoyl group (including a substituted carbamoyl group; e.g., carbamoyl, methylcarbamoyl, dimethylcarbamoyl, ethylcarbamoyl, phenylcarbamoyl), a thiocarbamoyl group (including a substituted thiocarbamoyl group; e.g., thiocarbamoyl, methylthiocarbamoyl, dimethylthiocarbamoyl, ethylthiocarbamoyl, phenylthiocarbamoyl), an alkoxycarbonyl group having 2 to 22 carbon atoms (e.g., methoxycarbonyl, ethoxycarbonyl, butoxycarbonyl), an aryloxycarbonyl group (e.g., phenoxycarbonyl), an alkylcarbonyl group having 2 to 22 carbon atoms (e.g., acetyl, capryloyl) and an oxygen atom. The above-described alkyl group may be further substituted, for example, by a carboxyl group, a sulfo group, an alkoxycarbonyl group (e.g., methoxycarbonyl, ethoxycarbonyl), an acyloxy group (e.g., acetoxy) and an aryl group (e.g., phenyl or a substituted aryl group such as nitrophenyl).

Said heterocyclic rings may also have one or more substituent groups on the nitrogen atom thereof. Examples of the substituent groups include those already described above in the definition of the substituent groups for $R_{12}$.

When Q is $NR_{14}$, the alkyl group represented by $R_{14}$ has 1 to 20 carbon atoms and include unsubstituted alkyl groups and substituted alkyl groups. Examples of substituent groups include a halogen atom, a cyano group, a carboxyl group, a sulfo group, a sulfato group, a phospho group, a carbamoyl group, an aminosulfonyl group, a hydroxy group, an alkoxy group having 1 to 20 carbon atoms [e.g., methoxy, ethoxy, propoxy, butoxy; including a substituted alkoxy group which may be substituted by a hydroxyl group, an alkoxy group having 1 to 6 carbon atoms (e.g., methoxy, ethoxy, propoxy), an acyloxy group having 2 to 8 carbon atoms (e.g., acetoxy, propioxy), a sulfo group or a sulfoalkoxy group having 1 to 6 carbon atoms (e.g., 2-sulfoethoxy, 3-sulfopropoxy)], an acyloxy group having 2 to 22 carbon atoms (e.g., acetoxy, propioxy), an alkenyl group having 2 to 22 carbon atoms (e.g., vinyl), an alkoxycarbonyl group having 2 to 22 carbon atoms (e.g., methoxycarbonyl, ethoxycarbonyl, butoxycarbonyl, dodecyloxycarbonyl), an aryl group (a monocyclic or bicyclic aryl group which may be substituted; e.g., phenyl, p-sulfophenyl) and a residue of a heterocyclic group (e.g., a residue of a thiazole ring, a residue of an oxazole ring, a residue of an imidazole ring, a residue of a thiadiazole ring, a residue of an oxadiazole ring, a residue of a triazole ring, a residue of a tetrazole ring, a residue of a pyrimidine ring, and a group represented by the following formula

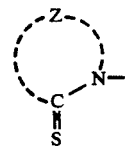

is particularly preferred in which Z represents an atomic group forming a ring with C and N).

Examples of the alkyl group represented b $R_{12}$ include a methyl group, an ethyl group, a propyl group (n- or i-), a butyl group (n-, sec-, i- or t-), an n-hexyl group, a dodecyl group, a heptadecyl group, a chloromethyl group, a 2-chloroethyl group, a 2-cyanoethyl group, a carboxymethyl group, a 2-carboxyethyl group, a 2-sulfoethyl group, a 3-sulfopropyl group, a 3-sulfobutyl group, a 4-sulfobutyl group, a 2-sulfatoethyl group, a 2-phosphoethyl group, a 2-hydroxyethyl group, a 3-hydroxypropyl group, a 2-methoxyethyl group, a 3-methoxypropyl group, a 2-ethoxyethyl group, a 2-(2-hydroxyethoxy)ethyl group, a 2-(2-acetoxyethoxy)ethyl group, a 2-(2-sulfoethoxy)ethyl group, a 2-[2-(3-sulfopropoxy)ethoxy]ethyl group, a 2-acetoxyethyl group, a 4-propionyloxybutyl group, an allyl group, a methoxycarbonylmethyl group, a 2-(methoxycarbonyl-)ethyl group, a 4-(ethoxycarbonyl)butyl group, a butoxycarbonylmethyl group, a benzyl group, a 2-phenylethyl group, a p-sulfobenzyl group and a 2-(2-mercapto-3-benzimidazolyl group.

Among the compounds represented by formula (V), compounds represented by the following formula (Va) are preferred.

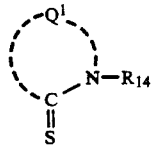

(Va)

wherein $Q^1$ is an atomic group required for the formation of a 5-membered or 6-membered heterocyclic ring; $R_{14}$ has the same meaning as in formula (V) except that $R_{14}$ is always a group other than a hydrogen atom; and no hydrogen atom is attached to atoms adjacent to the thioketo group; said atoms being members forming the atomic group represented by $Q^1$.

Examples of heterocyclic rings formed by $Q^1$ are those already described above in the definition of the heterocyclic rings formed by $R_{11}$ and $R_{13}$.

The heterocyclic rings formed by $Q^1$ may have one or more bivalent substituent groups of, for example, an oxo group (=O), a thioxo group (=S), an ethylidene group ($CH_3CH$=), a substituted ethylidene group (e.g., a benzoxazolylideneethylidene group, a thiazolinylideneethylidene group, a pyridylideneethylidene group, a quinolylideneethylidene group) and a bivalent residue of a heterocyclic ring (e.g., a benzoxazolylidene group, a benzothiazolylidene group, a thiazolinylidene group, a pyridylidene group, a quinolylidene group).

The compounds of formula (V) can be synthesized according to the methods described in JP-B-48-34169 (Compound Nos. 1 to 8, 31 and 32) (the term "JP-B" as used herein refers to an "examined Japanese patent publication"), *Pharmaceutical Journal*, 74, 1365–1369 (1954) (Compound No. 9), *Beilstein*, XIII, 394, IV 121

(Compound Nos. 12 and 13), JP-B-47-18008 (Compound No. 19) and JP-B-48-34168 (Compound No. 25).
Examples of the thioamido compounds which can be used in the present invention include the following compounds.
V-1
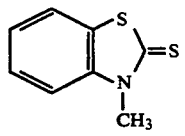
V-2
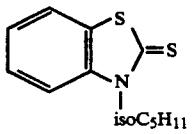
V-3
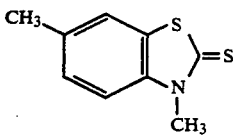
V-4
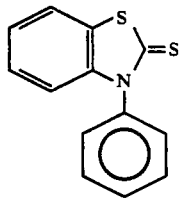
V-5
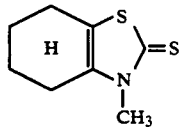
V-6
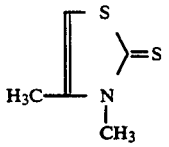
V-7
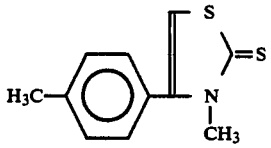
V-8
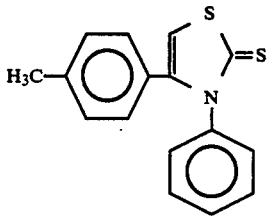
-continued
V-9
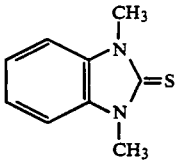
V-10
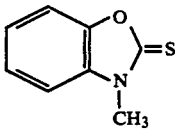
V-11
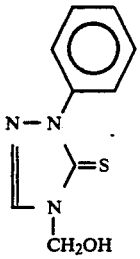
V-12
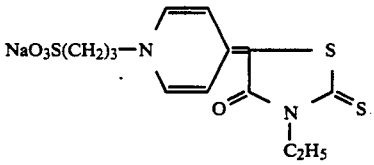
V-13
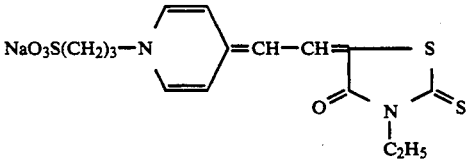
V-14
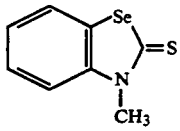
V-15
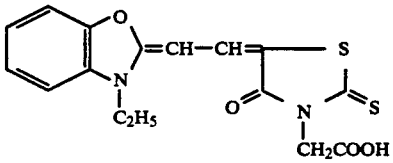
V-16
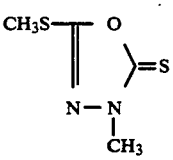

-continued
V-17
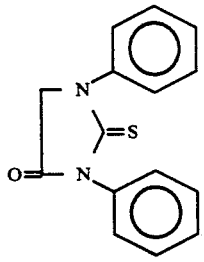
V-18
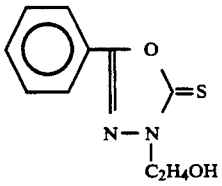
V-19
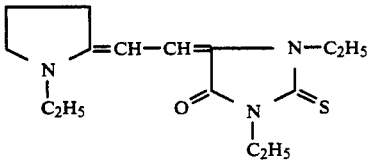
V-20
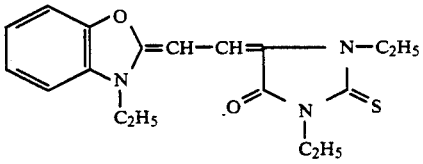
V-21
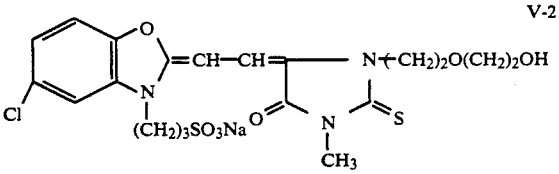
V-22
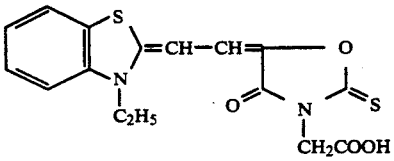
V-23
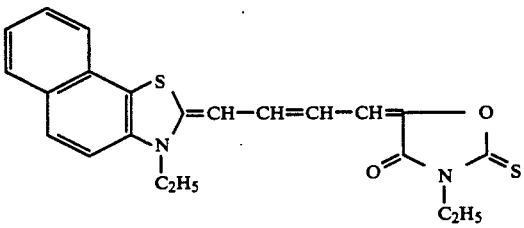
-continued
V-24
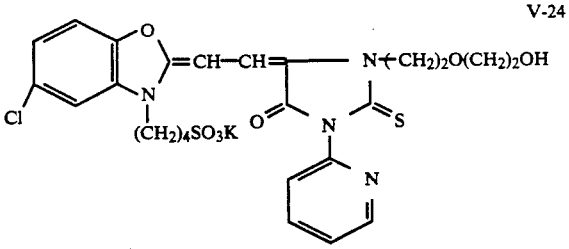
V-25
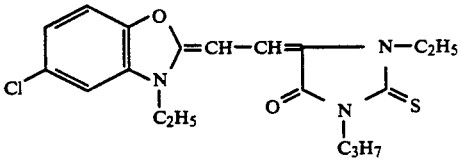
V-26
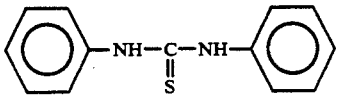
V-27
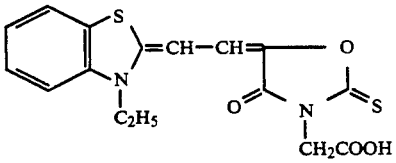
V-28
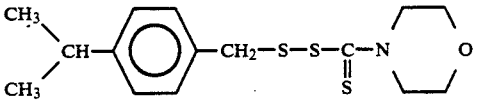
V-29
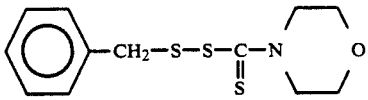
V-30
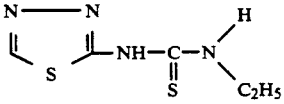
V-31
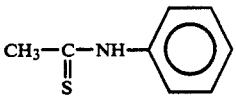
V-32
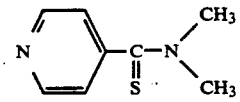
V-33
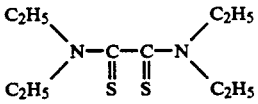
V-34
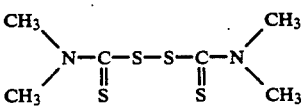
The compounds of formula (V) are preferably incorporated in the silver halide emulsion layers of the present invention. However, the compounds may be incorporated in nonsensitive colloid layers (e.g., a protective layer, an interlayer, a filter layer, an antihalation layer). When the compounds are soluble in water, they are added in the form of an aqueous solution to hydrophilic colloid solutions. When the compounds are sparingly soluble in water, the compounds are dissolved in water-miscible organic solvents such as alcohols, ethers or ketones and the solutions are added to the hydrophilic colloid solutions. When the compounds are to be added to the silver halide emulsion layers, the addition may be made at any stage before coating after the commencement of chemical ripening. However, it is preferred that the addition be made before coating after the completion of chemical ripening. It is also preferred that the compounds be added to coating solutions.

It is desirable that the optimum amounts of the compounds of formula (V) be chosen by taking into consideration the grain size of the silver halide emulsion, the halogen composition, the type and degree of chemical sensitization, the relationship between the layer in which the compounds are incorporated and the silver halide emulsion and the type of antifogging compounds. Test methods for choosing the amounts are known by those skilled in the art. Generally, the compounds are used in an amount of preferably $10^{-6}$ to $1\times10^{-2}$ mol, particularly preferably $1\times10^{-5}$ to $5\times10^{-3}$ mol, per mol of silver halide.

Dyes which can be preferably used in the present invention are those (including ultraviolet light absorbers) having peaks at 300 to 420 nm, more preferably at 350 to 410 nm. Examples of the dyes are described in JP-A-62-210458, JP-A-63-104046, JP-A-63-103235, JP-A-63-208846, JP-A-1-61745, JP-A-63-306436 and JP-A-63-314535.

Examples of compounds having absorption peaks at 300 to 420 nm which can be preferably used in the present invention include aryl group-substituted benzotriazole compounds, 4-thiazolidone compounds, benzophenone compounds, cinnamic ester compounds, butadiene compounds, benzoxazole compounds and ultraviolet light-absorbing polymers.

Dyes which are particularly preferred are compounds having absorption maxima at 300 to 420 nm, represented by formulae (D-1), (D-2), (D-3) or (D-4).

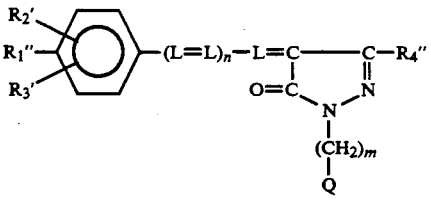

(D-I)

wherein $R_1''$ is an atomic group represented by —OX or

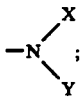

X and Y are each a hydrogen atom, an alkyl group, a cyanoalkyl group, a carboxyalkyl group, a sulfoalkyl group, a hydroxyalkyl group, a halogenated alkyl group or an alkyl group which may be substituted, or may be in the form of sodium or potassium salt; $R_2''$ and $R_3''$ are each a hydrogen atom, a halogen atom, an alkyl group, a hydroxyl group, an alkoxy group, an alkylthio group or the same as those set forth in —OX group; Q is a phenyl group substituted by at least one member of a halogen atom, a carboxyl group, a sulfo group or a sulfoalkyl group (these substituent groups being optionally in the form of sodium or potassium salt), or Q is a sulfoalkyl group, a sulfoalkoxyalkyl group or a sulfoalkylthioalkyl group; L is a methine group which may be substituted; $R_4''$ is an alkyl group, a carboxyl group, an alkyloxycarbonyl group or an acyl-substituted or unsubstituted amino group; m is an integer of 1 or 2; and n is an integer of 0 or 1.

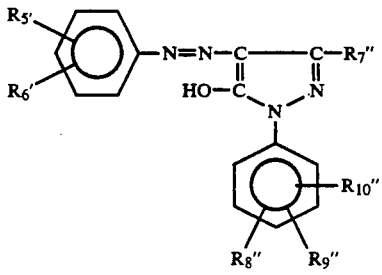

(D-II)

wherein $R_5''$, $R_6''$, $R_8''$, $R_9''$ and $R_{10}''$ are each a hydrogen atom, an alkyl group, a hydroxyl group, an alkoxy group, an amino group, an acylamino group, a carboxyl group or a sulfo group, these groups being optionally in the form of sodium or potassium salt; and $R_7''$ is an alkyl group or a carboxyl group.

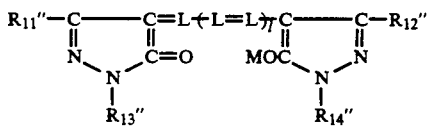

(D-III)

wherein $R_{11}''$ and $R_{12}''$ are each an alkyl group, a substituted alkyl group, an aryl group, an alkoxycarbonyl group or a carboxyl group; $R_{13}''$ and $R_{14}''$ are each a sulfo group- or carboxyl group-substituted alkyl group, a sulfo group- or carboxyl group-substituted aryl group, these groups being optionally in the form of sodium or potassium salt; L is a substituted or unsubstituted methine chain; M is sodium, potassium or hydrogen; l is 0 or 1.

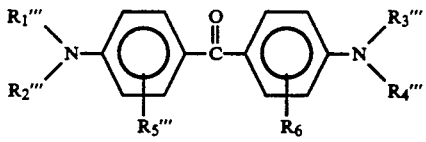

(D-IV)

wherein $R_1'''$, $R_2'''$, $R_3'''$ and $R_4'''$ are each an alkyl group, a hydroxyalkyl group, a cyano group, an alkylcyano group, an alkoxy group or a sulfoalkyl group; and $R_5'''$ and $R_6'''$ are each a sulfo group or an alkylsulfo group.

Examples of the dyes which can be preferably used in the present invention include, but are not limited to, the following compounds.

D-4
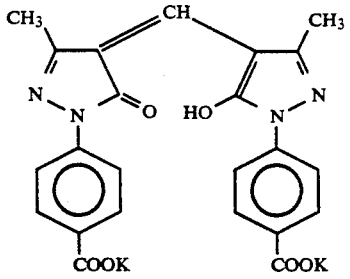
D-5
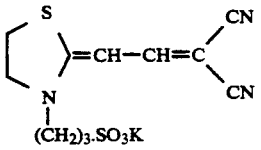
D-6
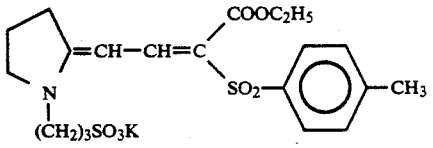
D-7
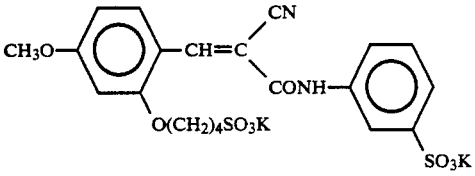
D-8
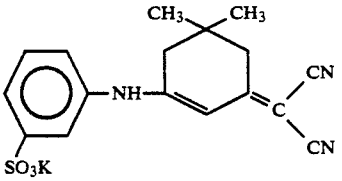
D-9
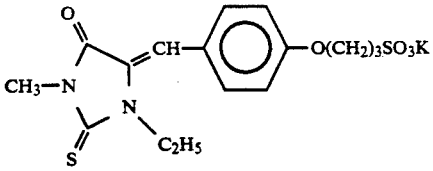
D-10
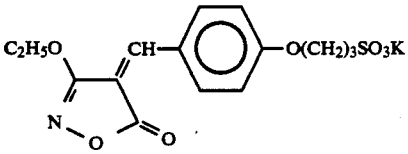
D-11
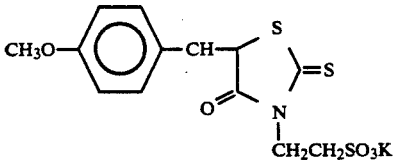
-continued
D-12
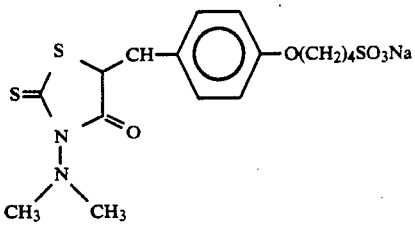
D-13
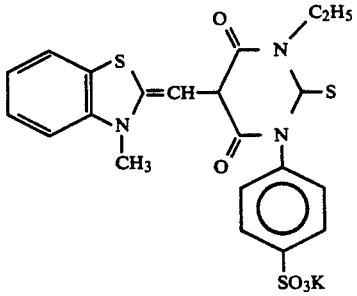
D-14
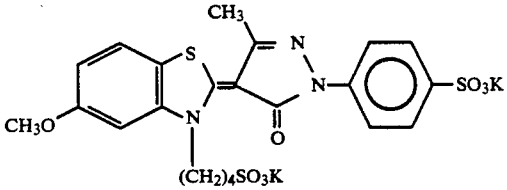
D-15
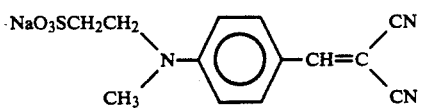
D-16
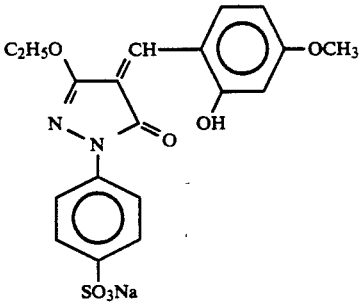
D-17
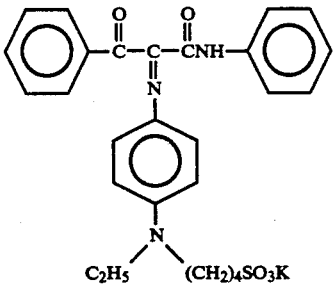
D-18
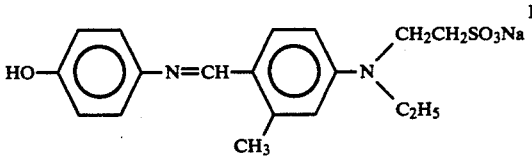

-continued

D-19

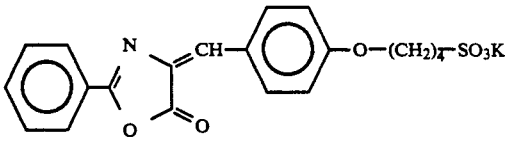

D-20

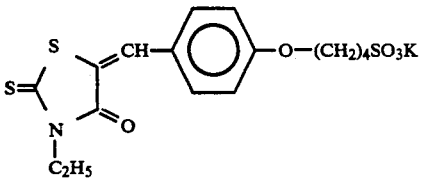

D-21

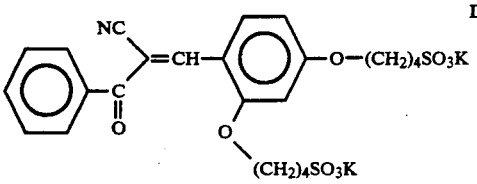

D-22

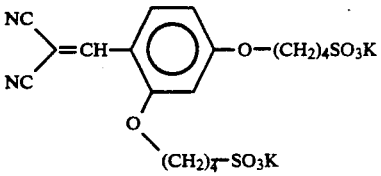

D-23

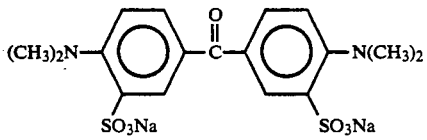

D-24

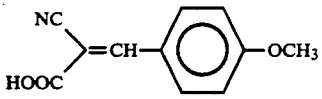

-continued

D-25

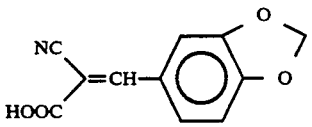

D-26

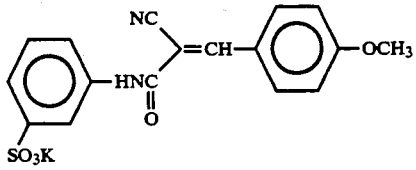

D-27

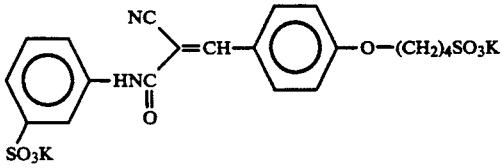

These dyes may be added to any of the emulsion layers, the interlayer, the protective layer and other hydrophilic colloid layers. Alternatively, these dyes may be substantially fixed to arbitrary layers. In this case, the dyes are preferably allowed to exist in the emulsion layers or layers outside emulsions. Compounds described in JP-B-43-10254 can be used as mordants for fixing these dyes.

Further, the crystallite dispersions of solid dye particles described in U.S. Pat. No. 73,256 and WO-8804794 can be used.

As dyes suitable for use in the present invention, there are functional dyes which can be decolorized in developing solutions, as described in JP-A-63-208846 and JP-A-1-61745. Examples of the functional dyes include the following compounds.

D-28

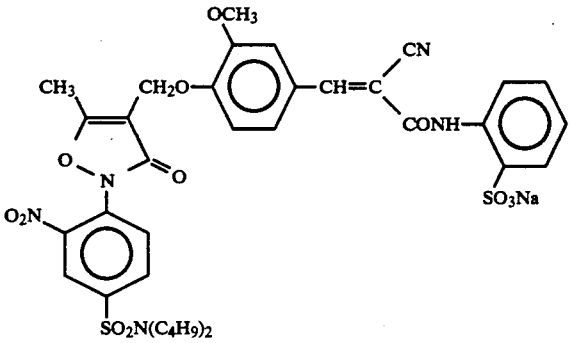

-continued
D-29
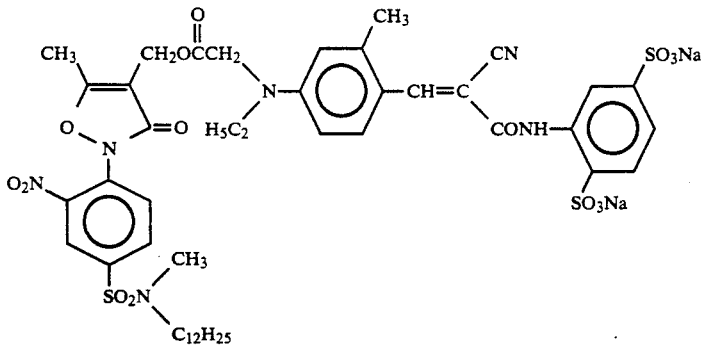
D-30
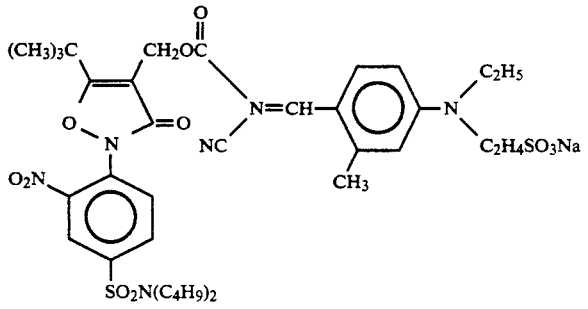
D-31
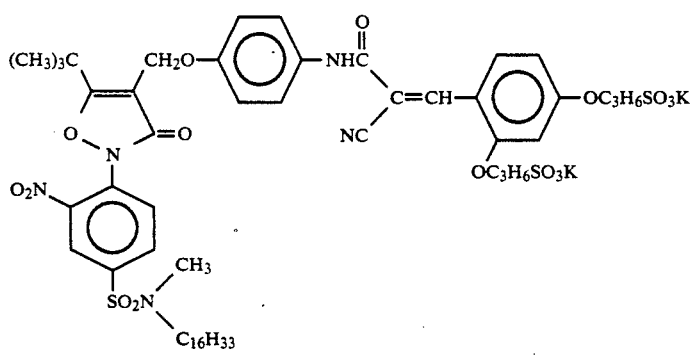
D-32
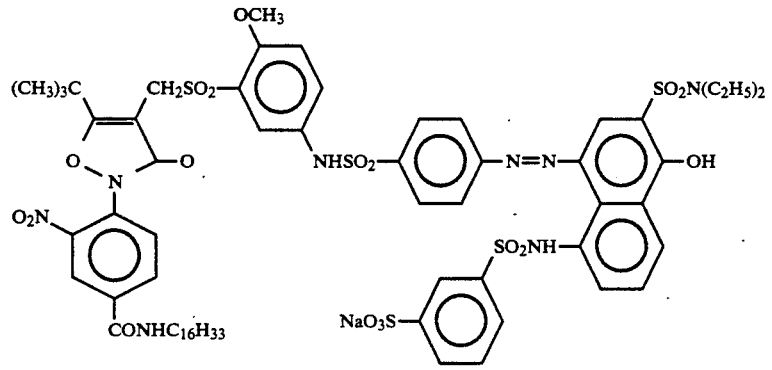

-continued

D-33

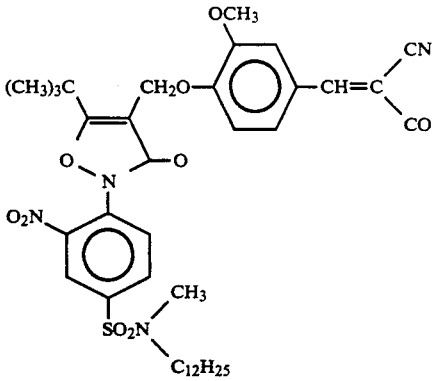

D-34

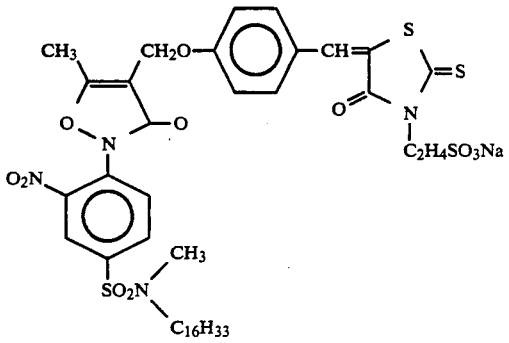

D-35

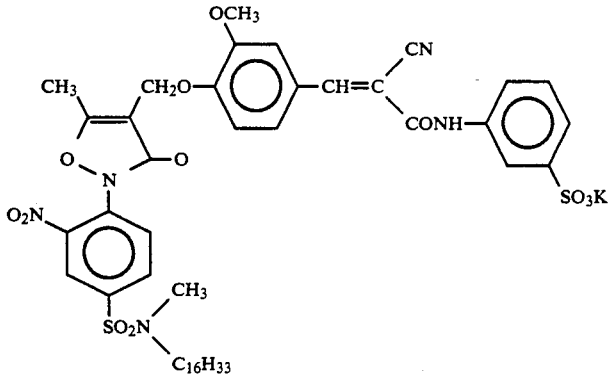

D-36

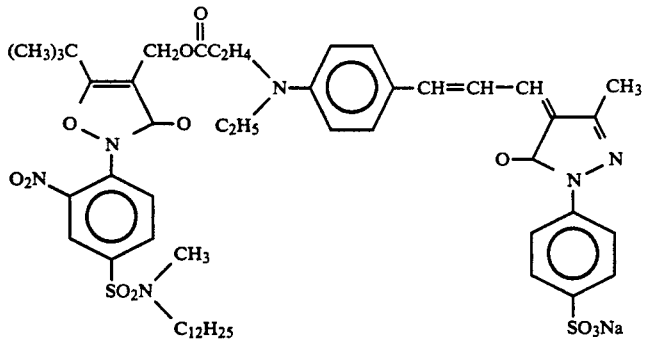

The amounts of the dyes to be used vary depending on their molar absorption coefficient, but they are generally used in the range of $10^{-2}$ to 1 g/m$^2$, preferably 50 to 500 mg/m$^2$.

The dyes may be dissolved in appropriate solvents (e.g., water, alcohols such as methanol, ethanol and propanol, acetone, methyl cellosolve and mixtures thereof) and the resulting solution may be added to coating solutions for the hydrophilic colloid layers of the present invention.

These dyes may be used either alone or in combinations of two or more of them.

Sensitizing dyes (e.g., cyanine dyes, merocyanine dyes, etc.) described in JP-A-55-52050 (pages 45 to 53) may be added to the photographic materials of the present invention to increase sensitivity.

The sensitizing dyes may be used either alone or in combinations. Combinations of the sensitizing dyes are often used for the purpose of supersensitization. In addition to the sensitizing dyes, emulsions may contain a dye which itself does not have a spectral sensitizing effect or a material which does not substantially absorb visible light, but exhibits a supersensitization activity.

Useful sensitizing dyes, the combinations of dyes exhibiting a supersensitization effect and compounds exhibiting supersensitization effect are described in *Research Disclosure,* Vol. 176, No. 17643, Item IV-J (page 23) (December, 1978).

The photographic materials of the present invention may contain various compounds to prevent fogging from being caused during the manufacturing process, storage or processing of the photographic materials or to stabilize photographic performance. Examples of such compounds include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds such as oxazolinethione; azaindenes such as triazaindenes, tetraazaindenes (particularly 4-hydroxy-substituted(1,3,3a,7)tetraazaindenes and pentaazaindenes; benzenethiosulfones; benzenesulfinic acid and benzenesulfonamido. These compounds are known as antifogging agents or stabilizers. Among these compounds, benzotriazoles (e.g., 5-methylbenzotriazole) and nitroindazoles (e.g., 5-nitroindazole) are preferred. Alternatively, these compounds may be incorporated in processing solutions.

The photographic emulsion layers and other hydrophilic colloid layers of the photographic materials of the present invention may contain inorganic or organic hardening agents. Examples of hardening agents include chromium salts (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine) and mucohalogenic acids (e.g., mucochloric acid, mucophenoxychloric acid). These compounds may be used either alone or in combination.

The photographic emulsion layers or other hydrophilic colloid layers of the photographic materials of the present invention may contain various surfactants as coating aids or for the purpose of imparting antistatic properties, improving slipperiness, emulsifying dispersion or photographic characteristics (e.g., development acceleration, high contrast, sensitization) or preventing sticking from being caused.

Examples of surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkyl aryl ethers, polyethylene glycol esters, polyethylene glycol sorbitan esters, polyalkylene glycol alkylamines or amides, adduct of polyethylene oxide to silicone), glycidol derivatives (e.g., polyglyceride of alkenylsuccinic acids, alkylphenol polyglyceride), and fatty acid esters or alkyl esters of polyhydric alcohols; anionic surfactants having a carboxyl group, a sulfo group, a phospho group, a sulfuric ester group or a phosphoric ester group such as alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkylphenyl ethers and polyoxyethylene alkylphosphoric esters; ampholytic surfactants such as amino acids, aminoalkylsulfonic acids, aminoalkylsulfuric or phosphoric esters, alkylbetaines and amine oxides; and cationic surfactants such as alkylamine salts, aliphatic or aromatic quaternary ammonium salt, heterocyclic quaternary ammonium salts such as pyridinium salts and imidazolium salts and aliphatic or heterocyclic phosphoniums or sulfonium salts.

Surfactants which can be preferably used in the present invention are polyalkylene oxides having a molecular weight of not less than 600 described in JP-B-58-9412. When the surfactants are used as antistatic agents, fluorine-containing surfactants as described in U.S. Pat. No. 4,201,586, JP-A-60-80849 and JP-A-59-74554 are preferred.

The photographic emulsion layers or other hydrophilic colloid layers of the photographic materials of the present invention may contain matting agents such as silica, magnesium oxide and polymethyl methacrylate for the purpose of preventing sticking.

The photographic emulsions of the present invention may contain dispersions of water-insoluble or sparingly water- soluble synthetic polymers for the purpose of improving dimensional stability. Examples of such polymers include polymers comprising a monomer component such as alkyl (meth)acrylate, alkoxyalkyl (meth)acrylate and glycidyl (meth)acrylate, either alone or in combination, or in combination thereof with acrylic acid or methacrylic acid.

The silver halide emulsion layers or other layers of the photographic materials of the present invention preferably contain compounds having acidic groups. Examples of the compounds having acid groups include organic acids such as salicylic acid, acetic acid and ascorbic acid; polymers or copolymers having a repeating unit of acid monomer such as acrylic acid, maleic acid and phthalic acid. With respect to these compounds the disclosures of JP-A-61-223834, JP-A-61-228437, JP-A-62-25745 and JP-A-62-55642 may be referred to. Among these compounds, ascorbic acid is particularly preferred and water-dispersible latexes of copolymers of an acid monomer such as acrylic acid with a crosslinking monomer having at least two unsaturated groups such as divinylbenzene are preferred.

Gelatin is preferred as a binder or protective colloid for the photographic materials. However, other hydrophilic synthetic high molecular materials can also be used. As gelatin, there can be used lime-processed gelatin, acid-processed gelatin and gelatin derivatives. Examples of gelatin are described in *Research Disclosure,* Vol. 176, No. 17643, Item IX (December, 1978).

Ultrahigh contrast, high sensitivity photographic characteristics can be obtained by processing the silver halide photographic materials of the present invention with stable developing solutions without using conventional infectious developing solutions or highly alkaline developing solutions having a pH of nearly 13 as described in U.S. Pat. No. 2,419,975.

Namely, sufficiently ultrahigh contrast negative images can be obtained when the silver halide photographic materials of the present invention are processed with developing solutions containing sulfite ions as a preservative in an amount of at least 0.15 mol/liter and having a pH of 10.5 to 12.3, particularly 11.0 to 12.0.

There is no particular limitation with regard to developing agents for use in the developing solutions of the present invention. However, developing solutions containing dihydroxybenzenes are preferred, because good halftone dot quality can be easily obtained. Combinations of dihydroxybenzenes with 1-phenyl-3-pyrazolidones or p-aminophenols are often used.

Examples of dihydroxybenzene developing agents which can be used in the present invention include hydroquinone, chlorohydroquinone, bromohydroquinone, isopropylhydroquinone, methylhydroquinone, 2,3-dichlorohydroquinone and 2,5-dichlorohydroquinone, with N-methyl-p-aminophenol being preferred.

Preferably, the developing agents are used in an amount of 0.05 to 0.8 mol/liter. When the combinations of the dihydroxybenzenes with 1-phenyl-3-pyrazolidones or p-aminophenols are used, it is preferred that the former be used in an amount of 0.05 to 0.5 mol/liter and the latter be used in an amount of not more than 0.06 mol/liter.

Examples of sulfites which are used as preservatives in the present invention include sodium sulfite, potassium sulfite, lithium sulfite, ammonium sulfite, sodium bisulfite, potassium metabisulfite and formaldehyde/-sodium bisulfite. The sulfites are used in an amount of preferably not less than 0.4 mol/liter, particularly preferably not less than 0.5 mol/liter. The upper limit is preferably 2.5 mol/liter.

Examples of alkaline agents for use in adjusting pH value include pH adjustors or pH buffering agents such as sodium hydroxide, potassium hydroxide, sodium carbonate, potassium carbonate, sodium tertiary phosphate and potassium tertiary phosphate.

Additives used other than the above-described components may include compounds such as boric acid and borax; development inhibitors such as sodium bromide, potassium bromide and potassium iodide; organic solvents such as ethylene glycol, diethylene glycol, triethylene glycol, dimethylformamide, methyl cellosolve, hexylene glycol, ethanol and methanol; antifoggants or black pepper inhibitors such as mercapto compounds, for example, 1-phenyl-5-mercaptotetrazole, and sodium 2-mercaptobenzimidazole-5-sulfonate; indazole compounds, for example, 5-nitroindazole, and benzotriazoles, for example, 5-methylbenzotriazole. Optionally, the additives may include toners, surfactants, defoaming agents, water softeners, hardening agents and the amino compounds described in JP-A-56-106244 and JP-A-1-29418.

Fixing solutions are aqueous solutions containing thiosulfates, water-soluble aluminum compounds, acetic acid and dibasic acids (e.g., tartaric acid, citric acid or salts thereof) and have a pH of at least 4, preferably from 4.4 to 5.0.

Fixing agents contain thiosulfate ion and ammonium ion as essential components. Examples of the fixing agents include ammonium thiosulfate salt and ammonium thiosulfate. Ammonium thiosulfate is particularly preferred from the viewpoint of fixing rate. The amounts of the fixing agents to be used can be properly varied, but are generally about 0.1 to about 5 mol/liter.

Water-soluble aluminum salts which mainly function as hardening agents in fixing solutions are compounds which are generally known as hardening agents for acidic hardening fixing solutions. Examples of such aluminum salts include aluminum chloride, aluminum sulfate and potash alum.

The silver halide photographic materials of the present invention give high Dmax. Therefore, when subjected to reduction processing after the formation of an image, high density can be kept even when dot area is reduced.

The present invention is now illustrated in greater detail by reference to the following examples which, however, are not to be construed as limiting the invention in any way.

The following Developing Solutions A, B and C were used in the Examples.

| Developing Solution A | |
|---|---|
| Hydroquinone | 50.0 g |
| N-Methyl-p-aminophenol | 0.3 g |
| Sodium Hydroxide | 18.0 g |
| 5-Sulfosalicylic Acid | 30.0 g |
| Boric Acid | 20.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)benzene-sulfonate | 0.2 g |
| 6-Dimethylamino-1-hexanol | 4.0 g |
| Sodium Toluenesulfonate | 15.0 g |
| Water to make | 1 liter |

pH was adjusted to 11.7 by adding potassium hydroxide.

| Developing Solution B | |
|---|---|
| Hydroquinone | 50.0 g |
| N-Methyl-p-aminophenol | 0.3 g |
| Sodium Hydroxide | 18.0 g |
| 5-Sulfosalicylic Acid | 30.0 g |
| Boric Acid | 20.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)benzene-sulfonate | 0.2 g |
| N-n-butyldiethanolamine | 15.0 g |
| Sodium Toluenesulfonate | 4.0 g |
| Water to make | 1 liter |

pH was adjusted to 11.7 by adding potassium hydroxide.

| Developing Solution C | |
|---|---|
| Hydroquinone | 50.0 g |
| 4-Methyl-4-hydroxymethyl-1-phenyl-3-pyrazolidone | 0.1 g |
| Sodium Hydroxide | 18.0 g |
| 5-Sulfosalicylic Acid | 30.0 g |
| Boric Acid | 20.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenziidazole-5-sulfonic Acid | 0.3 g |
| Sodium 3-(5-Mercaptotetrazole)benzene-sulfonate | 0.2 g |
| 6-Dimethylamino-1-hexanol | 4.0 g |
| Sodium Toluenesulfonate | 15.0 g |
| Water to make | 1 liter |

pH was adjusted to 11.7 by adding potassium hydroxide.

Unless otherwise indicated herein, all parts, percents, ratios and the like are by weight.

EXAMPLE 1

Emulsions A, B, C and D were prepared in the following manner.

EMULSION A

A cubic monodisperse silver iodobromide emulsion (coefficient of variation: 0.15, silver iodide: 0.5 mol %, iodine distribution being uniform) having a grain size of 0.25 μm was prepared by a controlled double jet process.

After the emulsion was desalted by a flocculation method, 70 mg of Proxel as an antiseptic per mol of silver was added thereto. The temperature of the emulsion was kept at 50° C., and $5\times10^{-4}$ mol of the following Compound (a) as a sensitizing agent and $10^{-3}$ mol of a potassium iodide solution were added thereto, each amount being per mol of silver. After the lapse of 15 minutes, the temperature was lowered.

EMULSION B

A cubic silver iodobromide emulsion (silver iodide: 0.5 mol %, iodine distribution being uniform) having a grain size of 0.25 μm was prepared by a controlled double jet process in the same way as in the preparation of Emulsion A except that the rate (the number of revolutions) of stirring during the formation of grains was lowered to obtain grains having a coefficient of variation of 0.23.

In the same manner as in the preparation of Emulsion A, the emulsion was desalted by a flocculation method, the antiseptic was added thereto and the temperature of the emulsion was kept at 50° C. The following Compound (a) as the sensitizing dye and the potassium iodide solution were added thereto. After the lapse of 15 minutes, the temperature was lowered.

EMULSION C

A cubic silver iodobromide emulsion (silver iodide: 0.5 mol %, iodine distribution being uniform) having a grain size of 0.25 μm was prepared by a controlled double jet process except that the rate (the number of revolutions) of stirring was further lowered in comparison with the rate of stirring in the preparation of Emulsion B to obtain grains having a coefficient of variation of 0.30.

In the same manner as in the preparation of Emulsion A, the emulsion was desalted by a flocculation method, the antiseptic was added thereto and the temperature of the emulsion was kept at 50° C. The following Compound (a) as the sensitizing dye and the potassium iodide solution were added thereto. After the lapse of 15 minutes, the temperature was lowered.

EMULSION D

Cubic monodisperse silver iodobromide emulsions (silver iodide: 0.5 mol %, iodine distribution being uniform, coefficients of variation: 14% and 15%) having grain sizes of 0.20 μm and 0.33 μm respectively were mixed in a ratio of 60/40 by silver halide molar ratio to obtain Emulsion D.

In the same manner as in the preparation of Emulsion A, the emulsion was desalted by a flocculation method, the antiseptic was added thereto and the temperature of the emulsion was kept at 50° C. The following Compound (a) as the sensitizing dye and the potassium iodide solution were added thereto. After the lapse of 15 minutes, the temperature was lowered.

4-Hydroxy-6-methyl-1,3,3a,7-tetraazaindene, 5-methylbenzotriazole and the following Compounds (b) and (c) as stabilizers were added to each of Emulsions A to D in such an amount that each compound in an amount of 5 mg/m² was coated.

(a)

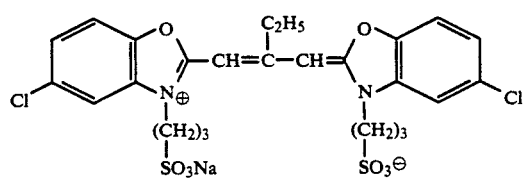

(b)

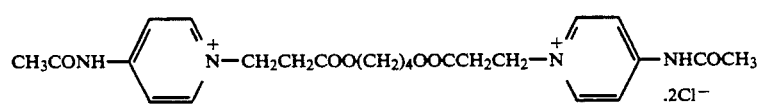

(c)

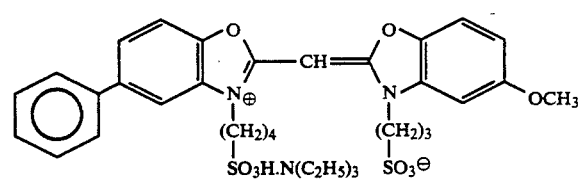

Compounds II-19 and II-5 as the hydrazine compounds of the present invention in an amount given in Table 1 and the redox compound (releasing a development inhibitor when oxidized) of the present invention in an amount given in Table 1 were added to each of Emulsions A to D. When Compound II-5 as the hydrazine compound was addede, the following Compound (d) was also added in such an amount as to give a coating weight of 2.3 mg/m².

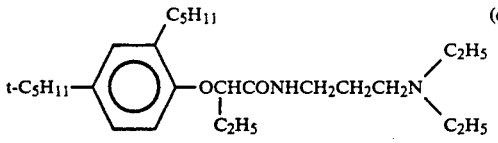

(d)

Further, polyethylene glycol having an average molecular weight of 600 was added to each of Emulsions A to D in such an amount as to give a coating weight of 75 mg/m². 30 wt % (on a solid basis, based on the amount of gelatin) of polyethyl acrylate and 1,3-divinylsulfonyl-2-propanol as a hardening agent were added. A polyethylene terephthalate film was coated with the resulting emulsion in such an amount as to give a coating weight of 3.6 g/m² as silver. On this emulsion coating, there was simultaneously coated a layer containing gelatin (1.2 g/m2), amorphous $SiO_2$ matting agent having a particle size of about 3 μm (40 mg/m²), methanol silica (0.1 g/m²), polyacrylamide (100 mg/m²), hydroquinone (200 mg/m²), silicone oil, the following fluorine-containing surfactant as a coating aid:

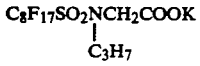

and sodium dodecylbenzenesulfonate as a protective layer to prepare each of the samples given in Table 1.

The back layer was coated by using the following formulation.

| Formulation for Back Layer | |
|---|---|
| Gelatin | 4 g/m² |
| Matting Agent (polymethyl methacrylate particles having a particle size of 3.0 to 4.0 μm) | 10 mg/m² |
| Latex of Polyethyl Acrylate | 2 g/m² |
| Surfactant (sodium p-dodecylbenzenesulfonate) | 40 mg/m² |
| Fluorine-Containing Surfactant | 5 mg/m² |
| 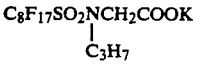 | |
| Hardener for Gelatin | 110 mg/m² |
| 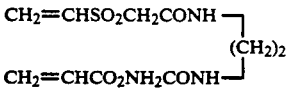 | |
| Dye Component (a mixture of Dyes (a), (b) and (c)) | |
| Dye (a) | 50 mg/m² |
| Dye (b) | 100 mg/m² |
| Dye (c) | 50 mg/m² |

Dye (a)

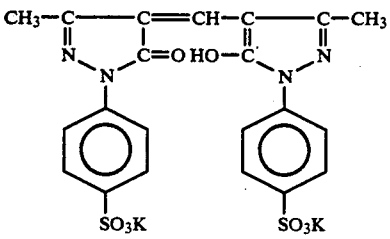

Dye (b)

-continued

Formulation for Back Layer

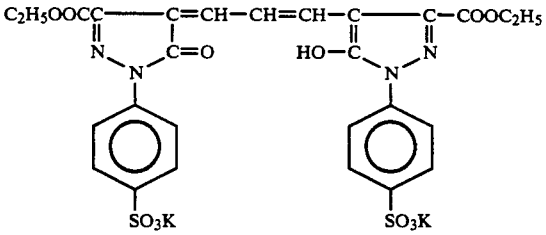

Dye (c)

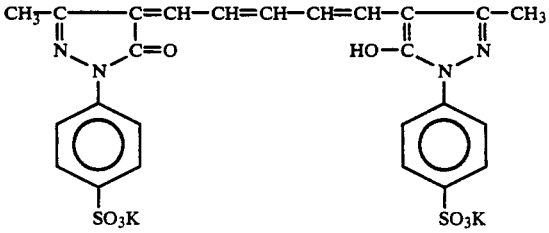

Evaluation was made by the following test methods.

PHOTOGRAPHIC CHARACTERISTICS

Photographic characteristics 1 were the results obtained by carrying out processing at 34° C. for 30 seconds with Developing Solution A having the above-described formulation in an FG-660F automatic processor (manufactured by Fuji Photo Film Co., Ltd.).

Photographic characteristics 2 were the results obtained by carrying out processing in the same manner as for the photographic characteristics 1 with the developing solution obtained after 150 sheets of 100% blackened Fuji lith ortho-film GA-100 complete size (50.8 cm×61 cm) were processed.

TEST METHODS

1. Evaluation of Halftone-Enlarged Image Quality (1) Preparation of the original The transparent image of a person, which was composed of halftone dots, and a step wedge, wherein dot percent was stepwise changed, were prepared by using a monochromatic scanner SCANART 30 (manufactured by Fuji Photo Film Co., Ltd.) and single photosensitive material SF-100 (manufactured by Fuji Photo Film Co., Ltd.). Screen ruling was 150 lines/inch.

(2) Shooting

Process camera C-440 (manufactured by Dainippon Screen K.K.) was set to the above-described original so that halftone enlargement magnification became actual size. The sample to be evaluated was then exposed by irradiating it with an Xe lamp.

Exposure was conducted so that the area of 95% of step wedge of the original became 5%.

(3) Evaluation

The samples were prepared to have the same dot percent of the small spot side (highlight area) by adjusting exposure amount as in the above (2). The evaluation was made in five grades (5–1) in order of quality of the gradation reproducibility of shadow area (difficulty in obscuring shadow detail) of the samples.

2. Evaluation of Image Quality of Line Original

There was used the original composed of 7Q Gothic type phototypeset letters and 7Q Ming-style letters wherein the line original had such a latitude that reflection density was in the range of 0.5 to 1.2. The original was photographed by using a camera (DSC 351) manufactured by Dainippon Screen K.K. Development (at 34° C. for 30 seconds) was then carried out under the same conditions as those for the photographic characteristics 1. The evaluation of the results was made in five grades in order of quality, i.e., the number 5 was the best quality and the number 1 was the worst quality. The number 5 or 4 could be put to practical use. The number 3 was poor, but could be put to practical use with difficulty. The number 2 or 1 was of no practical use. 3. Evaluation of Black Pepper Black pepper was evaluated in the following manner. The Developing Solution A having the above-described formulation was exhausted with time for one week without replenishment. When the pH was increased to 0.1 and the concentration of the sulfite ion was reduced to 30% of the fresh developing solution, processing was carried out in the same manner as that for the above-described photographic characteristics. Evaluation was then made in five grades by a microscopic inspection. The number 5 was the best quality and the number 1 was the worst quality. The number 5 or 4 could be put to practical use. The number 3 was poor, but could be put to practical use with difficulty. The number 2 or 1 was of no practical use.

It is apparent from Table 1 that the samples of the present invention, which contain the redox compound capable of releasing a development inhibitor when oxidized, are superior in the image qualities of the line original and "spread" and scarcely cause lowering in sensitivity, γ (gamma) and Dm in the photographic characteristics 2 in comparison with Samples 1-1 and 1-14 containing no redox compound.

Further, the samples comprising the monodisperse emulsion according to the present invention are superior in image quality and scarcely cause lowering in sensitivity, γ (gamma) and Dmax in the photographic characteristics 2 in particular as compared with the comparative samples comprising polydisperse emulsions or a mixture of monodisperse emulsions.

TABLE 1

| Sample No. | Emulsion | Compound of Formula (II) Kind | Compound of Formula (II) Added Amount* | Redox Compound of the Invention Kind | Redox Compound of the Invention Added Amount** | Photographic Characteristics 1 Sensitivity | Photographic Characteristics 1 Gamma | Photographic Characteristics 1 Dm | Photographic Characteristics 2 Sensitivity | Photographic Characteristics 2 Gamma | Photographic Characteristics 2 Dm | Image Quality Line Original | Image Quality Spread | Image Quality Black Pepper | Remarks |
|---|---|---|---|---|---|---|---|---|---|---|---|---|---|---|---|
| 1-1 | A | II-5 | $5 \times 10^{-5}$ | — | — | 100 | 10.0 | 4.8 | 77 | 7.5 | 3.5 | 2 | 2 | 3 | Comparison |
| 1-2 | A | " | " | 17 | $1.4 \times 10^{-5}$ | 95 | 9.5 | 4.6 | 85 | 8.7 | 4.2 | 4 | 4 | 4 | Invention |
| 1-3 | B | " | " | " | " | 100 | 9.0 | 4.2 | 80 | 7.0 | 3.6 | 3 | 3 | 4 | Comparison |
| 1-4 | C | " | " | " | " | 105 | 8.5 | 4.0 | 72 | 6.5 | 3.5 | 3 | 2 | 3 | " |
| 1-5 | D | " | " | " | " | 110 | 8.0 | 4.0 | 60 | 5.5 | 3.2 | 2 | 2 | 3 | " |
| 1-6 | A | " | " | 51 | $6.4 \times 10^{-5}$ | 98 | 9.8 | 4.6 | 88 | 9.0 | 4.2 | 4 | 4 | 4 | Invention |
| 1-7 | B | " | " | " | " | 105 | 9.2 | 4.2 | 85 | 7.4 | 3.6 | 3 | 3 | 4 | Comparison |
| 1-8 | C | " | " | " | " | 112 | 9.0 | 4.2 | 82 | 7.2 | 3.5 | 3 | 2 | 3 | " |
| 1-9 | D | " | " | " | " | 115 | 8.5 | 4.0 | 68 | 5.0 | 3.2 | 2 | 2 | 3 | " |
| 1-10 | A | " | " | 4 | $7.5 \times 10^{-6}$ | 90 | 9.5 | 4.6 | 80 | 8.8 | 4.2 | 4 | 4 | 4 | Invention |
| 1-11 | B | " | " | " | " | 98 | 9.0 | 4.2 | 76 | 7.0 | 3.5 | 3 | 3 | 4 | Comparison |
| 1-12 | C | " | " | " | " | 105 | 8.4 | 4.0 | 76 | 6.0 | 3.4 | 3 | 2 | 3 | " |
| 1-13 | D | " | " | " | " | 110 | 7.8 | 3.9 | 62 | 5.2 | 3.2 | 2 | 2 | 3 | " |
| 1-14 | A | II-19 | $1 \times 10^{-5}$ | — | — | 108 | 10.5 | 5.0 | 85 | 7.5 | 3.5 | 2 | 2 | 3 | Comparison |
| 1-15 | A | " | " | 17 | $1.4 \times 10^{-5}$ | 100 | 10.0 | 4.8 | 88 | 9.2 | 4.4 | 4 | 4 | 4 | Invention |
| 1-16 | B | " | " | " | " | 105 | 9.5 | 4.4 | 85 | 7.5 | 3.8 | 3 | 3 | 4 | Comparison |
| 1-17 | C | " | " | " | " | 110 | 9.0 | 4.2 | 75 | 7.0 | 3.6 | 3 | 2 | 3 | " |
| 1-18 | D | " | " | " | " | 115 | 8.5 | 4.2 | 65 | 6.0 | 3.3 | 2 | 2 | 3 | " |
| 1-19 | A | " | " | 51 | $6.4 \times 10^{-5}$ | 105 | 10.5 | 4.8 | 95 | 9.7 | 4.4 | 4 | 4 | 4 | Invention |
| 1-20 | B | " | " | " | " | 110 | 10.0 | 4.4 | 90 | 8.0 | 3.8 | 3 | 3 | 4 | Comparison |
| 1-21 | C | " | " | " | " | 118 | 9.8 | 4.2 | 85 | 7.8 | 3.6 | 3 | 2 | 3 | " |
| 1-22 | D | " | " | " | " | 120 | 9.0 | 4.0 | 70 | 6.8 | 3.3 | 2 | 2 | 3 | " |
| 1-23 | A | " | " | 4 | $7.5 \times 10^{-6}$ | 96 | 10.0 | 4.8 | 85 | 9.2 | 4.4 | 4 | 4 | 4 | Invention |
| 1-24 | B | " | " | " | " | 102 | 9.6 | 4.4 | 80 | 8.3 | 3.8 | 3 | 3 | 4 | Comparison |
| 1-25 | C | " | " | " | " | 108 | 9.2 | 4.3 | 78 | 7.2 | 3.6 | 3 | 2 | 3 | " |
| 1-26 | D | " | " | " | " | 115 | 8.7 | 4.0 | 65 | 6.5 | 3.4 | 2 | 2 | 3 | " |

*mol/mol of Ag,
**mol/m²

EXAMPLE 2

Emulsions E and F were prepared in the following manner.

EMULSION E

A cubic monodisperse silver iodobromide emulsion (coefficient of variation: 0.15, silver iodide: 0.5 mol %, iodine distribution being uniform) having a grain size of 0.25 μm was prepared by a controlled double jet process in the same way as in the preparation of Emulsion A except that $K_3IrCl_6$ was added in such an amount as to give a content of $4 \times 10^{-7}$ mol/mol of Ag.

EMULSION F

A cubic silver iodobromide emulsion (silver iodide: 0.5 mol %, iodine distribution being uniform) having a grain size of 0.25 μm and containing $K_3IrCl_6$ in an amount of $4 \times 10^{-7}$ mol/mol of Ag was prepared by a controlled double jet process in the same way as in the preparation of Emulsion E except that the rate (the number of revolutions) of stirring was lowered to obtain grains having a coefficient of variation of 0.30.

In the same manner as in the preparation of Emulsion A, the emulsion was desalted by a flocculation method, the antiseptic was added thereto and the temperature of the emulsion was kept at 50° C. Compound (a) as the sensitizing dye and the potassium iodide solution were added thereto. After the lapse of 15 minutes, the temperature was lowered.

Coating was carried out by using Emulsion A obtained in Example 1 and Emulsions E and F to prepare each of the Samples given in Table 2. Evaluation was made by using the test methods described in Example 1.

It is apparent from Table 2 that the sample comprising monodisperse Emulsion E containing iridium according to the present invention has high sensitivity, γ (gamma) value and Dm value in the photographic characteristics 1, scarcely causes lowering in sensitivity, γ (gamma) and Dm in the photographic characteristics 2 and is superior in image quality.

Table 3 was made by using the test methods described in Example 1.

It is apparent from Table 3 that the samples containing the polymer according to the present invention cause less lowering in sensitivity, γ (gamma) and Dm in the photographic characteristics 2 and are superior in the image qualities of the line original and "spread". Namely, the samples have high processing stability, give images of high quality and have improved property with regard to black pepper.

TABLE 2

| Sample No. | Emulsion | Compound of Formula (II) Kind | Compound of Formula (II) Added Amount* | Redox Compound of the Invention Kind | Redox Compound of the Invention Added Amount** | Photographic Characteristics 1 Sensitivity | Photographic Characteristics 1 Gamma | Photographic Characteristics 1 Dm | Photographic Characteristics 2 Sensitivity | Photographic Characteristics 2 Gamma | Photographic Characteristics 2 Dm | Image Quality Line Original | Image Quality Spread | Image Quality Black Pepper | Remarks |
|---|---|---|---|---|---|---|---|---|---|---|---|---|---|---|---|
| 2-1 | A | II-5 | $5 \times 10^{-5}$ | 17 | $1.4 \times 10^{-5}$ | 95 | 9.5 | 4.6 | 85 | 8.7 | 4.2 | 4 | 4 | 4 | Invention |
| 2-2 | E | " | " | " | " | 150 | 15.0 | 5.5 | 144 | 14.4 | 5.1 | 5 | 4 | 4 | Invention |
| 2-3 | F | " | " | " | " | 160 | 10.5 | 4.6 | 120 | 7.5 | 3.8 | 3 | 3 | 3 | Comparison |
| 2-4 | A | " | " | 51 | $6.4 \times 10^{-5}$ | 98 | 9.8 | 4.6 | 88 | 9.0 | 4.2 | 4 | 4 | 4 | Invention |
| 2-5 | E | " | " | " | " | 160 | 16.0 | 5.6 | 155 | 15.5 | 5.3 | 5 | 4 | 4 | Invention |
| 2-6 | F | " | " | " | " | 165 | 11.0 | 4.7 | 120 | 8.0 | 3.8 | 3 | 3 | 3 | Comparison |
| 2-7 | A | " | " | 4 | $7.5 \times 10^{-6}$ | 90 | 9.5 | 4.6 | 80 | 8.8 | 4.2 | 4 | 4 | 4 | Invention |
| 2-8 | E | " | " | " | " | 145 | 15.0 | 5.5 | 138 | 14.5 | 5.1 | 4 | 5 | 4 | Invention |
| 2-9 | F | " | " | " | " | 155 | 10.5 | 4.6 | 115 | 7.5 | 3.8 | 3 | 3 | 3 | Comparison |
| 2-10 | A | II-19 | $1 \times 10^{-5}$ | 17 | $1.4 \times 10^{-5}$ | 100 | 10.0 | 4.8 | 88 | 9.2 | 4.4 | 4 | 4 | 4 | Invention |
| 2-11 | E | " | " | " | " | 160 | 15.5 | 5.6 | 152 | 14.8 | 5.2 | 5 | 4 | 4 | Invention |
| 2-12 | F | " | " | " | " | 170 | 11.0 | 4.7 | 130 | 8.0 | 3.8 | 3 | 3 | 3 | Comparison |
| 2-13 | A | " | " | 51 | $6.4 \times 10^{-5}$ | 105 | 10.5 | 4.8 | 95 | 9.7 | 4.4 | 4 | 4 | 4 | Invention |
| 2-14 | E | " | " | " | " | 170 | 16.5 | 5.8 | 162 | 16.0 | 5.5 | 5 | 4 | 4 | Invention |
| 2-15 | F | " | " | " | " | 175 | 11.5 | 4.7 | 135 | 8.3 | 3.8 | 3 | 3 | 3 | Comparison |
| 2-16 | A | II-19 | $1 \times 10^{-5}$ | 4 | $7.5 \times 10^{-6}$ | 96 | 10.0 | 4.8 | 85 | 9.2 | 4.4 | 4 | 4 | 4 | Invention |
| 2-17 | E | " | " | " | " | 150 | 15.0 | 5.6 | 145 | 14.4 | 5.2 | 4 | 5 | 4 | Invention |
| 2-18 | F | " | " | " | " | 160 | 10.5 | 4.6 | 120 | 7.7 | 3.7 | 3 | 3 | 3 | Comparison |

*mol/mol of Ag.
**mol/m$^2$

TABLE 3

| Sample No. | Emulsion | Redox Compound of the Invention Kind | Redox Compound of the Invention Added Amount* | Compound of Formula (III) Kind | Compound of Formula (III) Added Amount** | Photographic Characteristics 1 Sensitivity | Photographic Characteristics 1 Gamma | Photographic Characteristics 1 Dm | Photographic Characteristics 2 Sensitivity | Photographic Characteristics 2 Gamma | Photographic Characteristics 2 Dm | Image Quality Line Original | Image Quality Spread | Image Quality Black Pepper | Remarks |
|---|---|---|---|---|---|---|---|---|---|---|---|---|---|---|---|
| 3-1 | A | 51 | $6.4 \times 10^{-5}$ | — | — | 98 | 9.8 | 4.6 | 88 | 9.0 | 4.2 | 4 | 4 | 4 | Invention |
| 3-2 | " | — | — | 1 | 0.35 | 100 | 9.8 | 4.5 | 80 | 7.2 | 3.5 | 2 | 2 | 4 | Comparison |
| 3-3 | " | 51 | $6.4 \times 10^{-5}$ | " | " | 98 | 9.7 | 4.6 | 88 | 9.0 | 4.2 | 4 | 4 | 5 | Invention |
| 3-4 | " | " | " | 3 | " | 96 | 9.8 | 4.6 | 85 | 8.8 | 4.2 | 4 | 4 | 5 | " |
| 3-5 | " | " | " | 4 | " | 98 | 9.8 | 4.6 | 88 | 9.0 | 4.2 | 4 | 4 | 5 | " |
| 3-6 | " | 4 | $7.5 \times 10^{-6}$ | — | — | 90 | 9.5 | 4.6 | 80 | 8.8 | 4.2 | 4 | 4 | 4 | " |
| 3-7 | " | " | " | 1 | 0.35 | 90 | 9.6 | 4.7 | 80 | 8.8 | 4.4 | 4 | 4 | 5 | " |
| 3-8 | " | " | " | 3 | " | 88 | 9.6 | 4.6 | 77 | 8.7 | 42 | 4 | 4 | 5 | " |
| 3-9 | " | " | " | 4 | " | 88 | 9.4 | 4.6 | 78 | 8.5 | 4.2 | 4 | 4 | 5 | " |
| 3-10 | E | 51 | $6.4 \times 10^{-5}$ | — | — | 160 | 16.0 | 5.6 | 155 | 15.5 | 5.3 | 5 | 4 | 4 | " |
| 3-11 | " | — | — | 1 | 0.35 | 160 | 15.0 | 5.6 | 140 | 13.2 | 4.5 | 2 | 2 | 4 | Comparison |
| 3-12 | " | 51 | $6.4 \times 10^{-5}$ | " | " | 155 | 16.0 | 5.6 | 150 | 15.5 | 5.3 | 5 | 4 | 5 | Invention |
| 3-13 | " | 51 | " | 3 | " | 150 | 15.5 | 5.5 | 144 | 14.8 | 5.2 | 5 | 4 | 5 | " |
| 3-14 | " | 51 | " | 4 | " | 150 | 15.5 | 5.6 | 145 | 14.8 | 5.2 | 5 | 4 | 5 | " |

*mol/m$^2$,
**mol/mol of Ag

EXAMPLE 3

Compound II-5 as the hydrazine compound in an amount of $5 \times 10^{-5}$ mol/mol of Ag, the redox compound of the present invention and the polymer of formula (III) in amounts given in Table 3 were added to each of Emulsion A of Example 1 and Emulsion E. Coating was carried out in the same manner as in Example 1. The evaluation of the resulting samples given in

EXAMPLE 4

Compound II-5 as the hydrazine compound in an amount of $5 \times 10^{-5}$ mol/mol of Ag, the redox compound of the present invention in amounts given in Table 4 and the short wave monomethine dye of formula (IV) in an amount given in Table 4 were added to each of Emulsion A of Example 1 and Emulsion E. Coating was carried out in the same manner as in Example 1. The evaluation of the resulting samples given in Table 4 was made by using the test methods described in Example 1.

It is apparent from Table 4 that the samples containing the short wave monomethine dye according to the present invention have high processing stability, give images of high quality and have improved property with regard to black pepper.

evaluation of the resulting samples given in Table 5 was made by using the test methods described in Example 1.

It is apparent from Table 5 that the samples containing the thioamido compound according to the present invention have high sensitivity, γ (gamma) value and Dm value in the photographic characteristics 1 and causes less lowering in sensitivity, γ (gamma) value and Dm value in the photographic characteristics 2.

TABLE 4

| Sample No. | Emulsion | Redox Compound of the Invention | | Compound of Formula (IV) | | Photographic Characteristics 1 | | | Photographic Characteristics 2 | | | Image Quality | | | Remarks |
|---|---|---|---|---|---|---|---|---|---|---|---|---|---|---|---|
| | | Kind | Added Amount* | Kind | Added Amount** | Sensitivity | Gamma | Dm | Sensitivity | Gamma | Dm | Line Original | Spread | Black Pepper | |
| 4-1 | A | 51 | $6.4 \times 10^{-5}$ | — | — | 98 | 9.8 | 4.6 | 88 | 9.0 | 4.2 | 4 | 4 | 4 | Invention |
| 4-2 | " | — | — | IV-10 | $4 \times 10^{-4}$ | 90 | 9.8 | 4.6 | 70 | 7.8 | 3.6 | 2 | 2 | 4 | Comparison |
| 4-3 | " | 51 | $6.4 \times 10^{-5}$ | " | " | 95 | 9.8 | 4.6 | 85 | 9.0 | 4.2 | 4 | 4 | 5 | Invention |
| 4-4 | " | " | " | IV-3 | $2 \times 10^{-4}$ | 92 | 9.6 | 4.6 | 82 | 8.8 | 4.2 | 4 | 4 | 5 | " |
| 4-5 | " | " | " | IV-15 | " | 90 | 9.6 | 4.6 | 80 | 8.6 | 4.2 | 4 | 4 | 5 | " |
| 4-6 | " | " | " | IV-26 | $4 \times 10^{-4}$ | 90 | 9.6 | 4.6 | 80 | 8.6 | 4.2 | 4 | 4 | 5 | " |
| 4-7 | " | " | " | Iv-27 | " | 95 | 9.8 | 4.6 | 85 | 8.8 | 4.3 | 4 | 4 | 5 | " |
| 4-8 | " | 4 | $7.5 \times 10^{-6}$ | — | — | 90 | 9.5 | 4.6 | 80 | 8.8 | 4.2 | 4 | 4 | 4 | " |
| 4-9 | " | " | " | IV-10 | $4 \times 10^{-4}$ | 85 | 9.6 | 4.6 | 75 | 8.8 | 4.2 | 4 | 4 | 5 | " |
| 4-10 | " | " | " | IV-27 | " | 88 | 9.6 | 4.6 | 78 | 8.8 | 4.3 | 4 | 4 | 5 | " |
| 4-11 | E | 51 | $6.4 \times 10^{-5}$ | — | — | 160 | 16.0 | 5.6 | 155 | 15.5 | 5.3 | 5 | 4 | 4 | " |
| 4-12 | " | — | — | IV-10 | $4 \times 10^{-4}$ | 150 | 16.0 | 5.5 | 130 | 13.5 | 4.6 | 2 | 2 | 4 | Comparison |
| 4-13 | " | 51 | $6.4 \times 10^{-5}$ | " | " | 150 | 16.5 | 5.6 | 145 | 15.8 | 5.2 | 5 | 4 | 5 | Invention |
| 4-14 | " | " | " | IV-27 | " | 150 | 16.0 | 5.5 | 145 | 15.5 | 5.2 | 5 | 4 | 5 | " |

*mol/m$^2$,
**mol/mol of Ag

TABLE 5

| Sample No. | Emulsion | Redox Compound of the Invention | | Compound of Formula (V) | | Photographic Characteristics 1 | | | Photographic Characteristics 2 | | | Image Quality | | | Remarks |
|---|---|---|---|---|---|---|---|---|---|---|---|---|---|---|---|
| | | Kind | Added Amount* | Kind | Added Amount** | Sensitivity | Gamma | Dm | Sensitivity | Gamma | Dm | Line Original | Spread | Black Pepper | |
| 5-1 | A | 51 | $6.4 \times 10^{-5}$ | — | — | 98 | 9.8 | 4.6 | 88 | 9.0 | 4.2 | 4 | 4 | 4 | Invention |
| 5-2 | " | — | — | V-12 | $5 \times 10^{-4}$ | 105 | 10.0 | 4.6 | 80 | 7.8 | 3.8 | 2 | 2 | 4 | Comparison |
| 5-3 | " | 51 | $6.4 \times 10^{-5}$ | " | " | 120 | 12.0 | 5.0 | 112 | 11.4 | 4.8 | 4 | 4 | 4 | Invention |
| 5-4 | " | " | " | V-6 | " | 115 | 11.5 | 4.9 | 108 | 10.8 | 4.7 | 4 | 4 | 4 | " |
| 5-5 | " | " | " | V-24 | " | 115 | 11.5 | 5.0 | 108 | 11.0 | 4.8 | 4 | 4 | 4 | " |
| 5-6 | " | 4 | $7.5 \times 10^{-6}$ | — | — | 90 | 9.5 | 4.6 | 80 | 8.8 | 4.2 | 4 | 4 | 4 | " |
| 5-7 | " | " | " | V-12 | $1 \times 10^{-3}$ | 115 | 11.0 | 5.0 | 108 | 10.5 | 4.8 | 4 | 4 | 4 | " |
| 5-8 | " | " | " | V-6 | " | 115 | 10.5 | 5.0 | 108 | 9.8 | 4.7 | 4 | 4 | 4 | " |
| 5-9 | " | " | " | V-24 | " | 110 | 11.0 | 5.0 | 100 | 10.2 | 4.7 | 4 | 4 | 4 | " |
| 5-10 | E | 51 | $6.4 \times 10^{-5}$ | — | — | 160 | 16.0 | 5.6 | 155 | 15.5 | 5.3 | 5 | 4 | 4 | " |
| 5-11 | " | — | — | V-24 | $1 \times 10^{-3}$ | 165 | 16.5 | 5.6 | 140 | 13.8 | 4.2 | 2 | 2 | 4 | Comparison |
| 5-12 | " | 51 | $6.4 \times 10^{-5}$ | V-12 | " | 180 | 18.0 | 6.0 | 175 | 17.2 | 5.7 | 5 | 4 | 4 | Invention |
| 5-13 | " | " | " | V-6 | " | 175 | 17.5 | 5.9 | 168 | 16.8 | 5.5 | 5 | 4 | 4 | " |
| 5-14 | " | " | " | V-24 | " | 175 | 18.0 | 5.9 | 168 | 17.2 | 5.5 | 5 | 4 | 4 | " |

*mol/m$^2$,
**mol/mol of Ag

EXAMPLE 5

Compound II-5 as the hydrazine compound in an amount of $5 \times 10^{-5}$ mol/mol of Ag, the redox compound of the present invention in an amount given in Table 5 and the thioamido compound of formula (V) in an amount given in Table 5 were added to each of Emulsion A of Example 1 and Emulsion E. Coating was carried out in the same manner as in Example 1. The

EXAMPLE 6

Compound II-5 as the hydrazine compound in an amount of $5 \times 10^{-5}$ mol/mol of Ag, the redox compound of the present invention in an amount given in Table 6 and dye having an absorption peak at 300 to 420 nm in an amount given in Table 6 were added to each of Emulsion A of Example 1 and Emulsion E. Coating was carried out in the same manner as in Example 1. The evaluation of the resulting samples given in Table 6 was made by using the test methods described in Example 1.

It is apparent from Table 6 that the samples containing the dye having an absorption peak at 300 to 420 nm have further improved properties with regard to the image quality of "spread" in particular.

TABLE 6

| Sample No. | Emulsion | Redox Compound of the Invention Kind | Redox Compound of the Invention Added Amount* | Compound of Formula (D) Kind | Compound of Formula (D) Added Amount** | Photographic Characteristics 1 Sensitivity | Photographic Characteristics 1 Gamma | Photographic Characteristics 1 Dm | Photographic Characteristics 2 Sensitivity | Photographic Characteristics 2 Gamma | Photographic Characteristics 2 Dm | Image Quality Line Original | Image Quality Spread | Image Quality Black Pepper | Remarks |
|---|---|---|---|---|---|---|---|---|---|---|---|---|---|---|---|
| 6-1 | A | 51 | $6.4 \times 10^{-5}$ | — | — | 98 | 9.8 | 4.6 | 88 | 9.0 | 4.2 | 4 | 4 | 4 | Invention |
| 6-2 | " | — | — | D-23 | 200 | 95 | 9.4 | 4.5 | 72 | 7.6 | 3.6 | 2 | 2 | 4 | Comparison |
| 6-3 | " | 51 | $6.4 \times 10^{-5}$ | " | " | 90 | 9.8 | 4.6 | 80 | 9.2 | 4.2 | 5 | 5 | 4 | Invention |
| 6-4 | " | " | " | D-19 | " | 90 | 9.6 | 4.6 | 80 | 9.0 | 4.2 | 4 | 5 | 4 | " |
| 6-5 | " | " | " | D-20 | " | 88 | 9.8 | 4.5 | 78 | 9.0 | 4.2 | 5 | 5 | 4 | " |
| 6-6 | " | " | " | D-24 | " | 90 | 10.0 | 4.6 | 80 | 9.3 | 4.2 | 5 | 5 | 4 | " |
| 6-7 | " | 4 | $7.5 \times 10^{-6}$ | — | — | 90 | 9.5 | 4.6 | 80 | 8.8 | 4.2 | 4 | 4 | 4 | " |
| 6-8 | " | " | " | D-23 | 100 | 85 | 9.8 | 4.6 | 75 | 9.0 | 4.2 | 5 | 5 | 4 | " |
| 6-9 | " | " | " | D-19 | " | 82 | 9.5 | 4.5 | 72 | 8.8 | 4.2 | 4 | 5 | 4 | " |
| 6-10 | " | " | " | D-20 | " | 80 | 9.8 | 4.6 | 70 | 9.0 | 4.2 | 5 | 5 | 4 | " |
| 6-11 | " | " | " | D-24 | " | 85 | 9.5 | 4.6 | 75 | 8.5 | 4.2 | 4 | 5 | 4 | " |
| 6-12 | E | 51 | $6.4 \times 10^{-5}$ | — | — | 160 | 16.0 | 5.6 | 155 | 15.5 | 5.3 | 5 | 4 | 4 | " |
| 6-13 | " | — | — | D-19 | 400 | 150 | 15.5 | 5.4 | 125 | 12.0 | 4.5 | 2 | 2 | 4 | Comparison |
| 6-14 | " | 51 | $6.4 \times 10^{-5}$ | " | " | 150 | 16.0 | 5.6 | 144 | 15.5 | 5.2 | 5 | 5 | 4 | Invention |
| 6-15 | " | " | " | D-23 | " | 145 | 16.0 | 5.6 | 140 | 15.5 | 5.2 | 5 | 5 | 4 | " |
| 6-16 | E | 51 | $6.4 \times 10^{-5}$ | D-20 | 400 | 145 | 15.5 | 5.5 | 140 | 15.0 | 5.1 | 5 | 5 | 4 | Invention |
| 6-17 | " | " | " | D-24 | " | 150 | 15.5 | 5.6 | 145 | 15.0 | 5.2 | 5 | 5 | 4 | " |

*mol/m², **mg/m²

EXAMPLE 7

The procedures of Examples 1 to 6 were repeated except that each of Developing Solutions B and C was used in place of Developing Solution A.

The resulting samples of the present invention had excellent characteristics as in Examples 1 to 6.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one sensitive silver halide emulsion layer, wherein said emulsion layer comprises a monodisperse emulsion which comprises silver halide grains containing an iridium salt in an amount of at least $10^{-8}$ mol per mol of silver, and said emulsion layer or another hydrophilic colloid layer contains at least one hydrazine compound according to formula (II) below and at least one redox compound according to formula (I) which is capable of releasing a development inhibitor when oxidized by the oxidation product of a developer:

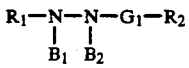

(II)

wherein $R_1$ represents an aliphatic group or an aromatic group; $R_2$ represents a hydrogen atom, an alkyl group, an aryl group, an alkoxy group, or aryloxy group, an amino group, a carbamoyl group or an oxycarbonyl group; $G_1$ represents a carbonyl group, a sulfonyl group, a sulfoxy group, a group of

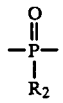

or an iminomethylene group; and both $B_1$ and $B_2$ represent hydrogen atoms, or one of $B_1$ and $B_2$ is a hydrogen atom and the other is a substituted or unsubstituted alkylsulfonyl group, a substituted or unsubstituted arylsulfonyl group or a substituted or unsubstituted acyl group;

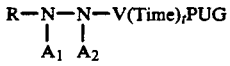

(I)

wherein both $A_1$ and $A_2$ represent hydrogen atoms, or one of $A_1$ and $A_2$ represents a hydrogen atom and the other represents a residue of a sulfinic acid or

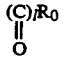

(wherein $R_0$ represents an alkyl group, an alkenyl group, an aryl group, an alkoxy group or an aryloxy group; and l represents 1 or 2); t represents 0 or 1; Time represents a bivalent bonding group; PUG represents a development inhibitor; V represents a carbonyl group,

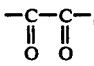

a sulfonyl group, a sulfoxy group,

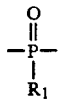

(wherein $R_1$ represents an alkoxy group or an aryloxy group), an iminomethylene group or a thiocarbonyl group; and R represents an aliphatic group, an aromatic group or a heterocyclic group.

2. A silver halide photographic material as in claim 1, wherein said emulsion layer or other hydrophilic colloid emulsion further contains a compound represented by formula (IV):

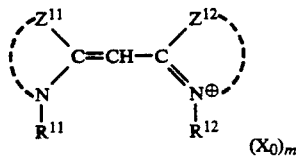

(IV)

wherein $Z^{11}$ and $Z^{12}$ are each a nonmetallic atomic group required for the formation of a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus or a quinoline nucleus; $R^{11}$ and $R^{12}$ are each an alkyl group or an aralkyl group and at least one thereof has an acid radical; $X_0$ is a counter ion for charge balance; m is 0 or 1.

3. A silver halide photographic material as in claim 1, wherein said emulsion layer or other photographic colloid emulsion further contains a polymer having a repeating unit derived from the monomer represented by formula (III):

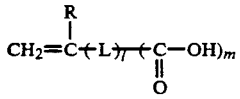

(III)

wherein R is a hydrogen atom or a substituted or unsubstituted alkyl group; L is a bivalent, trivalent or tetravalent bonding group; l is 0 or 1; and m is 1, 2 or 3.

4. A silver halide photographic material as in claim 1, wherein said emulsion layer or other hydrophilic colloid emulsion further contains a thioamido compound represented by formula (V):

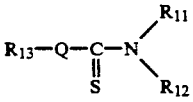

(V)

wherein $R_{13}$ is a hydrogen atom, an alkyl group, an aryl group or a residue of a heterocyclic ring; Q is a single bond, a sulfur atom, a selenium atom, an oxygen atom or a bivalent group selected from the group consisting of a disulfide group (—S—S—), $NR_{14}$,

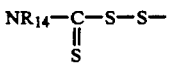

or $NR_{14}CS$ (wherein $R_{14}$ has the same meaning as $R_{13}$); and $R_{11}$ and $R_{12}$ are each a hydrogen atom, an alkyl group, an aryl group, a residue of a heterocyclic ring or an amino group.

5. A silver halide photographic material as in claim 1, wherein said emulsion layer or other hydrophilic colloid emulsion further contains a dye represented by formulae (D-I), (D-II), (D-III) or (D-IV):

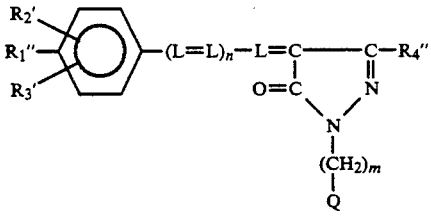

(D-I)

wherein $R_1''$ is an atomic group represented by —OX or

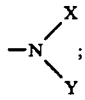

X and Y are each a hydrogen atom, an alkyl group, a cyanoalkyl group, a carboxyalkyl group, a sulfoalkyl group, a hydroxyalkyl group, a halogenated alkyl group or an alkyl group which may be substituted, or may be in the form of sodium or potassium salt; $R_2''$ and $R_3''$ are each a hydrogen atom, a halogen atom, an alkyl group, a hydroxyl group, an alkoxy group, an alkylthio group or the same as those set forth in —OX group; Q is a phenyl group substituted by at least one member of a halogen atom, a carboxyl group, a sulfo group or a sulfoalkyl group (these substituent groups being optionally in the form of sodium or potassium salt), or Q is a sulfoalkyl group, a sulfoalkoxyalkyl group or a sulfoalkylthioalkyl group; L is a methine group which may be substituted; $R_4''$ is an alkyl group, a carboxyl group, an alkyloxycarbonyl group or an acyl-substituted or unsubstituted amino group; m is an integer of 1 or 2; and n is an integer of 0 or 1;

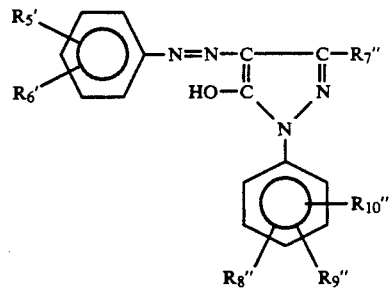

(D-II)

wherein $R_5''$, $R_6''$, $R_8''$, $R_9''$ and $R_{10}''$ are each a hydrogen atom, an alkyl group, a hydroxyl group, an alkoxy group, an amino group, an acylamino group, a carboxyl group or a sulfo group, these groups being optionally in the form of sodium or potassium salt; and $R_7''$ is an alkyl group or a carboxyl group;

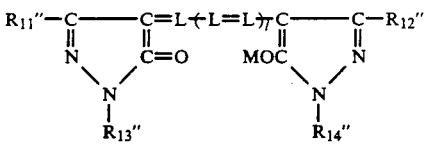

(D-III)

wherein $R_{11}''$ and $R_{12}''$ are each an alkyl group, a substituted alkyl group, an aryl group, an alkoxycarbonyl group or a carboxyl group; $R_{13}''$ and $R_{14}''$ are each a sulfo group- or carboxyl group-substituted alkyl group, a sulfo group- or carboxyl group-substituted aryl group, these groups being optionally in the form of sodium or potassium salt; L is a substituted or unsubstituted methine chain; M is sodium, potassium or hydrogen; l is 0 or 1;

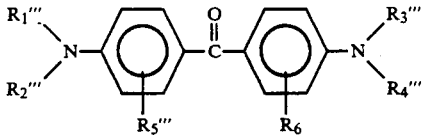

(D-IV)

wherein $R_1'''$, $R_2'''$, $R_3'''$ and $R_4'''$ are each an alkyl group, a hydroxyalkyl group, a cyano group, an alkylcyano group, an alkoxy group or a sulfoalkyl group; and $R_5'''$ and $R_6'''$ are each a sulfo group or an alkylsulfo group.

* * * * *